United States Patent [19]

Yamauchi et al.

[11] Patent Number: 4,616,817

[45] Date of Patent: Oct. 14, 1986

[54] PAPER SHEET DISPENSING APPARATUS

[75] Inventors: Masahide Yamauchi, Kawasaki; Minoru Hirose, Yokohama, both of Japan

[73] Assignee: Kabushiki Kaisha Toshiba, Kawasaki, Japan

[21] Appl. No.: 606,684

[22] Filed: May 3, 1984

[30] Foreign Application Priority Data

May 9, 1983 [JP] Japan ..... 58-80291

[51] Int. Cl.[4] ..... B65H 3/44

[52] U.S. Cl. ..... 271/9; 271/3.1; 271/111

[58] Field of Search ..... 271/3, 3.1, 9, 110, 271/111, 101, 166, 189, 214, 187, 315

[56] References Cited

U.S. PATENT DOCUMENTS 4,465,193 8/1984 Kokubo ..... 271/3.1 X
4,501,416 2/1985 Hain ..... 271/3.1

FOREIGN PATENT DOCUMENTS 418626 10/1934 United Kingdom .
940427 10/1963 United Kingdom .
1234910 6/1971 United Kingdom .
1301759 1/1973 United Kingdom .
1443089 7/1976 United Kingdom .
2114104 8/1983 United Kingdom .

*Primary Examiner*—Richard A. Schacher
*Attorney, Agent, or Firm*—Cushman, Darby & Cushman

[57] ABSTRACT

In a paper sheet dispensing apparatus according to the present invention, horizontally stacked bills are removed by a dispensing roller through a dispensing port one by one. When the dispensing operation is completed, one end of the stack of bills which is located furthest away from the dispensing port is held by an upper flapper, and the stack is moved by a predetermined distance in a stacking direction away from the position of the dispensing roller as the upper flapper moves. Thereafter, the upper flapper from the stack of bills is released, and the stack is moved toward the dispensing roller by an urging force of a spring and is brought into contact with the dispensing roller.

19 Claims, 69 Drawing Figures

| LOADING | | |
|---|---|---|
| DENOMI. | NUMBER | TOTAL |
| 100 | 600 | 60,000 |
| 10 | 300 | 3,000 |
| G.T. | | 63,000 |

PAPER SHEET DISPENSING APPARATUS

BACKGROUND OF THE INVENTION

The present invention relates to a paper sheet dispensing apparatus for dispensing horizontally stacked paper sheets one by one and, more particularly, a paper sheet dispensing apparatus such as a bank note dispensing apparatus used in a receiving/dispensing section of an automatic teller machine.

Recently, many automatic teller machines (ATMs) are being installed in automated corners of bank branches. ATMs allow customers to automatically withdraw and deposit cash (bills) by using a bank card or a passbook. The ATM can continue to serve even outside banking hours. In addition, ATMs can be installed in department stores and supermarkets, and the number of ATMs being installed is increasing and will continue to do so.

Widespread application of the ATM is accompanied by important effects on issues such as the effective utilization of capital, a decrease in labor, and banking systems. In order to achieve the effective utilization of capital, an ATM has been developed and is available wherein bills received by the ATM are subsequently used as bills to be dispensed thereby.

In an ATM of this type, the bill take-in and take-out sections as the bill dispensing apparatus in the bill receiving/dispensing section are provided in the same position along the same direction.

However, in the bill dispensing apparatus of this type, after a given number of bills have been removed from the receiving/dispensing section, subsequent bills may be accidentally partially removed. Under this circumstance, proper stacking cannot be performed, resulting in inconvenience.

SUMMARY OF THE INVENTION

The present invention has been made in consideration of the above situation. Its object is to provide a paper sheet dispensing apparatus capable of storing half-dispensed bills in a standby state when a predetermined number of bills have been removed.

In order to achieve the above object of the present invention, horizontally stacked bills are removed by a dispensing means through a dispensing port one by one. When the dispensing operation is completed, one end of the stack of bills which is located furthest away from the dispensing port is held by a holding means, and the stack is moved by a predetermined distance in a stacking direction away from the position of the dispensing means. Thereafter, the holding means is released, and the stack is moved toward the dispensing means and is brought into contact with the dispensing means.

According to one aspect of the present invention, a paper sheet dispensing apparatus comprises storage means for stacking paper sheets along a predetermined stacking direction, said storage means having an outlet port at one end thereof, rotating means, rotatably disposed at said outlet port, for engaging with one of the paper sheets stacked in one end of said storage means, biasing means for biasing the paper sheets toward said rotating means so as to engage said rotating means with one of the paper sheets, first driving means for driving said rotating means and removing outside said storage means the paper sheet engaging with said rotating means through said outlet port upon rotation of said rotating means, first engaging means, disposed to be movable along the predetermined stacking direction, for freely engaging with an end of the paper sheet which is located in a position opposite to the side of said outlet port, second driving means for moving said first engaging means to be apart from said rotating means along the predetermined stacking direction, and third driving means for moving said first engaging means and disengaging the paper sheet from said first engaging means after said first engaging means is moved by said second driving means, whereby the paper sheets disengaged by said third driving means from said first engaging means are engaged with said rotating means by the biasing force of said biasing means.

BRIEF DESCRIPTION OF THE DRAWINGS

FIGS. 1 to 36 show an automatic bank note transaction apparatus in which one embodiment of a paper sheet dispensing apparatus is used as a bank note dispensing apparatus; in which FIG. 1 is a partial cutaway perspective view showing the outer appearance of an automatic bank note transaction apparatus;

FIGS. 3 to 6 are side views showing different operating states of a bill receiving/dispensing unit of the mechanism shown in FIGS. 2A and 2B;

FIG. 7 is a side view showing a temporary stacking section;

FIG. 8 is a side view showing a bill stacking/dispensing unit;

FIG. 9 is a schematic plan view showing a separator mechanism and a bill take-out mechanism;

FIG. 10 is a plan view showing the bill take-out mechanism;

FIG. 11 is a side view showing the relationship between a rotating member and an idler roller;

FIG. 12 is a side view for explaining the operation of a movable member;

FIG. 14 is a plan view for explaining the configuration of the flappers;

FIG. 15 is a side view showing the arrangement of a bill detecting mechanism;

FIGS. 16 to 19 are side views showing different operating states of the bill stacking/dispensing unit;

FIG. 20 is a schematic block diagram showing the overall configuration of a control system;

FIG. 21 is a plan view showing the arrangement of a display section in an internal monitor;

FIG. 22 is a plan view showing the arrangement of a display section in a remote monitor;

FIG. 24 is a side view showing a bill flow in the deposit transaction mode;

FIG. 26 is a flow chart for explaining the operation of the main parts in a deposit return mode;

FIG. 28 is a side view showing a bill flow in the deposit return mode;

FIG. 31 is a side view showing a bill flow in the withdrawal transaction mode;

FIG. 32 is a side view showing a bill flow in a recover mode;

FIG. 34 is a side view showing a bill flow in the loading mode;

FIG. 35 is a plan view showing the printed state of a journal in the loading mode; and FIG. 36 is a side view showing a bill flow in a loaded bill return mode.

DETAILED DESCRIPTION OF THE PREFERRED EMBODIMENT

An automatic bank note (banking) transaction apparatus according to are embodiment of the present invention will be described with reference to the accompanying drawings.

Figure 1:
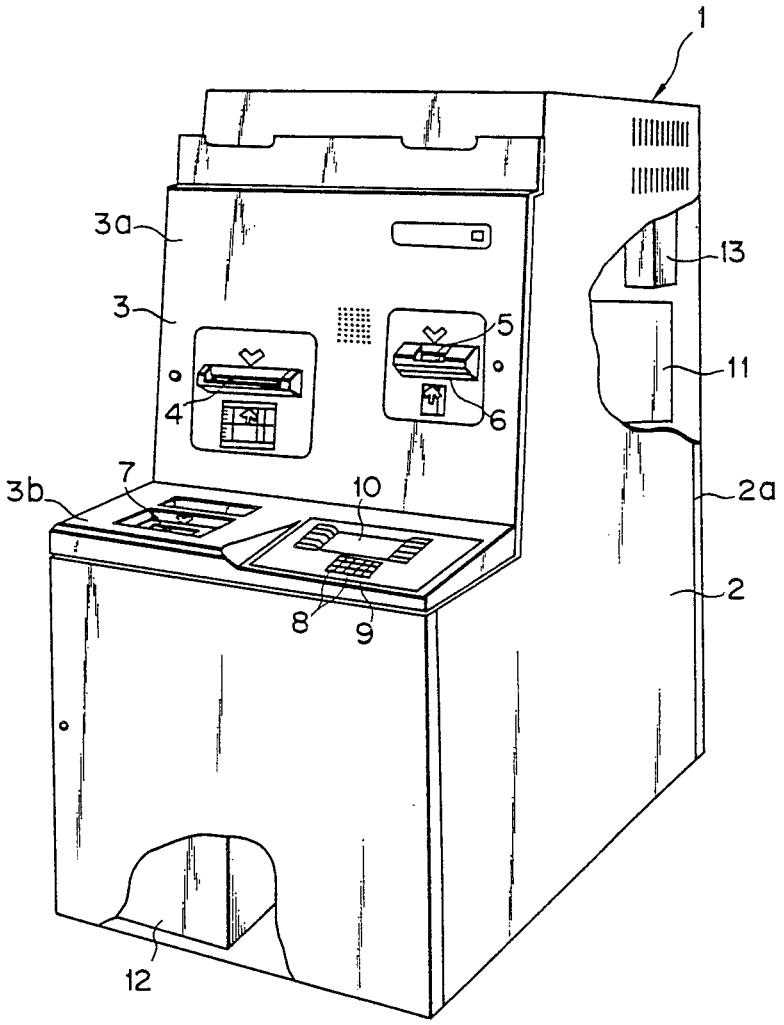

FIG. 1 shows a depositing/dispensing apparatus 1 of an automatic bill circulating system as the automatic bank note transaction apparatus. The apparatus 1 has a main body 2, and an operation panel 3 is provided at the customer side of the main body 2. A passbook insertion port 4, a card insertion port 5 and a receipt dispensing port 6 are formed in a vertical panel portion 3*a* of the operation panel 3. A bill receiving/dispensing port (bill port) 7 which serves as both a bill inlet port and a bill outlet port, an operation section 9 having a plurality of operation buttons 8, and an instruction display section (i.e., CRT display unit) 10 are provided in a horizontal panel portion 3*b* of the operation panel 3.

A passbook reader/printer (not shown in FIG. 1) and a card/receipt processing unit 11 are arranged in the main body 2. The passbook reader/printer reads magnetic information on a passbook received through the passbook insertion port 4, records the read magnetic information, and prints a transaction content on the passbook. The card/receipt processing unit 11 deals with a magnetic card inserted through the card insertion port 5, produces a receipt and dispenses it through the receipt dispensing port 6, and prepares a journal duplicate. The main body 2 also contains a bill receiving/dispensing mechanism 12 for dispensing received bills, and recovering dispensed bills which are accidentally left at the bill receiving/dispensing port 7, and an internal monitor unit 13 for loading the bills and discriminating them.

The construction of the bill receiving/dispensing mechanism 12 will be described with reference to FIGS. 2A and 2B.

Figure 2A:
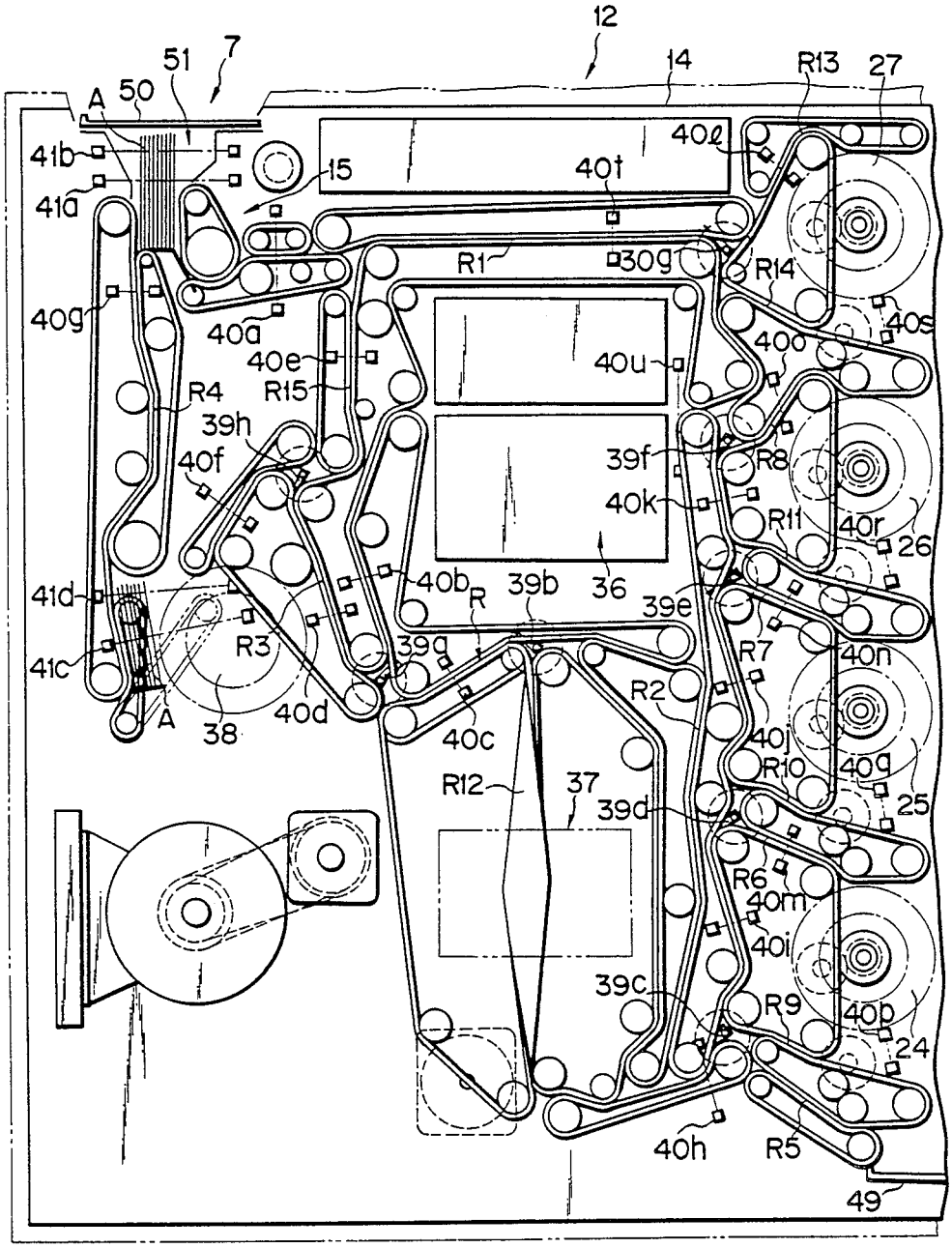
FIGS. 2A and 2B are schematic longitudinal sectional side views of a bill receiving/dispensing mechanism.
Figure 2B:
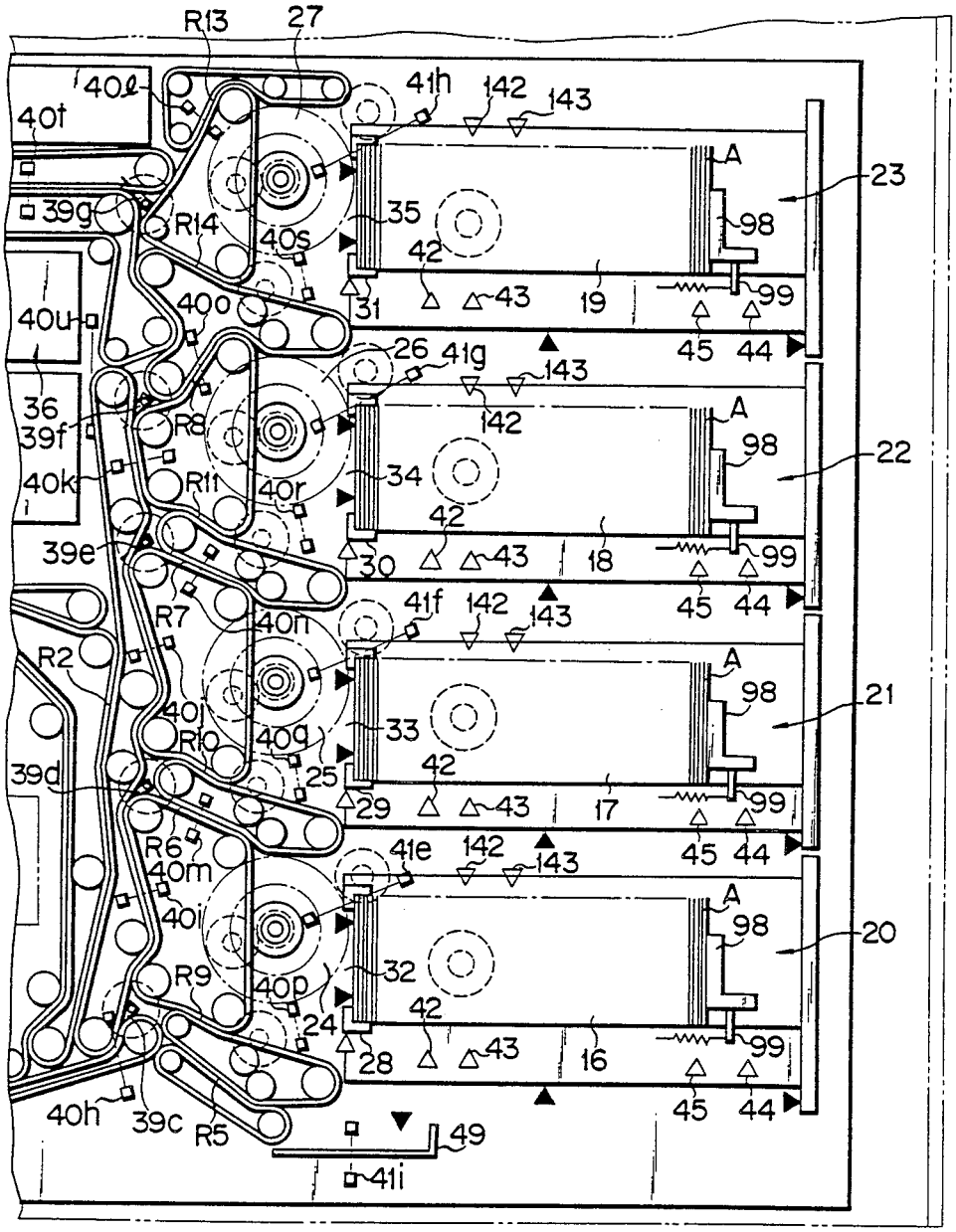

Referring to FIGS. 2A and 2B, reference numeral 14 denotes a housing of the bill receiving/dispensing mechanism 12. A bill receiving/dispensing unit 15 is disposed in the upper portion of the front side (customer side) of the housing 14 so as to oppose the bill receiving/dispensing port 7. First, second, third and fourth bill cassettes 16, 17, 18 and 19 are vertically disposed from the bottom to the top of the rear side (bank side) of the housing 14. The first to fourth bill cassettes 16 to 19 constitute a first storage section 20 as an improper bill storage section for storing bills of a first denomination (i.e., $50, £10 or DM50) which are unfit for dispensation and rejected bills, a second storage section 21 for storing bills of a second denomination (i.e., $10, £5 or DM10), a third storage section 22 for storing bills of a third denomination (i.e., $100, £20 or DM100), and a fourth storage section (recovery compartment/loading compartment) 23 for storing recovered and loading bills, respectively. Each of the first to fourth bill cassettes 16 to 19 can be pulled out from the main body 2 by opening a rear door 2*a* disposed at the rear side (bank side) of the main body 2 of the depositing/dispensing apparatus 1.

First, second third and fourth bill stacking/dispensing units 24, 25, 26 and 27 are vertically disposed at substantially the center along the front-to-rear direction (horizontal direction in the drawings) of the housing 14 so as to respectively correspond to outlet ports of the bill storage sections 20, 21, 22 and 23. Separator mechanisms 28, 29, 30 and 31 as partitioning means for distinguishing the present transaction from the previous transaction are disposed in the bill storage sections 20, 21, 22 and 23, respectively. Temporary storage sections 32, 33, 34 and 35 are formed between the mechanism 28 and the unit 24, between the mechanism 29 and the unit 25, between the mechanism 30 and the unit 26, and between the mechanism 31 and the unit 27, respectively.

A discrimination section 36 is disposed in the front portion of the housing 14 substantially centrally along the vertical direction thereof. A reverse-presented bill inverting section 37 is disposed below the discrimination section 36, and a temporary stacking section 38 is disposed in front of the discrimination section 36.

Bill convey paths R are formed in the housing 14 so as to convey bills A to the corresponding sections. More particularly, the convey paths R consist of: a first convey path R1 for conveying the bill A from the bill receiving/dispensing unit 15 through the discrimination section 36 to a first branch disposed between the discrimination section 36 and the temporary stacking section 38; a second convey path R2 for conveying the bill A from the first branch to a merge portion of the first convey path R1 which is located at the inlet port of the discrimination section 36; a third convey path R3 for conveying the bill A from the first branch to the temporary stacking section 38; a fourth convey path R4 for conveying the bill A from the temporary stacking section 38 to the bill receiving/dispensing unit 15; a fifth convey path R5 for conveying the bill A from a second branch which is defined at an intermediate portion of the second convey path R2 and located in front of and below the first stacking/dispensing unit 24 to a rejected bill stacking section 49 disposed under the first storage section 20; a sixth convey path R6 for conveying the bill A from a third branch which is defined at an intermediate portion of the second convey path R2 and located in front of and above the first stacking/dispensing unit 24 to the first stacking/dispensing unit 24; a seventh convey path R7 for conveying the bill A from a fourth branch which is defined at an intermediate portion of the second convey path R2 and located in front of and above the second stacking/dispensing unit 25 to the second stacking/dispensing unit 25; an eighth convey path R8 for conveying the bill A from a fifth branch which is defined at an intermediate portion of the second convey path R2 and located in front of and above the third stacking/dispensing unit 26 to the third stacking/dispensing unit 26; a ninth convey path R9 for conveying the bill A from the first stacking/dispensing unit 24 to a merge portion of the second convey path R2 located in front of the first stacking/dispensing unit 24; a tenth convey path R10 for conveying the bill A from the second stacking/dispensing unit 25 to a merge portion of the second convey path R2 located in front of the second stacking/dispensing unit 25; an eleventh path R11 for conveying the bill A from the third stacking/dispensing unit 26 to a merge portion of the second convey path R2 located in front of the third stacking/-dispensing unit 26; a twelfth convey path R12 for conveying the bill A from a sixth branch which is defined at an intermediate portion of the second convey path R2 and is located below the discrimination section 36 to a merge portion which is defined at an intermediate portion of the second convey path R2 and which is located in front of the second branch so as to invert the bill by 180 degrees; a thirteenth convey path R13 for conveying the bill A from a seventh branch which is defined at an intermediate portion of the first convey path R1 and located in front of the fourth stacking/dispensing unit 27 to the fourth stacking/dispensing unit 27; a fourteenth convey path R14 for conveying the bill A from the fourth stacking/dispensing unit 27 to a merge portion which is defined at an intermediate portion of the second convey path R2 and which is located in front of and below the fourth stacking/dispensing unit 27; and a fifteenth convey path R15 for conveying the bill A from an eighth branch defined at an intermediate portion of the third convey path R3 to a merge portion defined at an intermediate portion of the first convey path R1.

First to eighth selector gates 39*a*, 39*c*, 39*d*, 39*e*, 39*f*, 39*b*, 39*g* and 39*h* are disposed at the first to eighth branches, respectively. Each selector gate guides the bill A which has reached the corresponding branch to one of the two corresponding convey paths. The selector gates 39*a* to 30*h* are driven by rotary solenoids (not shown), respectively. Bill flow sensors 40*a* to 40*u* are arranged at respective predetermined positions of the convey paths R. Bill presence/absence sensors (residual bill sensors) 41*a* to 41*i* are disposed at respective stacking locations of the bills A. Each of the sensors 40*a* to 40*u* and 41*a* to 41*i* comprises a known pair of a light-emitting element and a light-receiving element.

A full-state sensor 44, a near-full-state sensor 45, an empty-state sensor 42 and a near-empty-state sensor 43 are arranged in each of the bill storage sections 20, 21, 22 and 23. Each of these sensors 42, 43, 44 and 45 comprises a microswitch which is turned on/off by a slider 99 fixed to a push plate 98 (to be described later).

The bill receiving/dispensing unit 15 which is disposed to oppose the bill receiving/dispensing port 7 will now be described with reference to FIGS. 3 to 6.

The bill receiving/dispensing unit 15 has a bill take-in mechanism 15*a* and a bill take-out mechanism 15*b*. Reference numeral 50 denotes a door for opening/closing the bill receiving/dispensing port 7. A handle 50*a* of the door 50 is at a lower level than the horizontal panel portion 3*b*, so that the opening/closing operation of the door 50 is not impeded by a customer's belongings such as a handbag.

A bill storage chamber 51 is formed below the bill receiving/dispensing port 7 which is opened/closed by the door 50. The bottom wall of the bill storage chamber 51 is defined by a guide plate 52, and side walls thereof are respectively defined by opposing surfaces of a first conveyor belt 53 of the bill take-in mechanism 15*a* and a second conveyor belt 54 of the bill take-out mechanism 15*b*.

The bill take-in mechanism 15*a* has the following construction. The first conveyor belt 53 is looped between pulleys 55 and 56 which are vertically disposed in the housing 14. A reception roller 57 is coaxial with the lower pulley 55. The roller 57 has a diameter slightly larger than that of the pulley 55 so that the circumferential surface of the roller 57 extends slightly beyond the outer surface of the first conveyor belt 53 looped around the pulley 55. The lower end of the roller 57 is in contact with a reverse brake belt 58 which serves as an overlying bill reception preventing means.

A backup member 59 is arranged with the second conveyor belt 54 in a nest configuration so as to be horizontally movable. The backup member 59 is mounted to a horizontally extending guide shaft 61 through a linear bearing 60. The backup member 59 can be moved by a backup member actuator (not shown) through the guide shaft 61 between a position where the backup member 59 urges the bills A in the bill storage chamber 51 against the first conveyor belt 53 and a position where the backup member 59 is situated to the left of the second convey or belt 54 so that bills A are removed from the bill storage chamber 51.

The bill take-out mechanism 15*b* has the following construction. A pulley (not shown) is disposed to oppose the roller 57 and a third conveyor belt 62 is looped around the pulley. This pulley is integrally mounted with a pulley 63. A pulley 64 is disposed above the pulley 63. The second conveyor belt 54 is looped around the pulleys 63 and 64. The opposing surfaces of the third conveyor belt 62 and a fourth conveyor belt 66 looped around a pulley 65 disposed at the bottom of the bill storage chamber 51 define the fourth convey path R4 of the convey paths R, which conveys the bills A from the temporary stacking section 38 to the bill storage chamber 51.

The pulley 64 is mounted at the free end of an arm 71. The proximal end of the arm 71 is supported to freely swing about a pivot pin 68. The arm 71 is normally biased by a spring 69 to be separated from the bill storage chamber 51, and abuts against a stopper 70.

The arm 71 is pivoted by an arm actuator 72 about the pivot pin 68 against the biasing force of the spring 69, so that the arm 71 is inserted into the bill storage chamber 51. A spring 75 is provided such that one end thereof is connected to a plunger 73*a* of a solenoid 73, an intermediate portion thereof is wound around a guide pulley 74, and the other end thereof is connected to the proximal end of the arm 71. The biasing force of the spring 75 is stronger than that of the spring 69. When the solenoid 73 having the construction described above is energized, the plunger 73*a* is withdrawn to pivot the arm 71 clockwise against the biasing force of the spring 69, so that the arm 71 is inserted into the bill storage chamber 51.

The bills taken-in, one by one, upon rotation of the roller 57 are guided by a guide plate 76 and are fed between conveyor belts 77 and 78 which constitute part of the first convey path R1 of the convey paths R. The driven roller having the conveyor belt 77 looped therearound is pivotally mounted on a shaft on which the reverse brake belt 58 is also mounted.

The residual bill sensors 41*a* and 41*b* are vertically arranged in the bill storage chamber 51 to be spaced apart from each other so as to detect the presence/absence of bills A. The upper sensor 41*b* is positioned such that a space is defined between the upper end of the largest bill A and the optical axis of the sensor 41*b* when the largest bill A is completely stored in the bill storage chamber 51. In this state, the light-receiving element of the upper sensor 41*b* receives light from the light-emitting element and generates a "bright" signal. The lower sensor 41*a* is positioned such that a space is defined between the lower end of the bill A and the optical axis of the sensor 41*a* when a bill which is being dispensed or returned is partially dispensed so as to extend from the bill receiving/dispensing port 7. The light-receiving element of the lower sensor 41*a* receives light from the light-emitting element and generates a "bright" signal.

Bill reception at the time of cash deposit will now be described with reference to FIGS. 3 and 4.

Figure 3:
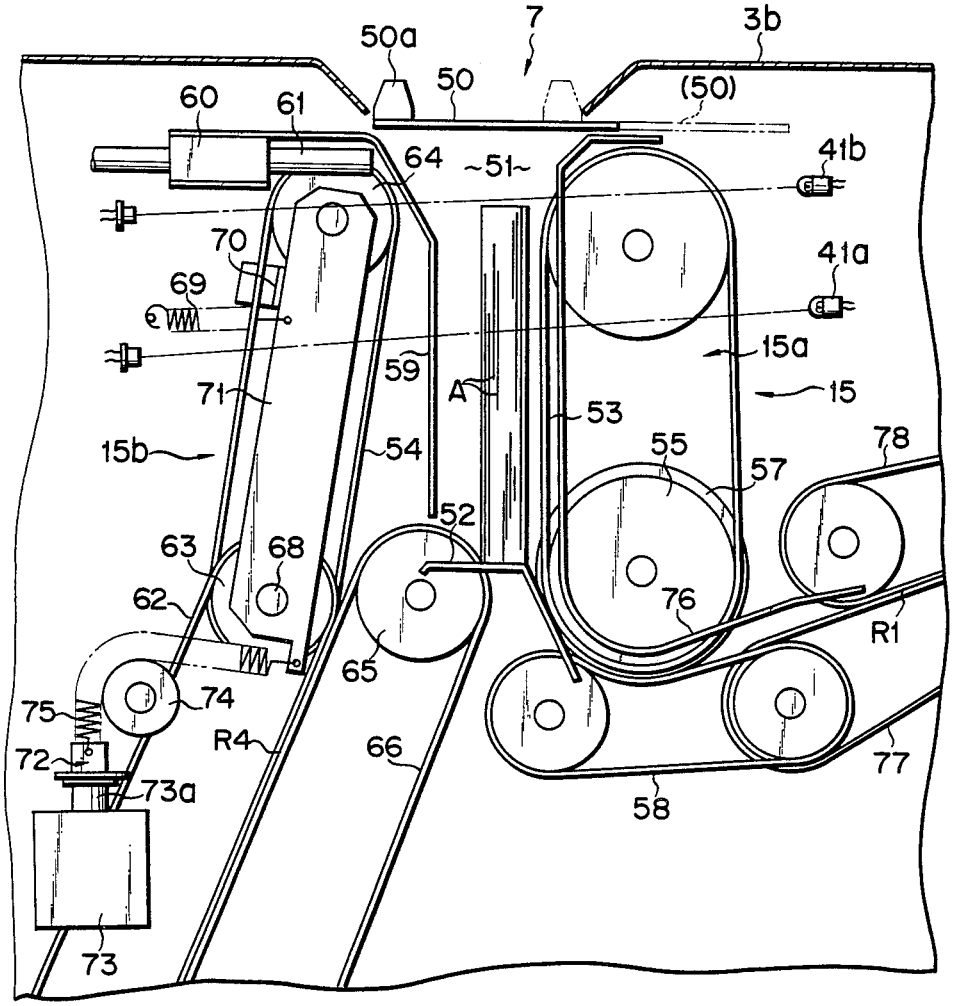

When a customer operates the apparatus to deposit cash, the door 50 is pulled by a motor (not shown) to the right in the drawings to open the bill reception/dispensing port 7, as indicated by the alternate long and two dashed line in FIG. 3. In this case, since the backup member 59 is located in the position where it is separated from the bill storage chamber 51, the customer can vertically insert a bundle of obverse- and/or reverse-presented bills of various denominations through the bill receiving/dispensing port 7 into the bill storage chamber 51. When the customer has finished inserting the bills, he moves the door 50 by means of the handle 50*a* to the left, so that the bill receiving/dispensing port 7 is closed. When the door 50 is closed, a sensor (not shown) detects the closed state, and the bill convey operation is started.

Figure 4:
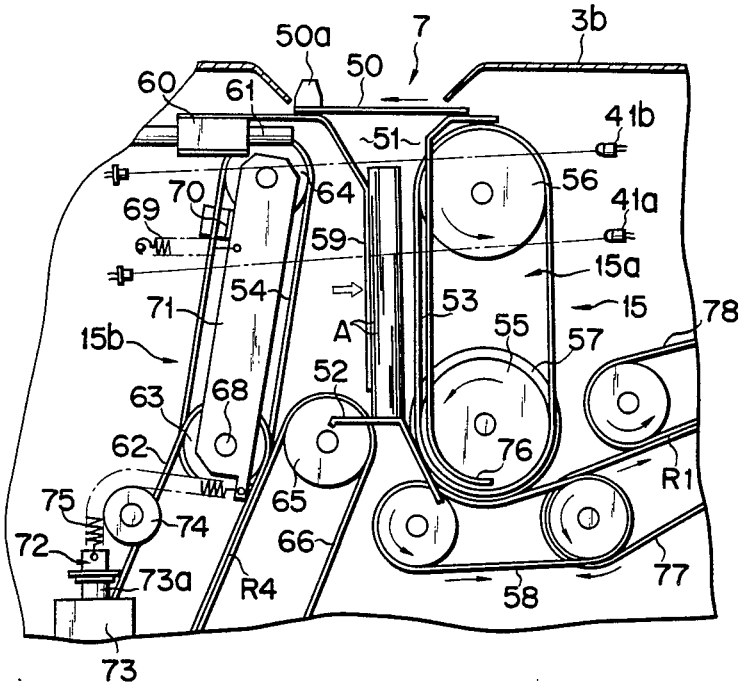

As shown in FIG. 4, the first conveyor belt 53 starts to move counterclockwise in the direction given by the arrow. Upon movement of the conveyor belt 53, the roller 57 having a rubber member of a high friction coefficient on its outer surface is rotated. At the same time, the backup member 59 is moved by the backup actuator (not shown) to the right. Therefore, as shown in FIG. 4, the bills A are urged to the right and are pressed against the roller 57 and the first conveyor belt 53. In this case, the backup member 59 urges the bills A through a spring (not shown). Therefore, the bills can be properly pressed irrespective of the thickness of the bundle of bills, so that the backup actuator will not be overloaded.

The bill A contacting the roller 57 is conveyed upon rotation of the roller 57. In this case, the second and subsequent bills A will not be conveyed, due to the action of the reverse brake belt 58 which rotates in the direction opposite to the convey direction. The bills A are thus fed, one by one, into the first convey path R1 defined between the conveyor belts 77 and 78.

Figure 5:
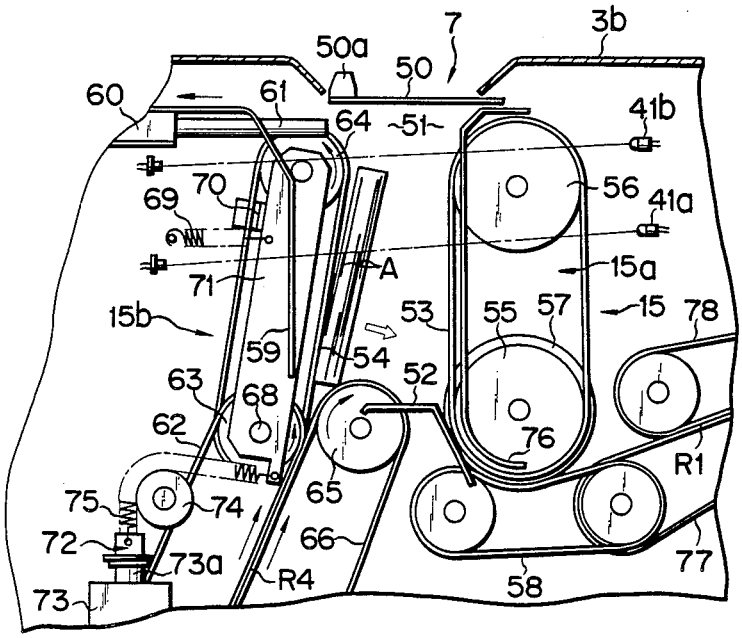

An operation will be described with reference to FIG. 5 wherein the bills A which are being returned to the bill receiving/dispensing port 7 are conveyed to the bill storage chamber 51. In this case, first, the bill receiving/dispensing port 7 is closed by the door 50. The backup member 59 is moved to the left and is separated from the bill storage chamber 51. The leading end of a bundle of bills A fed through the fourth convey path R4 defined between the conveyor belts 62 and 66 can be fed into the bill storage chamber 51 defined between the opposing surface of the second conveyor belt 54 and the first conveyor belt 53.

When the feeding of the bundle of bills A into the bill storage chamber 51 is completed, these bills which require a re-reading operation, such as rejected bills received at the time of cash deposit, are subjected to convey operation (FIG. 4) while the door 50 is closed.

Figure 6:
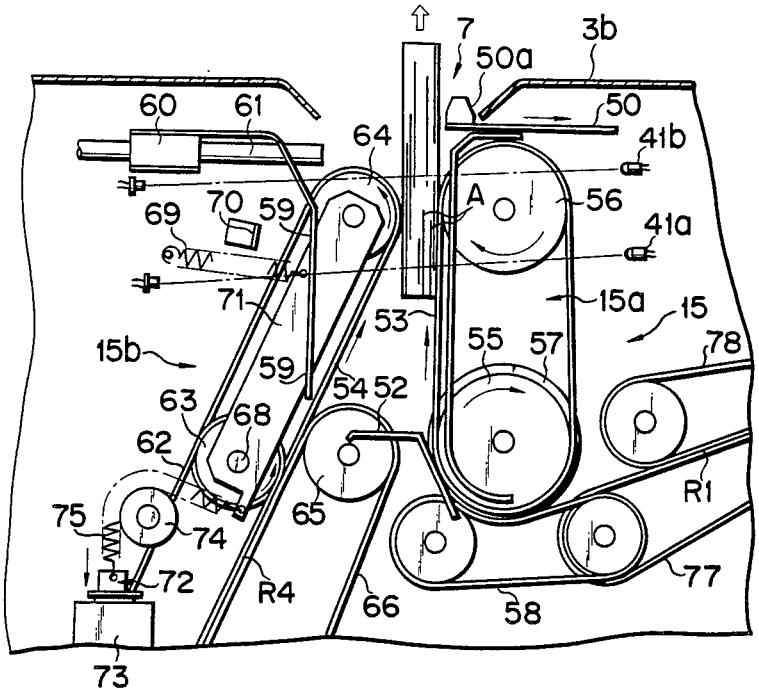

On the other hand, when re-reading is not required as in the case of automatic return of the bills at the time of cash deposit or in the case of bill dispensing, the following operation is performed. As shown in FIG. 6, the backup member 59 is held in the left position. Then, the solenoid 73 is energized while the feeding of the bills A is temporarily stopped. The arm 71 provided with the pulley 64 driven by the second conveyor belt 54 is pivoted clockwise about the pivot shaft 68. The bills A in the bill storage chamber 51 are thus clamped between the first conveyor belt 53 and the second conveyor belt 54.

Thereafter, the door 50 is moved by a motor (not shown) to open the bill receiving/dispensing port 7. The second conveyor belt 54 at the left side is driven at a low speed of 1/10 the normal feed speed counterclockwise in the direction indicated by the arrow. At the same time, the first conveyor belt 53 at the right side is driven at the same low speed and is driven clockwise in the direction given by the arrow. Therefore, the bills A are fed upward. When the lower residual bill sensor 41*a* generates a "bright" signal, the conveyor belts 53 and 54 are stopped.

In this case, the bills A are stopped such that more than half of their length extends from the receiving/dispensing port 7. The customer can easily remove the bills A from the port 7.

Furthermore, since the bills are firmly clamped by the biasing force of the spring 75, they will neither fall out nor be blown away by a gust of wind.

When the customer removes the bills A, the upper sensor 41*b* generates the "bright" signal, and the bill receiving/dispensing port 7 is automatically closed by the door 50. Meanwhile, when the door 50 is closed, the solenoid 73 is deenergized, and the arm 71 returns to the initial position as shown in FIG. 4. The backup member 59 which has been held at the left position is returned to the position shown in FIG. 3. The next step is then initiated.

When the residual bill sensor 41*b* does not generate a "bright" signal after a predetermined time interval has elapsed, the machine detects that the customer has forgotten to remove the dispensed bills, and the recovery operation is started. The first and second conveyor belts 53 and 54 are driven at a low speed of 1/10 the normal speed in the direction opposite to the dispensing direction, while the bills A remain clamped between the first and second conveyor belts 53 and 54. The reverse movement of the conveyor belts 53 and 54 continues until the residual bill sensor 41*b* generates the "bright" signal. The generation of the "bright" signal indicates that the bills A are completely withdrawn into the bill storage chamber 51. Therefore, the solenoid 73 is deenergized, and the arm 71 having the pulley 64 driven by the second conveyor belt 54 returns to the initial position. At the same time, the bill receiving/dispensing port 7 is closed by the door 50.

Thereafter, the normal reception operation is performed as described with reference to FIG. 4. The forgotten bills are recovered, one by one.

The temporary stacking section 38 will be described with reference to FIG. 7.

The temporary stacking section 38 has a stacking mechanism 38*a* and a dispensing mechanism 38*b*. Reference numeral 80 denotes a temporary stacking chamber. The bottom portion of the temporary stacking chamber 80 is defined by a guide plate 81, and side walls thereof are respectively defined by the opposing surfaces of a conveyor belt 82 of the stacking mechanism 38*a* and an extended portion 62*a* of the third conveyor belt 62 in the dispensing mechanism 38*b*. The third convey path R3 is defined by opposing surfaces of a conveyor belt 84 looped around a pulley 83 disposed above the temporary stacking chamber 80 and another pulley (not shown), and a conveyor belt 85. The bill A selected by the selector gate 39*h* (FIG. 2A) disposed in the eighth branch is guided to the temporary stacking chamber 80 through the third convey path R3.

An impeller 86 is disposed below the end of the third convey path R3. The leading end of a single conveyed bill A clamped between the conveyor belts 84 and 85 is inserted between adjacent blades 86*a* of the impeller 86, which rotates counterclockwise. The leading end of the bill A is guided downward by the conveyor belt 84 until it abuts against the conveyor belt 82. At this moment, the trailing end (upper end) of the bill A remains clamped between the blade 86*a* of the impeller 86 and the conveyor belt 84. Thereafter, the bill A is conveyed downward along the belt 82 and when the trailing end of the bill A is released from being clamped between the conveyor belt 84 and the blade 86*a*, the bill A flies to the left due to the action of the next blade 86*a*. Therefore, the bill A is stacked in the temporary stacking chamber 80 at a sufficient distance from the conveyor belt 82. The next bill A is inserted between the stacked bill A and the conveyor belt 82, and this bill is stacked in the temporary stacking chamber 80 in the same manner as described above.

The conveyor belt 82 which serves as a guide for removing the bill A from the impeller 86 is looped around a pulley 87 located in the vicinity of a main shaft 86*b* of the impeller 86 and a pulley 88 located below the guide plate 81. The upper pulley 87 is mounted on the free end portion of an arm 92 supported to swing about a shaft 89 of the lower pulley 88. The arm 92 normally abuts against a stopper 91 by the biasing force of a spring 90 and is biased to lie outside the temporary stacking chamber 80 as indicated by solid line in FIG. 7. The arm 92 is pivoted by an arm actuator (not shown) (in the same manner as the arm actuator 72 (FIGS. 3 to 6) of the bill receiving/dispensing unit 15) counterclockwise against the biasing force of the spring 90. Therefore, as indicated by the alternate long and two short dashed line in FIG. 7, the bills A in the temporary stacking chamber 80 are urged against the extended portion 62*a* of the conveyor belt 62.

The conveyor belt 82 is driven at the same speed as that of the conveyor belt 62 through a drive system (not shown). The bills A in the temporary stacking chamber 80 are fed into the fourth convey path R4 of the convey paths R as one bundle.

The presence/absence of the bills A within the temporary stacking chamber 80 is detected by a "dark"/"bright" signal from the residual bill sensor 41*c*.

The reverse-presented bill inverting section 37 has a known construction wherein the conveyor belts are twisted by 180 degrees to invert the bill while the bill is conveyed clamped between the conveyor belts, and a detailed description thereof will be omitted.

The first to fourth stacking/dispensing units 24 to 27 and the separator mechanisms 28 to 31 as partitioning means will now be described with reference to FIGS. 8 to 19. Each of the stacking/dispensing units has the same construction, and each of the separator mechanisms has the same construction, so that only the first stacking/dispensing unit 24 and the first separator mechanism 28 will be exemplified, and a description of other stacking/dispensing units and other separator mechanisms will be omitted.

Reference numeral 100 denotes a pair of stacking impellers. The impellers 100 are mounted on a common shaft 103, which is rotatably supported through a pair of bearings 102 (FIG. 10) respectively mounted on frames 101. The shaft 103 is rotated clockwise through a power transmission system 105 having a pulse motor (not shown) as a drive source.

A plurality of rotating members 106*a*, 106*b* and 106*c* as dispensing mechanisms are disposed on the outer sides of the impellers 100 such that the peripheral portions of the rotating members 106*a*, 106*b* and 106*c* partially overlay the peripheral portions of the impellers 100, respectively. Each rotating member 106*a*, 106*b* or 106*c* is fixed to a shaft 107*n* horizontally provided to be parallel to the shaft 103 on which the impellers 100 are mounted. Furthermore, each rotating member 106 is driven in the forward direction through a drive system (not shown).

Figure 10:
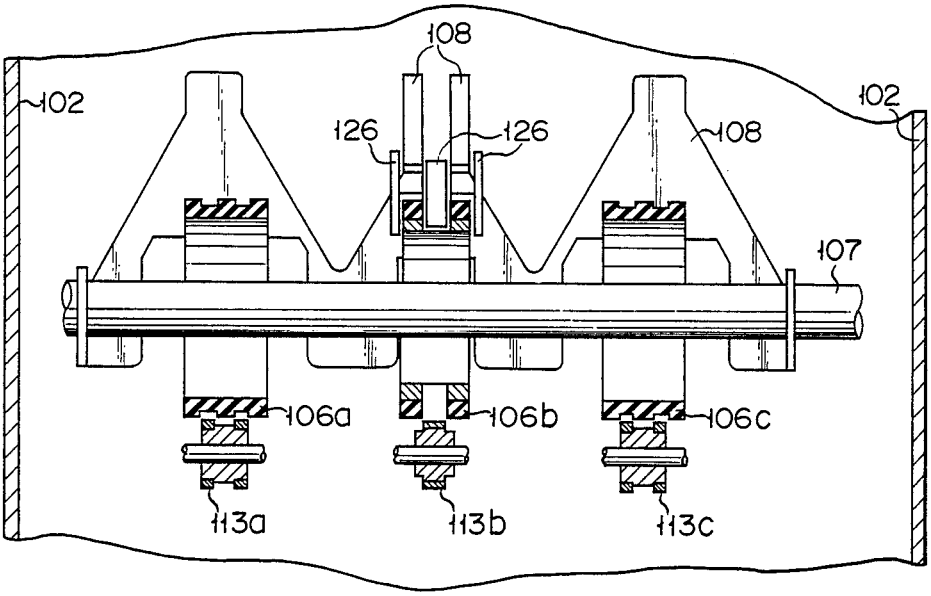

Part of the outer surface of each of the rotating members 106*a*, 106*b* or 106*c* is made of a material such as rubber having a high friction coefficient, as shown in FIG. 10.

Figure 11:
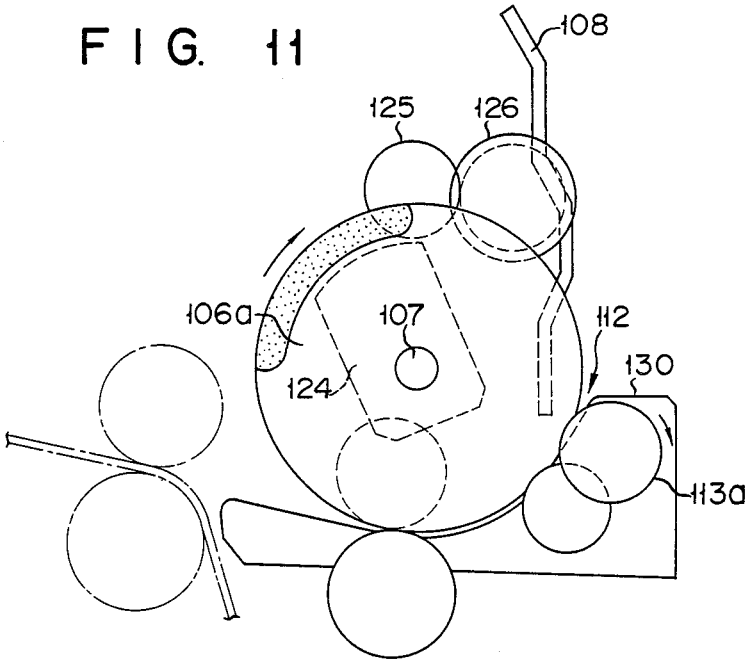

A cam 124 is fixed on the shaft 107, as shown in FIG. 11. The cam 124 has an arcuated outer surface which subtends a predetermined angular interval at the center of the shaft 107. An idler roller 125 is rotatably supported to be engaged with the outer surface of the cam 124. Feed rollers 126 are rotatably supported to normally engage with the idler roller 125. The feed rollers 126 are driven upon rotation of the idler roller 125. In this manner, when the rotating members 106*a*, 106*b*, and 106*c* are rotated, a rotational force of these members is transmitted to the corresponding feed rollers 126 through the corresponding idler rollers 125, so that the feed rollers 126 are intermittently rotated clockwise upon rotation of the members 106*a*, 106*b*, and 106*c*. Therefore, the bills A are fed downward one by one starting from the foremost bill and are removed from an outlet port 112 upon rotation of the feed rollers 126. In this manner, the dispensed bills A are conveyed upon rotation of the rotating members 106*a*, 106*b*, and 106*c*.

Overlying bill preventing rollers 113*a*, 113*b*, and 113*c* are respectively disposed at an outlet port 112 of the rotating members 106*a*, 106*b*, and 106*c* so as to prevent the second and subsequent bills from being dispensed together with the first bill dispensed by a combination of the feed rollers 126 and the rotating members 106*a*, 106*b*, and 106*c*. As shown in FIG. 10, the surfaces of the rollers 113*a*, 113*b*, and 113*c* are made of a high friction member and are fitted with the rotating members 106*a*, 106*b*, and 106*c*, respectively. The rollers 113*a*, 113*b*, and 113*c* are rotated in an opposite direction to the bill dispensing direction.

Figure 12:
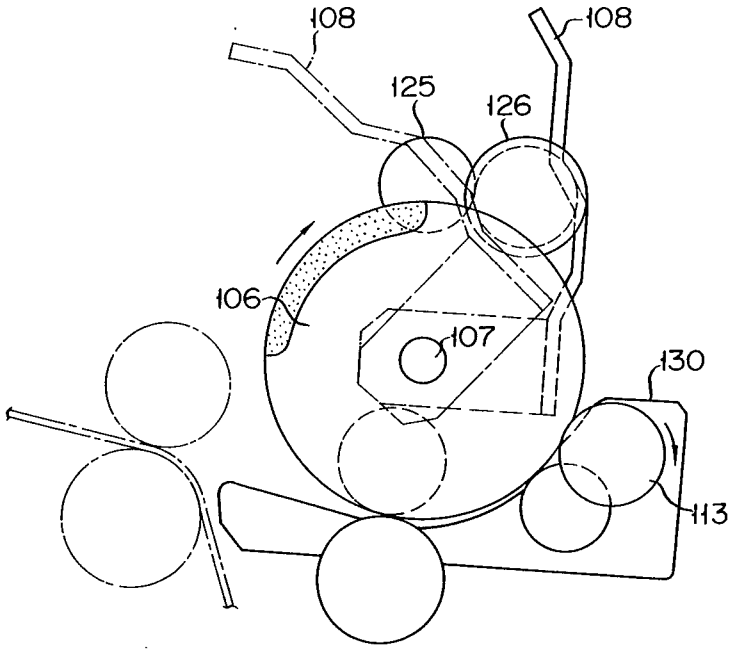

Movable members 108 are provided to be nested with the rotating members 106*a*, 106*b*, and 106*c* as dispensing mechanisms, and the pair of impellers 100. Each movable member 108 can swing between a dispensing position (indicated by the solid line) and a stacking position (indicated by the alternate long and short dashed line) about the shaft 107, as shown in FIG. 12. The movable member 108 is driven clockwise or counterclockwise by a pulse motor 110 as the drive source through a power transmission system 111. The movable members 108 serve as guide portions in the stacking mode whose parts cross the impellers 100 so as to remove the bill A from the impellers 100, as indicated by the alternate long and short dashed line. However, in the dispensing mode wherein the rotating members 106*a*, 106*b* and 106*c* remove the bill, as indicated by the solid line, the movable members 108 are pivoted through a predetermined angle clockwise from the stacking position and serve as push plates for pushing the bill in the direction (transverse direction) perpendicular to the dispensing direction (downward direction), and for supporting the bill.

Figure 8:
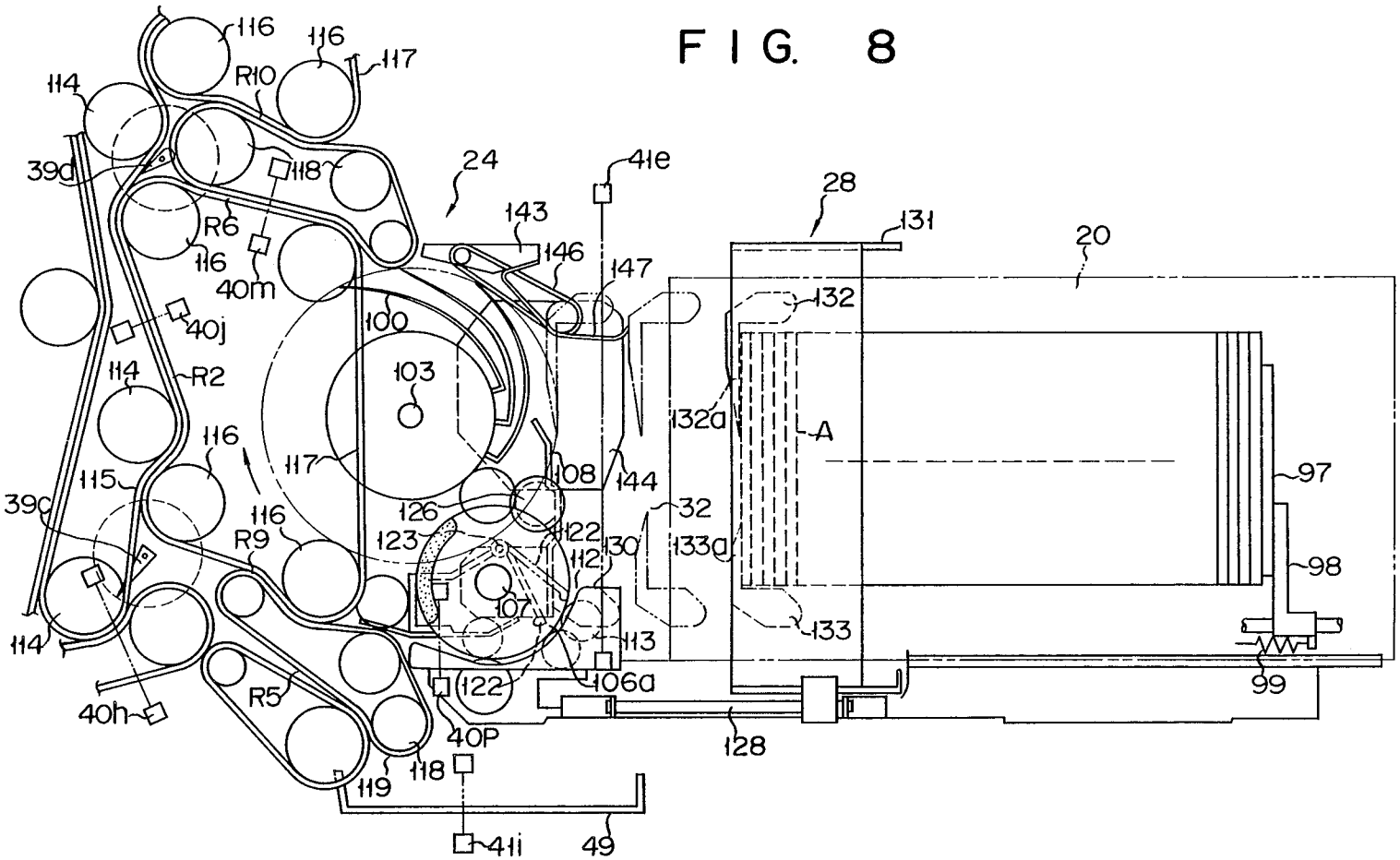

A rotating stopper 122 is provided to be nested with the rotating members 106*a*, 106*b* and 106*c* at the lower portions of the impellers 100, as shown in FIG. 8. The stopper 122 is rotatably supported on a shaft 123 and can swing between the two positions given by the dotted line and the alternate long and short dashed line, respectively, by means of a drive source (not shown). The stopper 122 closes the outlet port 112 in the stacking mode, as indicated by the alternate long and short dashed line, so as to prevent the bill A from being moved downward through the outlet port 112. However, in the dispensing mode, the stopper 122 is moved away from the outlet port 112, as indicated by the dotted line, so that the outlet port 112 is opened.

A detecting lever 94 is disposed in the lower portion of the impeller 100 to be fitted in grooves (slots) 133*a*' and 133*d*' formed in pawls 133*a* and 133*d* of a flipper 133 (to be described later). The detecting lever 94 detects whether or not the end of the bill A faces the outlet port 112 and can be pivoted about a shaft 95. A sensor (e.g., photocoupler) 96 is arranged at a position opposing an end 94*a* of the detecting lever 94. The sensor 96 is kept OFF by the end of the detecting lever 94 when the detecting lever 94 abuts against the end of the bill A temporarily stored in the temporary storage section. However, when the bill A is removed from the temporary storage section and the detecting lever 94 is pivoted counterclockwise and is moved to the position shown in FIG. 15, the sensor 96 is turned on by the end 94*a* of the detecting lever 94. The ON/OFF operation of the sensor 96 allows detection of an end of a deposit return operation, detection during the dispensing operation of an end of a withdrawal transaction and an end of a restoration operation after the bills are left at the dispensing port, and detection of an empty cassette.

An end of the sixth, seventh or eighth conveyor path R6, R7, or R8, which is branched from the second conveyor path R2 of the bill conveyor path R at substantially the center along the front-and-rear direction of the bill receiving/dispensing mechanism, housing faces the upper portions of the impellers 100, as shown in FIG. 8. The conveyor path R6, R7, or R8 conveys the bill A gated from the second conveyor path R2 through the separator gate 39*d*, 39*e*, or 39*f* to the corresponding impeller 100. The ninth, tenth or eleventh conveyor path R9, R10 or R11 whose end merges into the second conveyor path R2 is formed at the lower portions of the impellers 100. The conveyor path R9, R10, or R11 conveys the bill A dispensed by the rotary members 106*a*, 106*b*, or 206*c* as dispensing mechanisms into the second conveyor path R2.

The second conveyor path R2 is constituted by opposing surfaces of a conveyor belt 115 looped between guide rollers 114 and a plurality (four in this embodiment) of second conveyor belts 117, which partially contact the conveyor belt 115, as shown in FIG. 8. The sixth convey path R6 is constituted by opposing surfaces of one of the conveyor belts 117 and a conveyor belt 119 which is looped around guide rollers 118 and which partially contacts the upper surface of this conveyor belt 117. The lowermost, fifth conveyor path R5 is constituted by opposing surfaces of another conveyor belt 119 and a conveyor belt 120 which partially contacts the lower surface of this conveyor belt 119.

The bills A, sequentially guided by the impellers 100, can be stacked in any of the temporary storage sections 32, 33, and 34 (to be described later) through a guide 143, a belt 146 of a low friction coefficient, a leaf spring 147, and the corresponding movable member 108.

The construction of the separator mechanisms 28, 29, 30, and 31 as partitioning means will be described with reference to FIG. 9 and FIGS. 13A to 13C.

Figure 14:
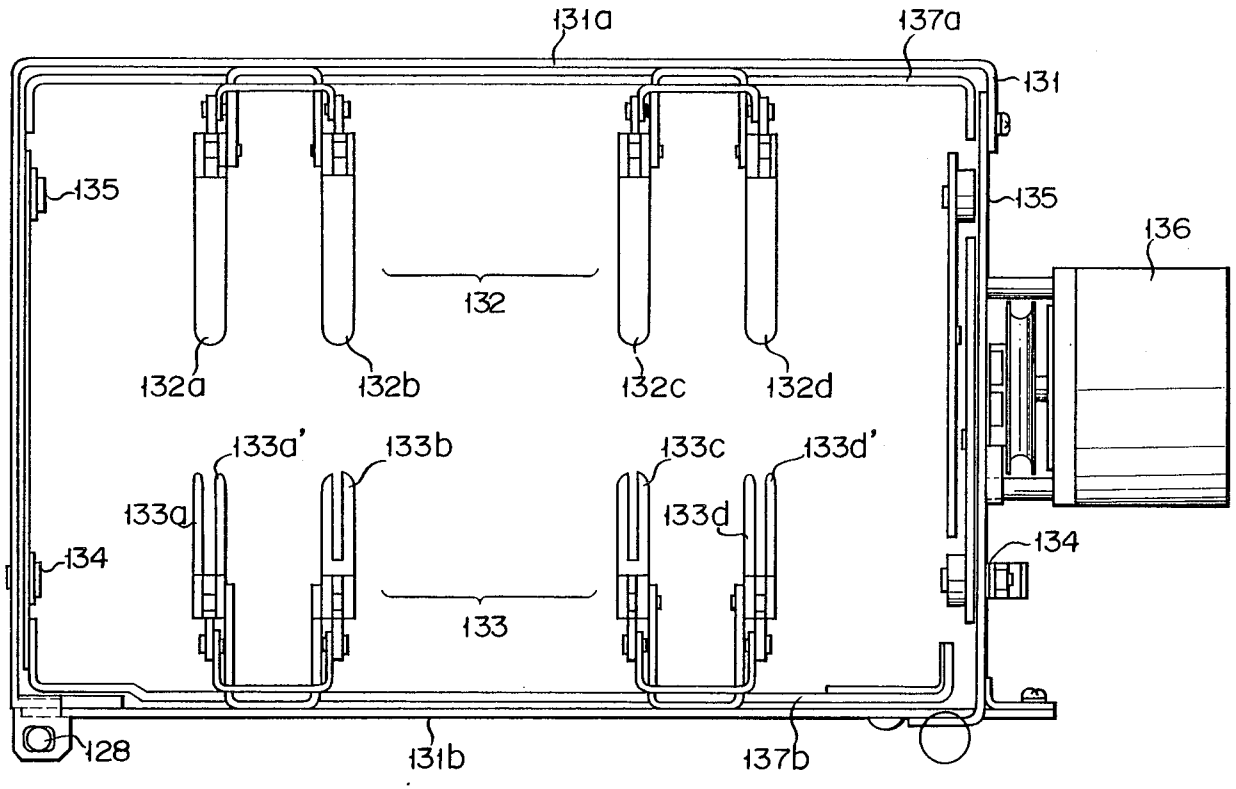
Figure 15:
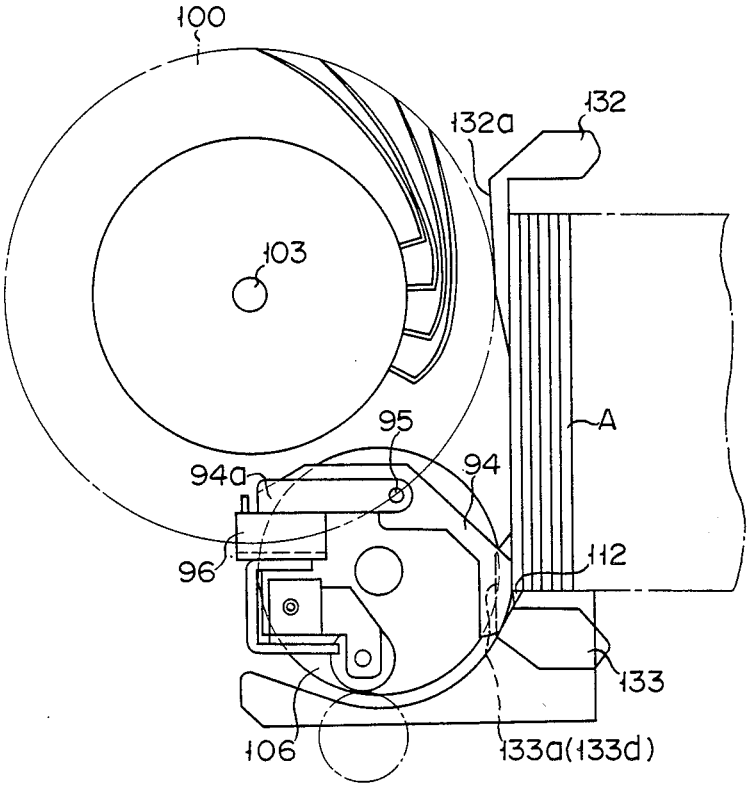

Rectangular movable members 131 for surrounding the stacks of bills A stacked on supports 130 are disposed in the fourth, third, second, and first storage sections 23, 22, 21, and 20, respectively. Each movable member 131 is reciprocally movable along the stacking direction of the bills A by guide rods 128 and 129 through linear bearings (not shown). As shown in FIG. 14, flappers 132 and 133, which respectively comprise a plurality of pawls 132*a* to 132*d* and 133*a* to 133*d*, are pivotally mounted on shafts 134 and 135 in upper and lower horizontal frames 131*a* and 131*b* of the movable members 131, respectively.

The drive force of a VR type pulse motor 136 is transmitted to the flappers 132 and 133 respectively through link mechanisms 137*a* and 137*b*. In this manner, the pawls 132*a* to 132*d* and 133*a* to 133*d* can be inserted into or removed from the stacking area of the bills A.

A grooved cam (not shown) is mounted on a shaft of the pulse motor 136. Upon rotation of the cam, the lower link mechanism 137*b* is pivoted. The rotation of the lower link mechanism 137*b* through a predetermined angle opens the lower flapper 133. When the grooved cam is further rotated, the upper link mechanism 137*a* is pivoted. The rotation of the upper link mechanism 137*a* through a predetermined angle opens the upper flapper 132. A mechanical lock mechanism (not shown) is disposed to prevent the upper and lower flappers 132 and 133 from being opened even if an external force acts on the pawls 132*a* to 132*d* and 133*a* to 133*d* when the flappers 132 and 133 are closed.

Figure 13A:
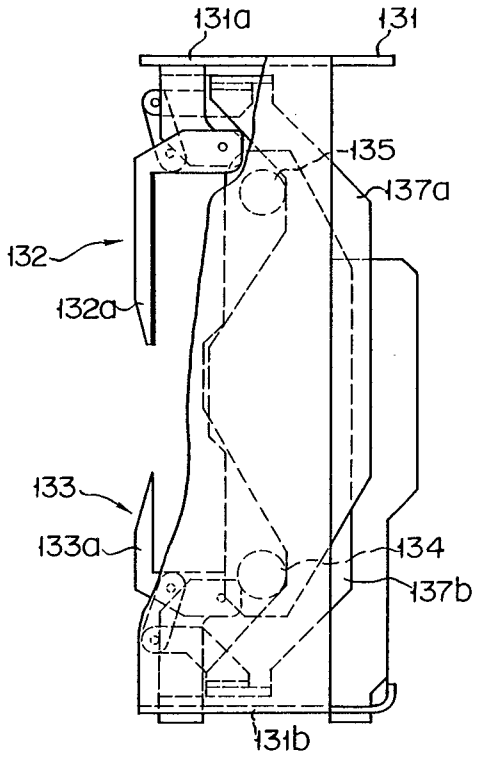
FIGS. 13A to 13C are side views for explaining the operation of flappers.
Figure 13C:
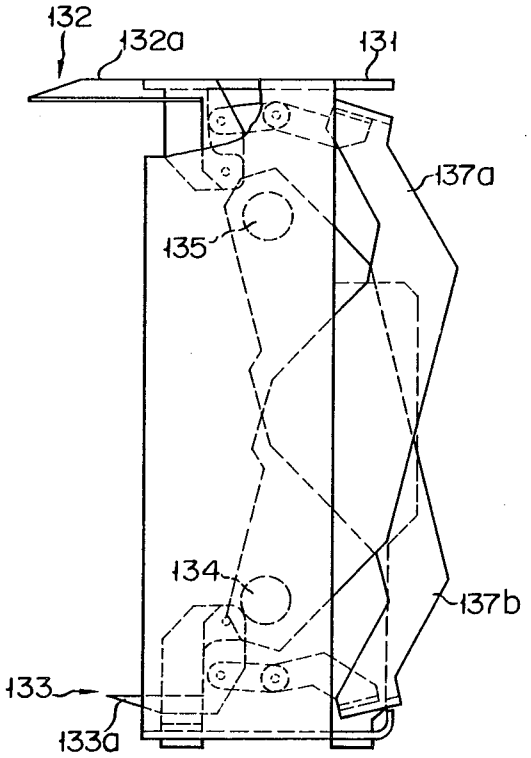
Figure 13B:
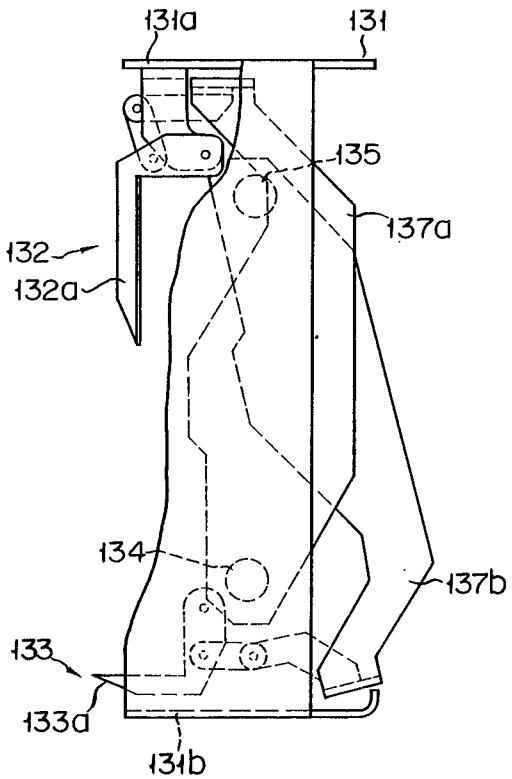

When the upper and lower flappers 132 and 133 are closed (standby state), the upper link mechanism 137*a* is pivoted about the shaft 135 upon predetermined rotation of the pulse motor 136, as shown in FIG. 13A, so that the lower flapper 133 is opened, as shown in FIG. 13B. Subsequently, when the lower link mechanism 137*b* is pivoted about the shaft 134 upon predetermined rotation of the pulse motor 136, the upper flapper 132 is opened, as shown in FIG. 13C. The pulse motor 136 is of the VR type and the shape of the grooved cam is preselected, so that the flappers 132 and 133 are normally closed even if the pulse motor 136 is deenergized while the flappers 132 and 133 are being opened or are already opened.

Grooves 133*a*' and 133*d*' are formed in the pawls 133*a* and 133*d*, respectively, as shown in FIG. 14. When the bill A does not abut against the pawls 133*a* and 133*d*, the detecting lever 94 is inserted in the grooves 133*a*' and 133*d*'.

Figure 9:
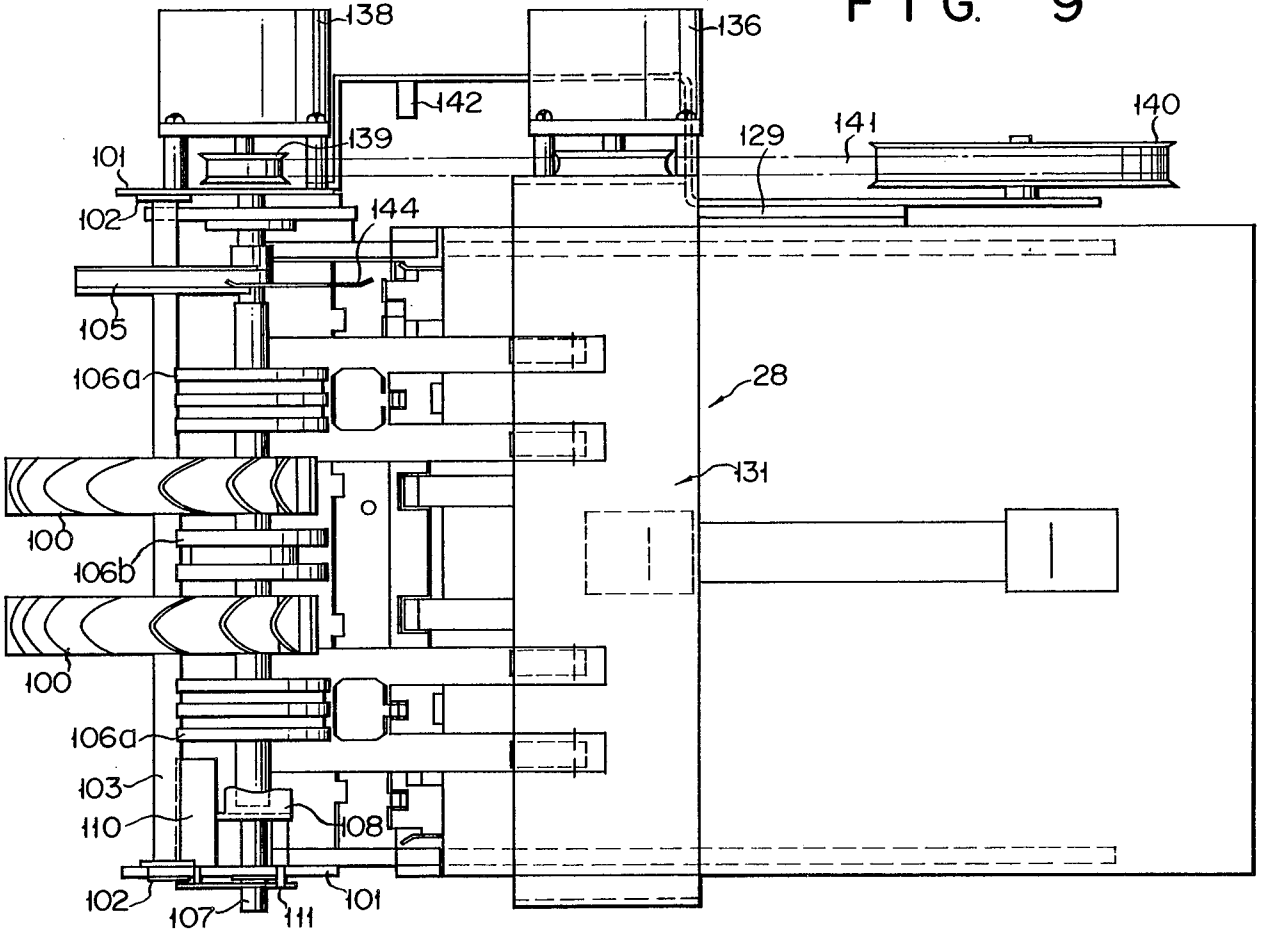

As shown in FIG. 9, a drive pulley 139 mounted on the drive shaft of a VR type pulse motor 138 is disposed in the vicinity of one end of one of the guide rods 129, and a driven pulley 140 is disposed in the vicinity of the other end thereof. An intermediate portion of a timing belt 141, looped between the pulleys 139 and 140, is coupled to the movable member 131. An initial position sensor (lead switch) 142 is arranged to keep the movable member 131 in the normal stop position. The movable member 131 stops in the normal stop position when the position sensor 142 is set in the normal condition.

Even if the movable member 131 is moved forward in the normal stop position, the pawls 132*a* to 132*d* and 133*a* to 133*d* of the upper and lower flappers 132 and 133 will not abut against the corresponding stacking/-dispensing units 24, 25, 26, and 27.

Figure 16:
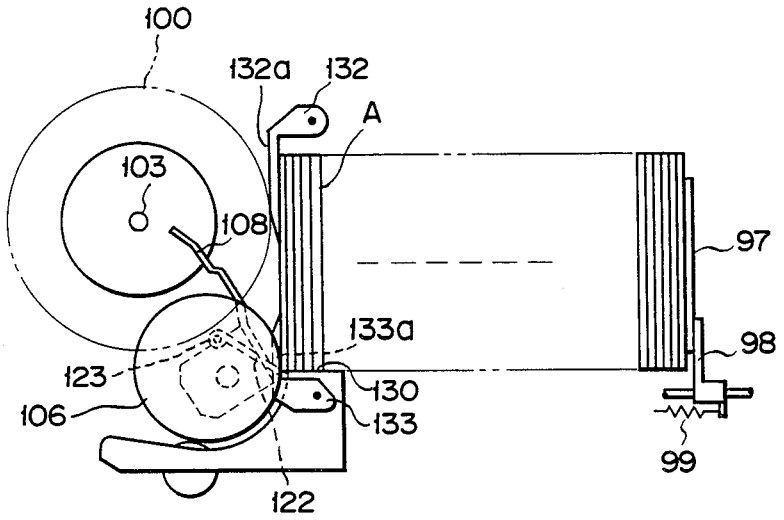

The bills A are urged toward the corresponding stacking/dispensing unit by a backup member, which comprises a movable member 98 and a press plate 97 biased by a spring 99 (FIG. 16).

Reference numeral 144 denote aligning guide plates which define the two side walls of the temporary storage section 32, which are disposed to be movable by means of driving means (not shown), and which align the bills A along the longitudinal direction.

Figure 17:
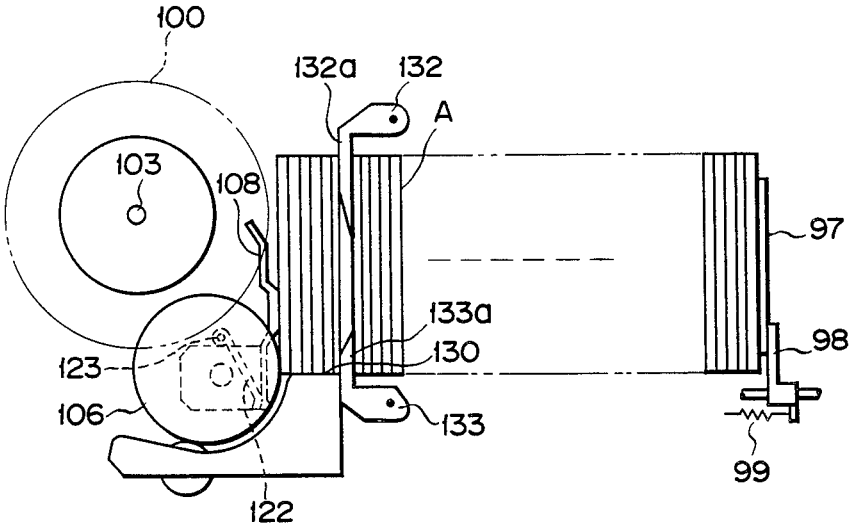
Figure 18:
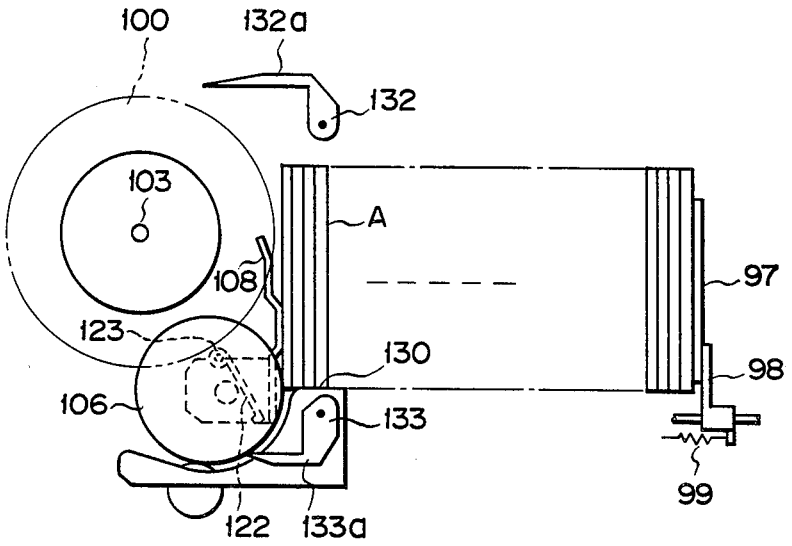
Figure 19:
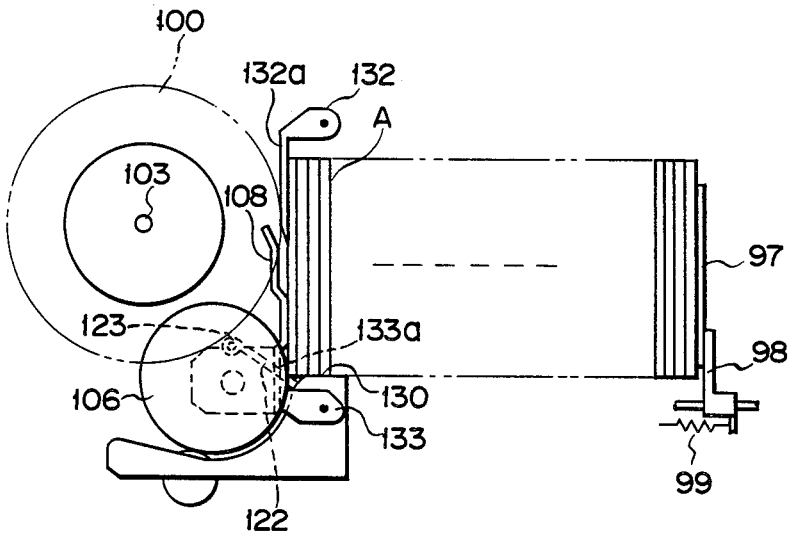

FIG. 8 shows the stacking state of the temporary storage section 32 of the bills. FIG. 16 shows the state of the stacking/dispensing unit 24 and the separator mechanism 28 where cash deposit is performed; FIG. 17 shows the state thereof where the received bills are returned; FIG. 18 shows the state thereof where the bills are dispensed; and FIG. 19 shows the standby state after the bills are dispensed. More particularly, when the bills are stacked in the temporary storage section 32, the movable member 108 is pivoted to the left, as shown in FIG. 8. The guide 108*a* is nested with the impellers 100, and the stopper 108*b* closes the outlet port 112. The pawls 132*a* and 133*a* of the flappers 132 and 133 of the separator mechanism 28 are engaged with the leading ends of the first bill stored in the storage section 20.

When the bills stacked in the temporary storage section 32 are received in the bill storage section 20, the state shown in FIG. 8 changes to the state shown in FIG. 12 wherein the pawls 132*a* and 133*a* are pivoted outside to disengage with the bill. In this manner, the bills A stacked in the temporary storage section 32 are stacked on the bills stored in the bill storage section 20. Thereafter, the pawls 132*a* and 133*a* are moved in the forward direction and are brought into engagement with the forward bill.

When a transaction is not completed or the customer does not confirm his deposit, the state shown in FIG. 8 changes to the state shown in FIG. 17. The pawls 132*a* and 133*a* are held in the positions where the bill is engaged therewith. The movable member 108 is pivoted to the right, and the guide 108*a* abuts against the forward bill of the bills stacked in the temporary storage section 32. Simultaneously, the stopper 108*b* is separated from the outlet port 112 to open it. Thereafter, upon rotation of the rotating member 106, the received bills stacked in the temporary storage section 32 are taken out one by one. It should be noted that the bills stacked in the storage section 20 are separated by the pawls 132*a* and 133*a* from the received bills and will not be dispensed by the rotating members 106.

When the bills are dispensed, the state shown in FIG. 17 changes to the state shown in FIG. 18. The pawls 132*a* and 133*a* are pivoted from the position where the bill is engaged to the position where the bill is not engaged. At the same time, the movable member 108 is povited to the right. Thereafter, upon rotation of the rotating member 106, the bills stored in the storage section 20 are dispensed one by one. When the dispensing operation of a predetermined number of bills is completed, the state shown in FIG. 18 changes to the state shown in FIG. 19. The pawls 132*a* and 133*a* are held in the standby mode wherein they engage with the first bill. The stacking/dispensing unit 24 and the separator mechanism 28 are set in this standby mode when the depositing/dispensing apparatus 1 is not operated.

Figure 20:
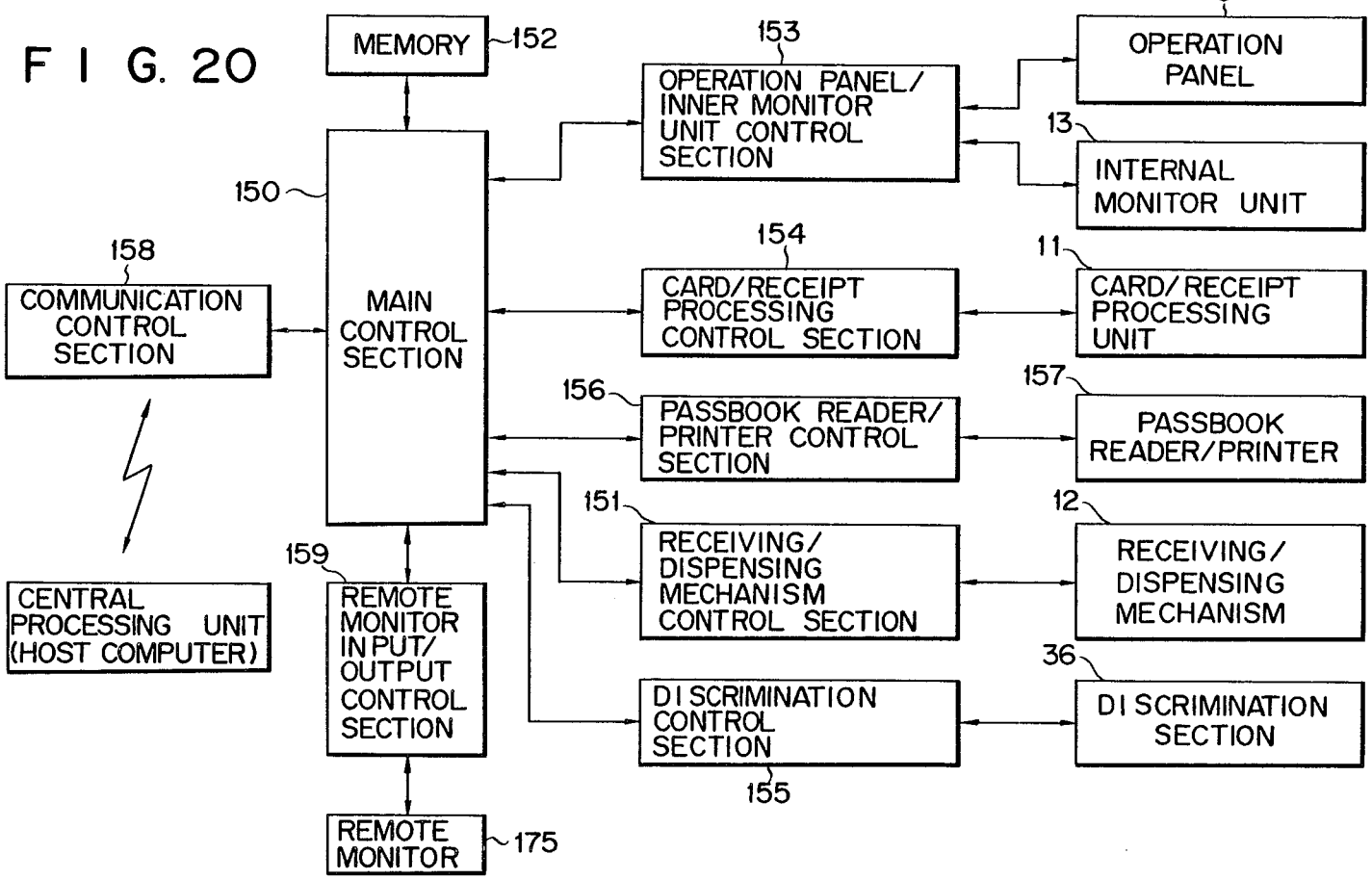

FIG. 20 is a block diagram for explaining the operation of the depositing/dispensing apparatus 1. A main control section 150 controls the overall operation of the apparatus 1. A memory 152 such as a ROM (read-only memory) stores a control program or the like. A receiving/dispensing mechanism control section 151 controls the receiving/dispensing mechanism 12 in accordance with the signal from the main control section 150 and the signal from a discrimination control section 155. The discrimination control section 155 controls the discrimination section 36. An operation panel/internal monitor unit control section 153 controls the operation panel 3 and the internal monitor unit 13. A card/receipt processing control section 154 controls the card/receipt processing unit 11. A passbook reader/printer control section 156 controls a passbook reader/printer 157 for reading magnetic stripe information of the passbook inserted through the passbook insertion port 4 and printing the transaction contents on the passbook and a journal.

More specifically, the main control section 150 counts the number of bills stored into the storage sections 21, 22 and 23, the number of stored bills, the number of loaded bills, and the total number of bills in units of denominations, in accordance with the signals from the sensors in the receiving/dispensing mechanism 12 and the discrimination signal from the discrimination section 36. The main control section 150 controls through a remote monitor input/output control section 159 a remote monitor 175 disposed to be spaced apart from the depositing/dispensing apparatus 1. Furthermore, the main control section 150 exchanges data with a central processing unit serving as a host computer via a communication control section 158.

Figure 21:
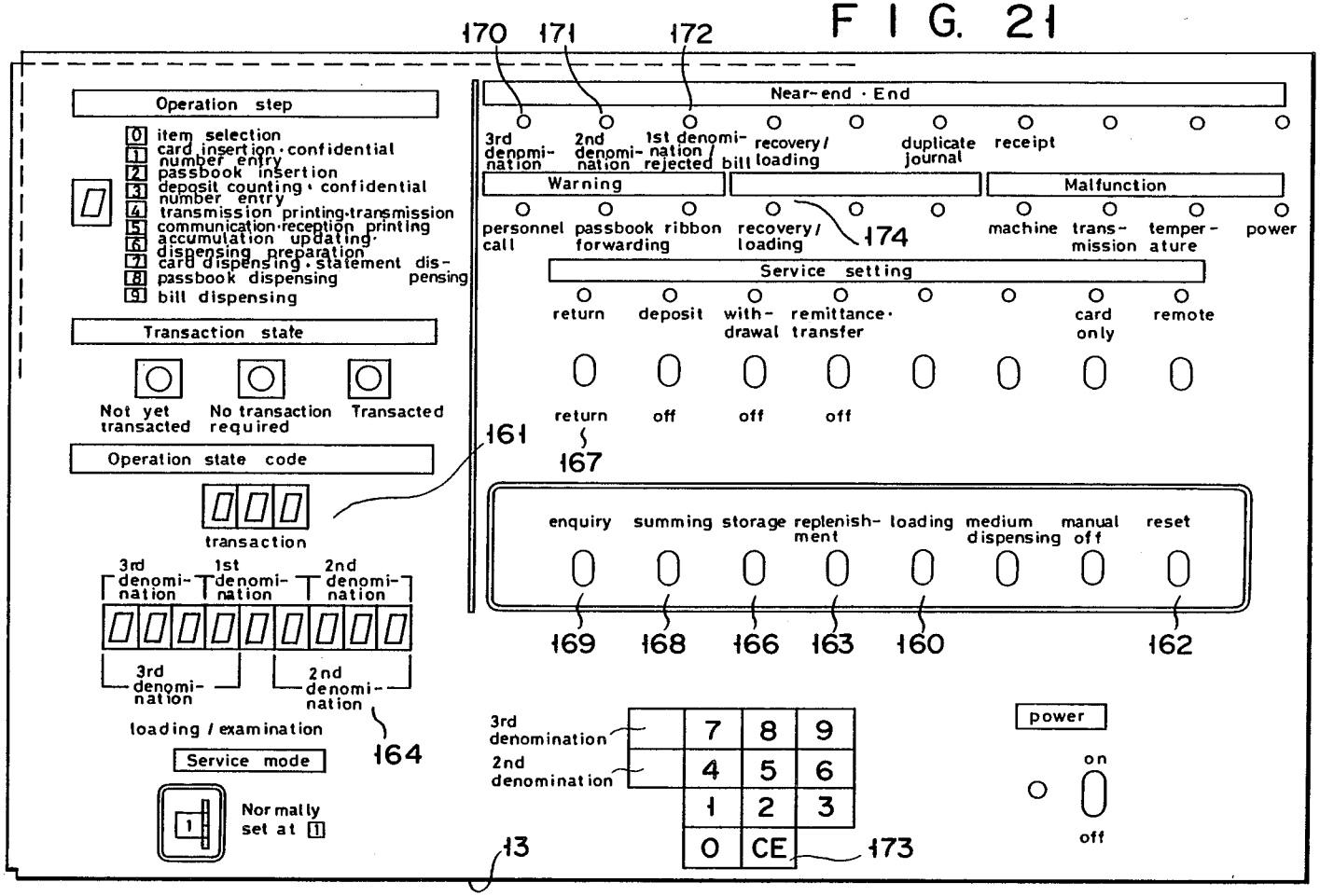

The inner monitor unit 13 comprises, as shown in FIG. 21, an operating state code display 161, a reset button 162, a loading button 160, a replenishing button 163, a bill number display 164 for displaying the number of bills of each of the first to third denominations, a confirmation button 166, a final examination button 168, an enquiry button 169, a bill return button 167, an indicator 170 for indicating ending of bills of the third denomination in the third storage section 22 in a flashing state and the end of bills therein in a continuously on state, an indicator 171 for indicating ending of bills of the second denomination in the second storage section 21 in a flashing state and the end of bills therein in a continuously on state, an indicator 172 for indicating ending of bills of the first denomination in the first storage section 20 in a flashing state and the end of bills therein in a continuously on state, an indicator 174 for indicating recover/loading, and a keyboard 173 having numerical denomination sort keys.

Figure 22:
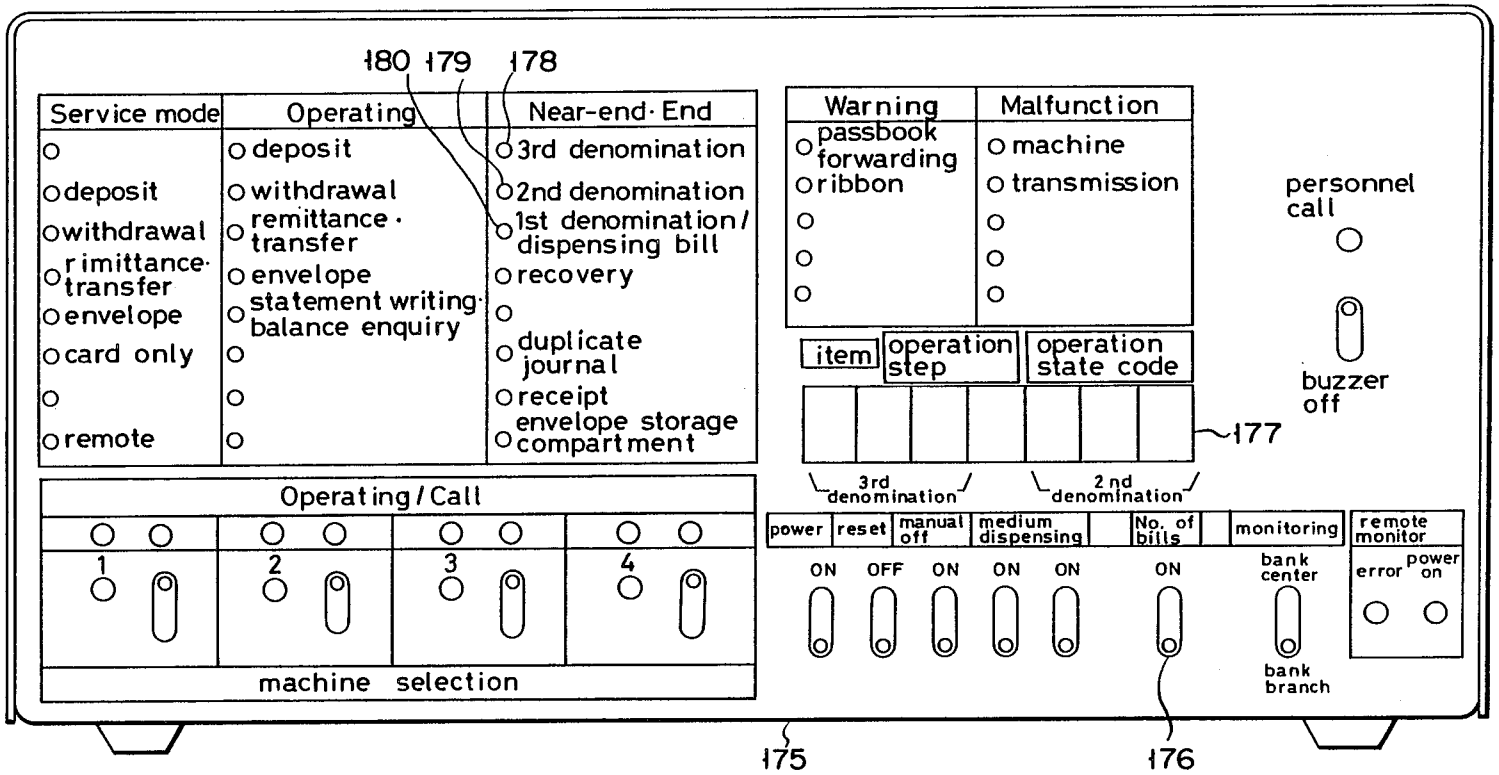

The remote monitor 175 is arranged in a manner as shown in FIG. 22. The monitor 175 comprises an indicator 178 for indicating ending of bills of the third denomination in a flashing state and the end of bills in a continuously on state, an indicator 179 for indicating ending of bills of the second denomination in the second storage section 21 in a flashing state and the end of bills in a continuously on state, an indicator 180 for indicating ending of bills of the first denomination in the first storage section 20 in a flashing state and the end of bills in a continuously on state, a display 177 for displaying the number of loaded bills or the total number of bills of each of the third and second denominations, a bill number button 176 and so on.

The mode of operation of the depositing/dispensing apparatus 1 controlled by the main control section 150 will now be described.

Assume that the user (customer) refers to a message "Insert passbook or card" displayed on the CRT display unit 10 and inserts, for example, his card in the card insertion port 5. The data on the magnetic stripe of the card is read by a reader (not shown) and is supplied to the main control section 150. The main control section 150 checks the validity of the card. When the main control section 150 determines that the card is valid, it causes the CRT display unit 10 to display a message "Enter confidential number". When the customer enters his confidential number with the operation buttons 8, the main control section 150 checks if the confidential number read from the card coincides with that entered with the operation buttons 8. When a coincidence is established, or the correspondence satisfies the predetermined rules, the main control section 150 causes the CRT display 10 to display a message "Select transaction item" and items "Deposit, withdrawal, remittance/-transfer, outstanding balance enquiry".

When the customer depresses a button of the operation buttons 8 which represents cash deposit, the main control section 150 is set in the deposit mode and generates a deposit command to the receiving/dispensing mechanism 12. The mechanism 12 causes the door 50 to open the receiving/dispensing port 7. The customer vertically inserts a bundle of obverse- and/or reverse-presented bills of various denominations in the bill storage chamber 51 and closes the door 50. A sensor (not shown) detects that the door 50 is closed. The main control section 150 determines that the bills are properly stored in the bill storage chamber 51 in accordance with the detection signals from the sensors **41*a* and 41*b*. Thereafter, the bills A are received, one by one, through the roller 57**.

The bill is then conveyed along the first convey path R1. In this case, the bill A is detected by the bill flow sensor **40*a* and the main control section 150 counts the number of bills A in accordance with the output signals from the sensor 40*a*. When the bill A passes through the discrimination section 36, various detection procedures such as a "size of the bill along a convey direction", a "size of the bill along a direction perpendicular to the convey direction", a "magnetic pattern matching", a "color separation of the transmitted light", and a "divided matching of the minute bill portions in accordance with the reflected light" are performed. According to these detection results, "denomination discrimination", "true/false (authentic/counterfeit) discrimination", fit/unfit discrimination", and "obverse/reverse-presented bill discrimination" are performed. The discrimination results are supplied to the main control section 150**.

The main control section 150 causes a counter (not shown) to counter the discrimination results. The main control section 150 generates a rejection signal to the receiving/dispensing mechanism 12 when the bill A is determined to be false (i.e., overlying bills) or a skewed bill, or a damaged bill is detected. When the leading end of such a rejected bill reaches the bill flow sensor **40*b*, the first selector gate 39*a* is pivoted to the right in response to the rejection signal, and the second convey path R2 is closed. Therefore, the bill A is conveyed along the third convey path R3 and is temporarily stacked in the temporary stacking section 38**.

On the other hand, when the bill is detected to be "true" and "reverse-presented bill" of the first denomination, the main control section 150 supplies a corresponding signal to the receiving/dispensing mechanism 12. In response to this output, the selector gates **39*a* and 39*b* are pivoted to the left and right, respectively. The third convey path R3 is closed, and the second convey path R2 is closed at the sixth branch. In this manner, the bill is sorted by the gates 39*a* and 39*b* and is conveyed to the twelfth convey path R12 (i.e., the reverse-presented bill inverting section 37) through the second convey path R2. The reverse-presented bill of the first denomination is inverted by the bill inverting section 37 and then returns to the second convey path R2. It should be noted that the selector gates 39*c* and 39*d* are, respectively, pivoted to the right and left when the reverse-presented bill has the first denomination. In this manner, the bill of the first denomination is sorted by the selector gate 39*d* and is conveyed along the sixth convey path R6. This bill is then stacked by the first stacking/dispensing unit 24 in the first temporary storage section 32, as shown in FIG. 8**.

Figure 23A:
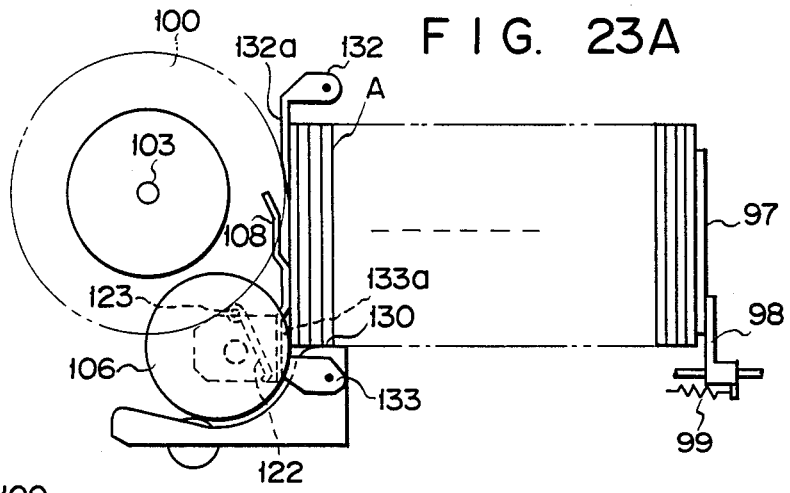
FIGS. 23A to 23K are side views showing operating states of the bill stacking/dispensing unit in a deposit transaction mode.
Figure 23B:
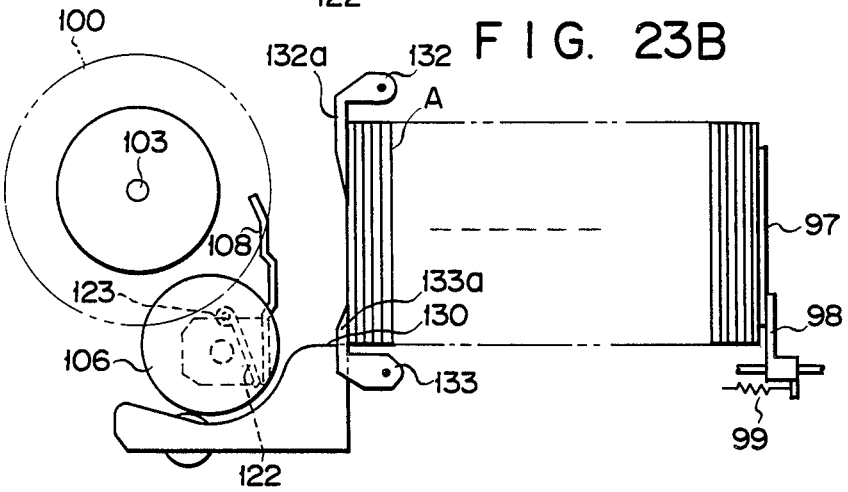
Figure 23C:
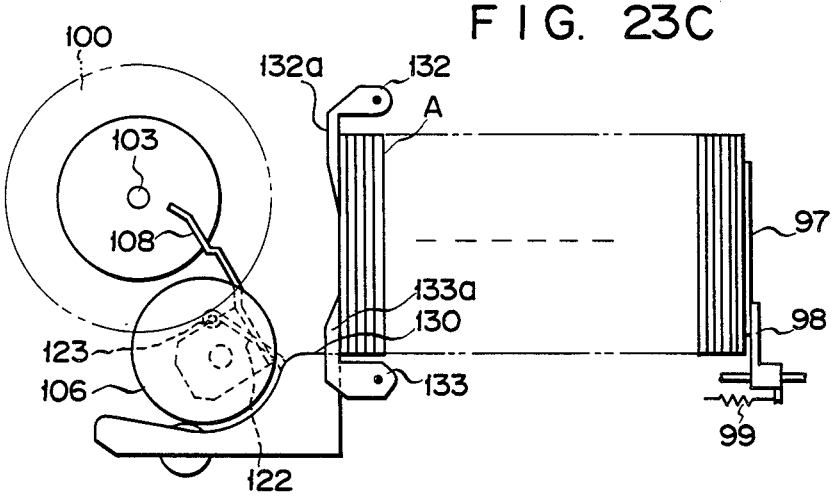
Figure 23D:
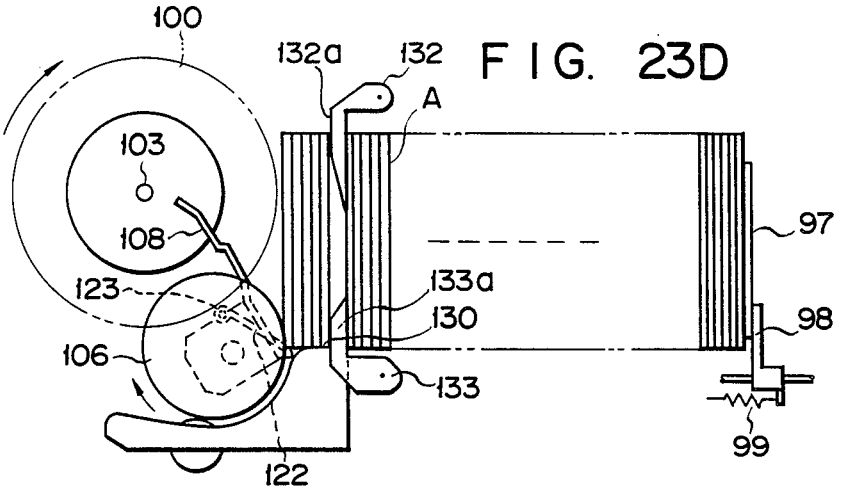
Figure 23E:
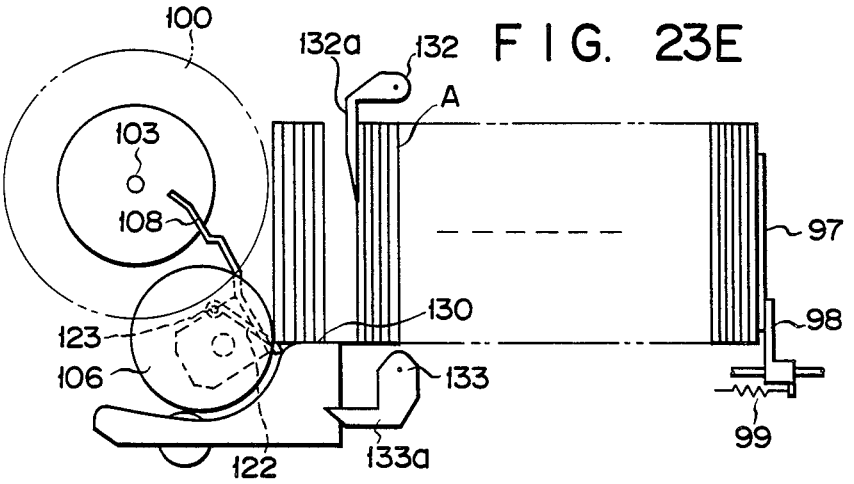
Figure 25A:
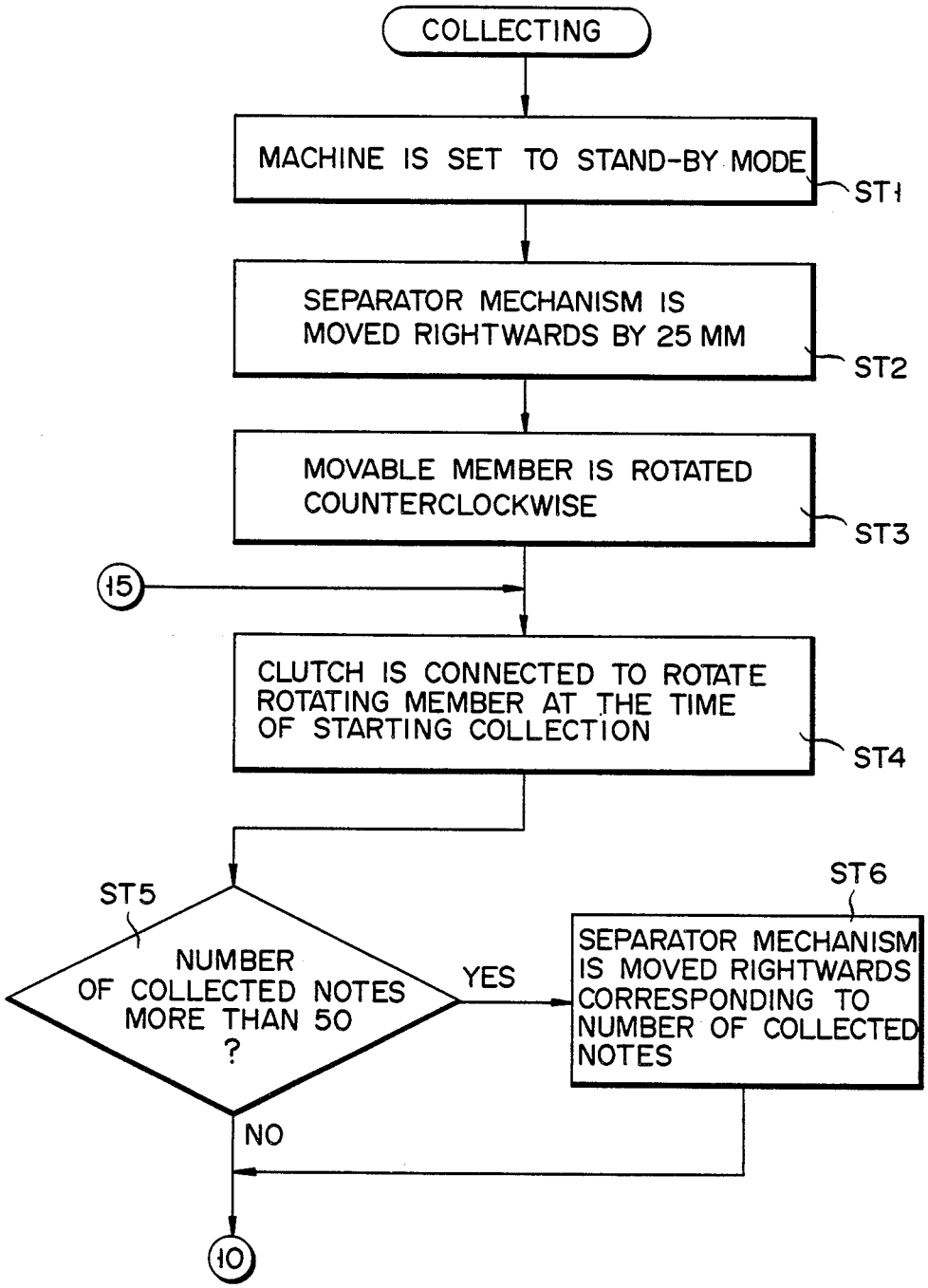
FIGS. 25A to 25C are flow charts for explaining the operation of the main parts in the deposit transaction mode.
Figure 25B:
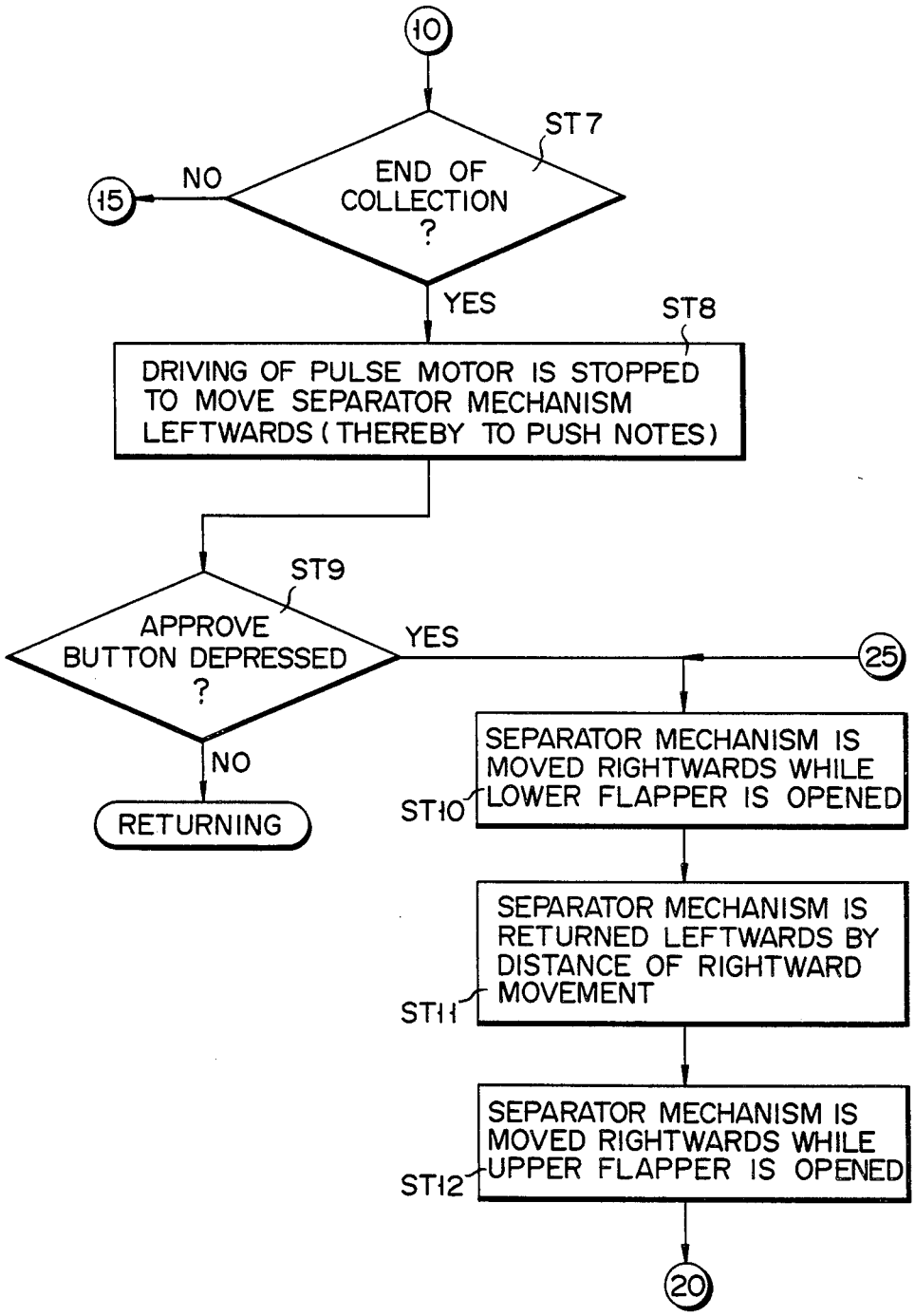

In this case, in the first to third storage sections 20, 21, and 22, the separator mechanisms 28, 29, and 30 are moved by a predetermined distance (about 25 mm in this case) from the standby state (ST1 where ST indicates each step of the processing shown in FIGS. 25A and 25B) to the position shown in FIG. 23B (ST2). At the same time, the pawls **132*a* to 132*d* and 133*a* to 133*d* of the upper and lower flappers 132 and 133 hold the bill A. Subsequently, the movable member 108 is pivoted counterclockwise (ST3) about the shaft 107 upon rotation of the pulse motor 110, and is located in the position shown in FIG. 23C. In this manner, the temporary storage sections 32, 33, and 34 are formed in front portions of the stacking/dispensing units 24, 25, and 26, respectively. The bill A guided by the impellers 100 and then the belt 146 having a low-friction surface abuts against the movable member 108 and is slightly bent. The reaction force caused by bending the bill A acts on the leaf spring 147 which is then slightly bent upward, thereby urging the bill A downward by the resiliency of the leaf spring 147. Since the bill A is slightly bent, it applies a pushing force to the already stored bill A, and is thus removed from the impellers 100. When the rotating members 106*a*, 106*b*, and 106*c*, each of which has a high-friction surface, are rotated clockwise, the bills A having different widths can be aligned downward and stacked one by one, as shown in FIG. 23**D (ST4).

In this case, the stopper 122 is pivoted counterclockwise about the shaft 123 when the movable member 108 is pivoted to the left, so that the distal end of the stopper 122 closes the outlet port 112. Therefore, the stacked bills A will not be conveyed downward. When the number of stacked bills exceeds a predetermined number (50 in this case; ST5), the corresponding one of the separator mechanisms 28, 39 and 30 is slightly shifted to the right, thereby decreasing a pressure between the bills A and hence improving the stacking performance (ST6). Alignment of the bills along the longitudinal direction is performed by a means (not shown) when the bills A are removed by the aligning guide plates 144 from the impeller and are stacked.

The selector gates 39*e* and 39*f* are pivoted to the left when the bill has the second or third denomination. The bill of the second or third denomination is stacked in the second or third temporary storage section 33 or 34. When the bill is detected to be "true" and "obverse-presented bill", the selector gate 39*b* is pivoted to the left to close the twelfth convey path R12. This bill is stacked in the corresponding one of the temporary storage sections 32, 33 and 34 without passing through the reverse-presented bill inverting section 37. The main control section 150 causes counters (not shown) to count the numbers of the bills of the first to third denominations in response to the detection signals from the bill flow sensors 40*m*, 40*n* and 40*o*, respectively, when stacking is performed.

When the absence of the bills in the bill storage chamber 51 is detected by the sensors 41*a* and 41*b*, the roller 57 is stopped, and the deposit operation is completed.

When the rejected bills are stacked in the temporary stacking section 38, the arm 92 is moved to the left. In this manner, the rejected bills are clamped between the conveyor belts 82 and 62, and are conveyed in the bill storage chamber 51 at once along the fourth convey path R4. The rejected bills returning to and stacked in the bill storage chamber 51 are subjected to the deposit operation.

All the bills received in the apparatus are stacked and are subjected to counting. The number of bills of the first, second and third denominations discriminated by the discrimination section 36 are compared by the main control section 150 with the count values of the bill flow sensors 40*m*, 40*n* and 40*o* arranged on the convey paths R6, R7 and R8 terminating into the temporary storage sections 32 to 34. In this manner, double checking guarantees the precision of counting operation (ST7).

When stacking is completed in the manner described above, the pulse motor 138 shown in FIG. 9 is deenergized. The separator mechanism 28, 29, or 30 freed from control by the pulse motor 138 is urged by the press plate 97, which is urged by the spring 99, through the bills A, and is moved to the left. Therefore, the bills A in the temporary storage sections 32, 33, and 34 are continuously urged by the separator mechanisms 28, 29 and 30, respectively (ST8).

Figure 23F:
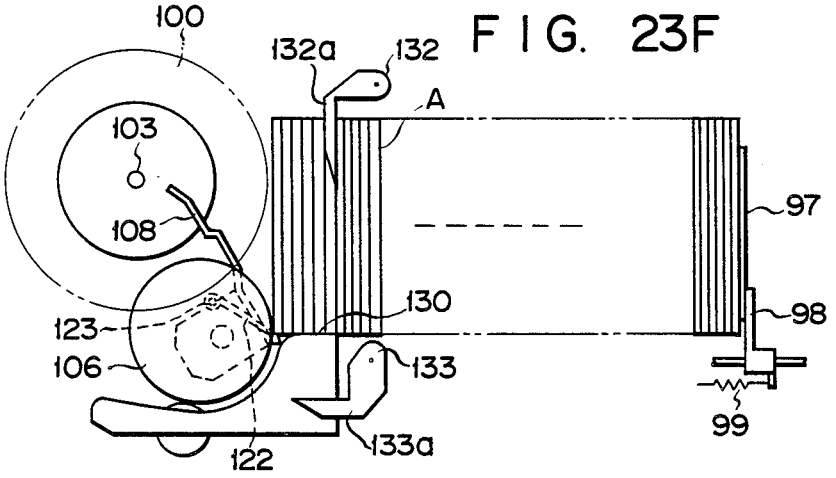

After the end of counting, the main control section 150 causes the CRT display unit 10 in the operation panel 3 to display the number of bills in units of denominations and a total deposit amount, so that the customer can confirm whether or not the display information is correct. When the customer depresses the confirmation button (ST9), the automatic bank note transaction apparatus communicates with a main processing apparatus as the host computer on an on-line basis. When the deposit transaction is "permitted" as a result of this communication, the pulse motor 136 shown in FIG. 9 is driven, and the separator mechanisms 28, 29, and 30 are moved to the right (ST10) while the lower flapper 133 is opened. The separator mechanisms 28, 29, and 30 are moved to the left (ST11) by a distance of the previous movement to the right while the lower flapper 133 is open and the upper flapper 132 is closed, as shown in FIG. 23F.

Figure 23G:
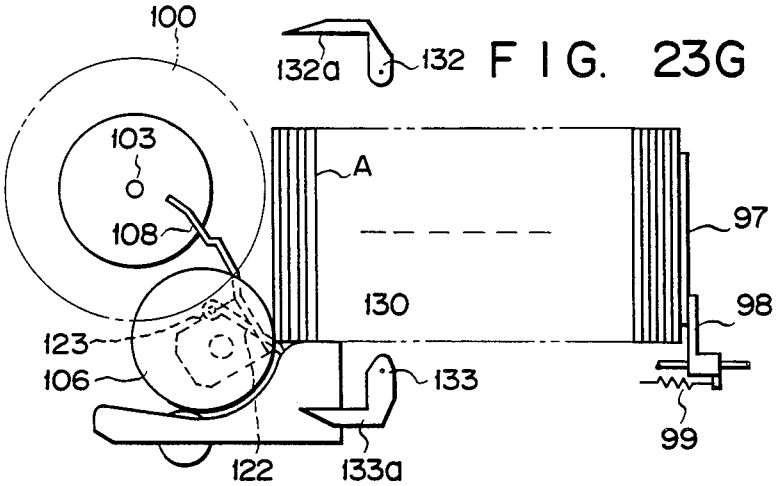

The separator mechanisms 28, 29, and 30 are moved to the right (ST12) while the lower flapper 133 is kept open and the upper flapper 132 is being opened, as shown in FIG. 23G. In this case, the pawls 132*a*, 132*b*, 132*c*, and 132*d* of the upper flapper 132 are controlled by the pulse motors 136 and 138 so as not to flip the bills into the temporary storage sections 32, 33, and 34 and so as to draw linear tracks along the upright direction of the bills A. The bills A are urged by the press plate 97 of each of the separator mechanism 28, 29, or 30 and moved to the left, so that the bills are collected together with the bills A stored in the corresponding, temporary storage sections 32, 33, and 34, and abut against the corresponding stacking/dispensing units 24, 25, and 26.

Figure 23H:
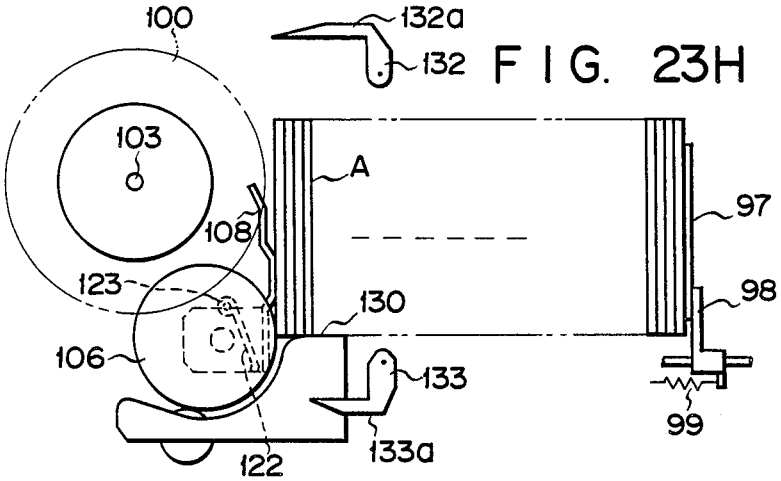
Figure 23I:
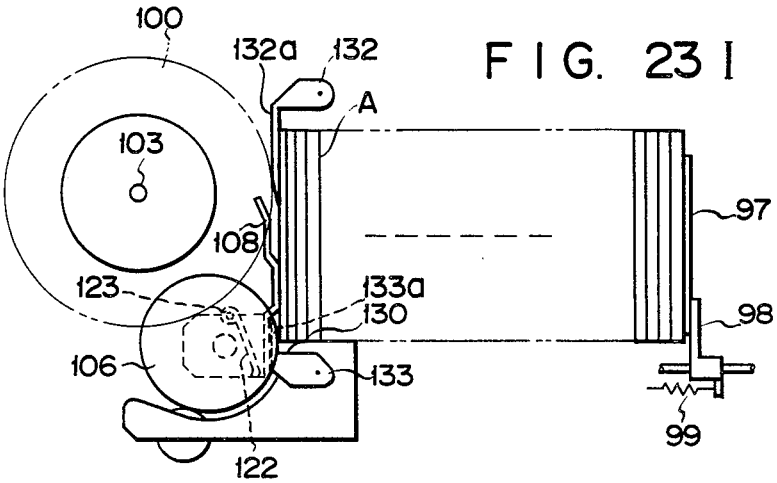
Figure 23J:
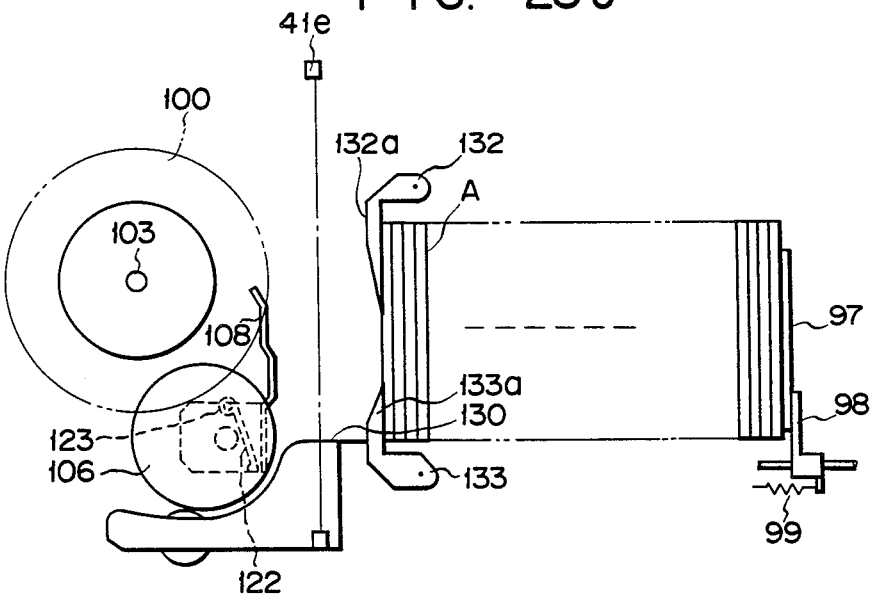
Figure 23K:
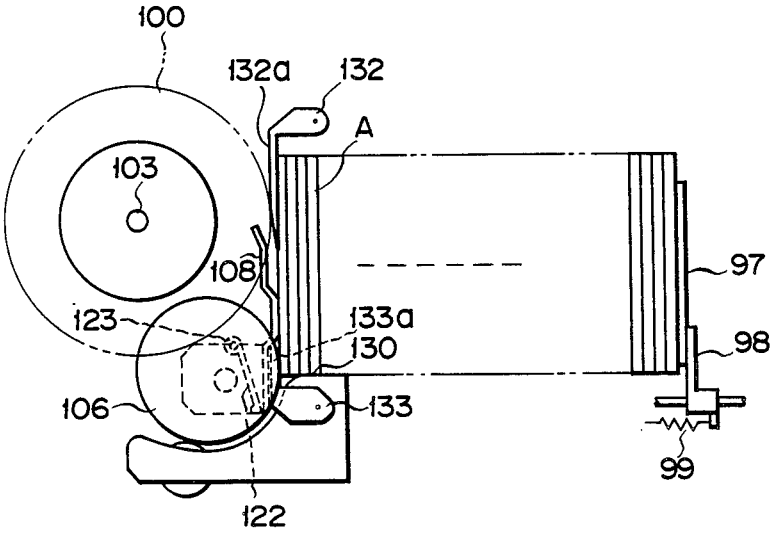
Figure 24:
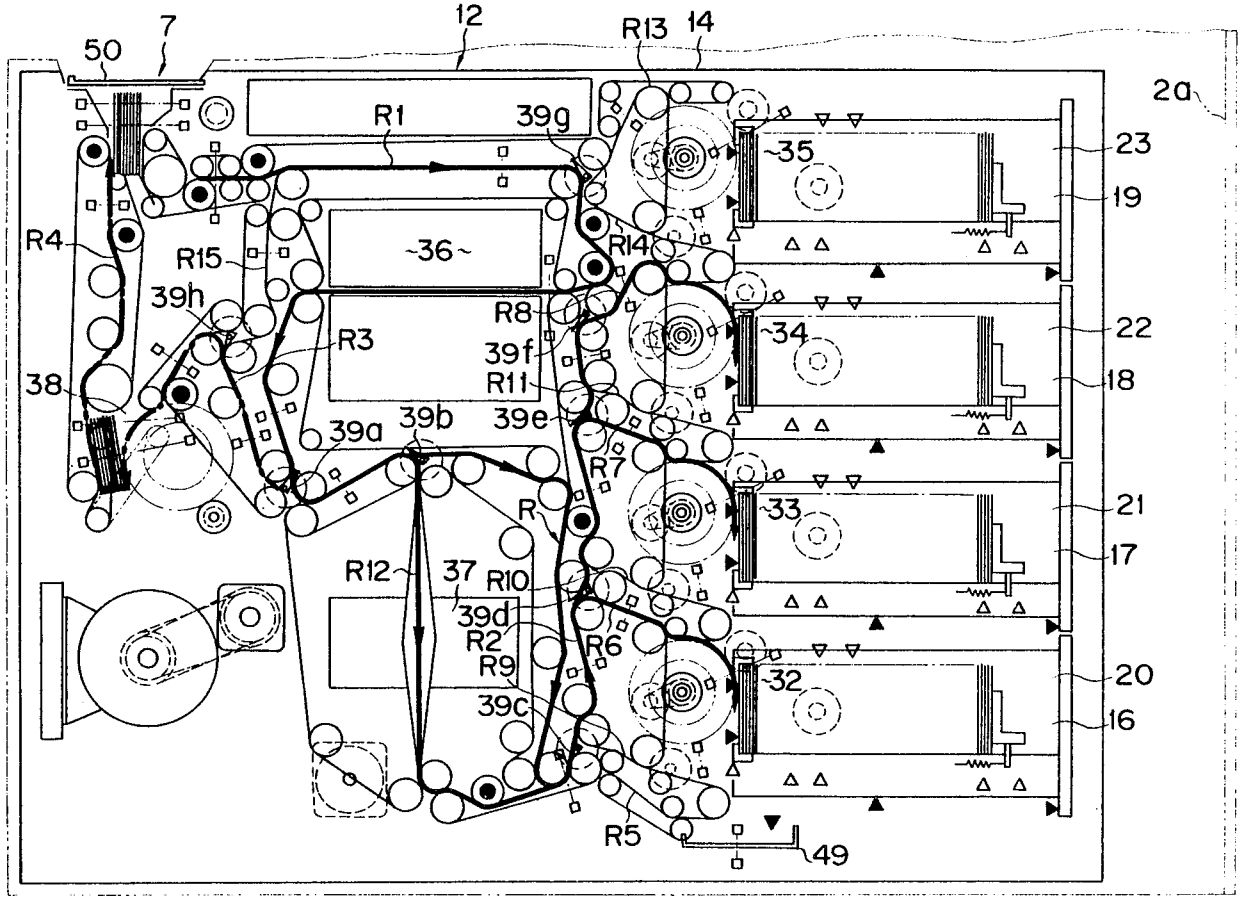

As shown in FIG. 23H, the movable member 108 is pivoted clockwise to be vertically positioned. At the same time, the separator units 28, 29, and 30 are moved to the stacking position shown in FIG. 23I (ST13). The flappers 132 and 133 are fully closed (ST14), and the separator mechanisms 28, 29, and 30 are moved to the right by a predetermined distance (25 mm in this case) (ST15). The sensors 41*e*, 41*f*, and 41*g* check whether any bill A is left (ST16). If NO in ST16, the separator mechanisms 28, 29, and 30 are moved to the standby position, as shown in FIG. 23K (ST17). In this standby position, a residual bill detecting lever 143 checks again whether or not any bill is left. If no bill is left, the deposit transaction is completed. However, if any bill is left, the deposit transaction operation is performed in accordance with the bill flow shown in FIG. 24. The deposit transaction operation is shown in the flow charts in FIGS. 25A and 25B.

Figure 26:
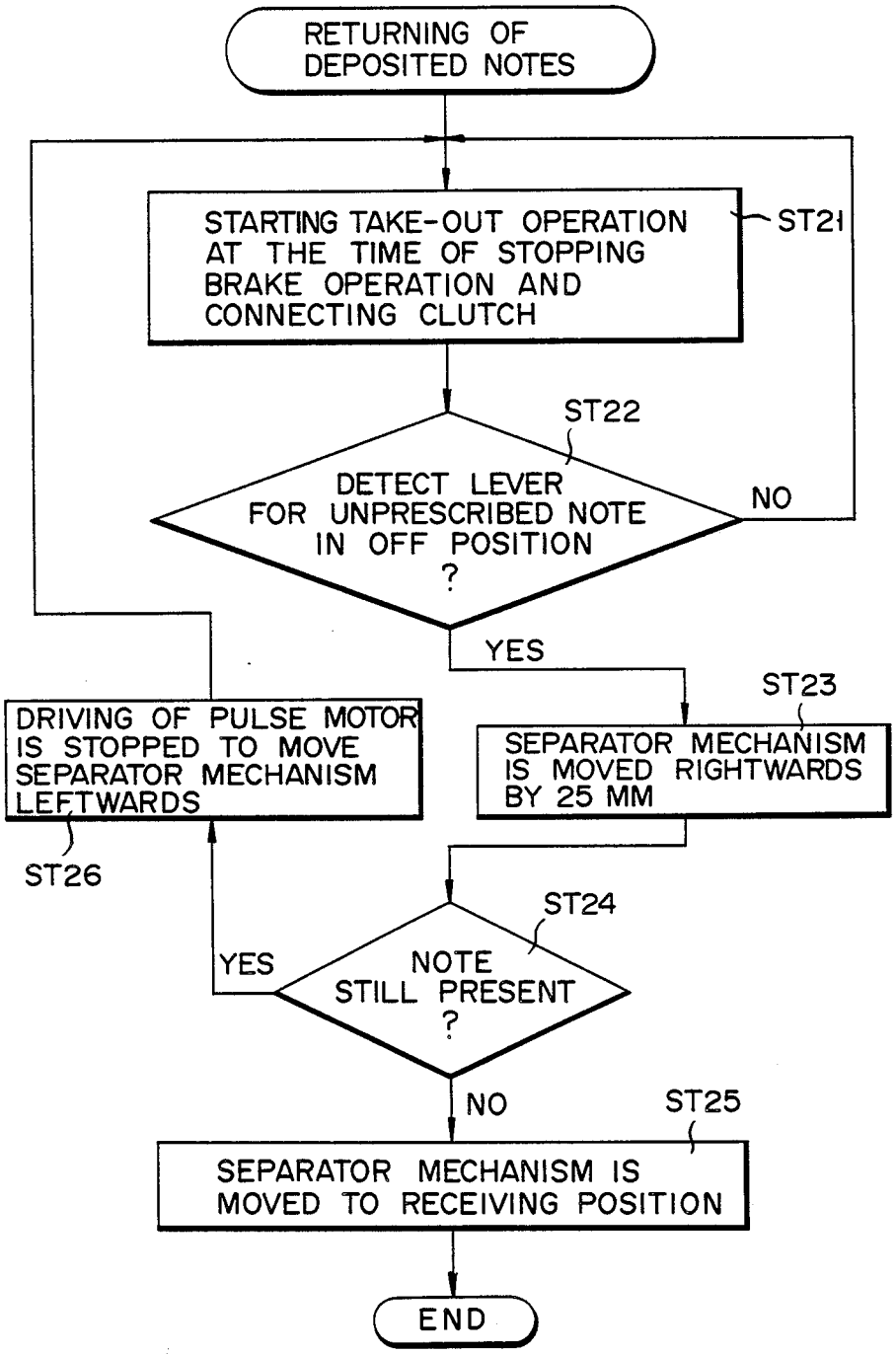

The deposit return operation will now be described with reference to FIG. 26.

Figure 27A:
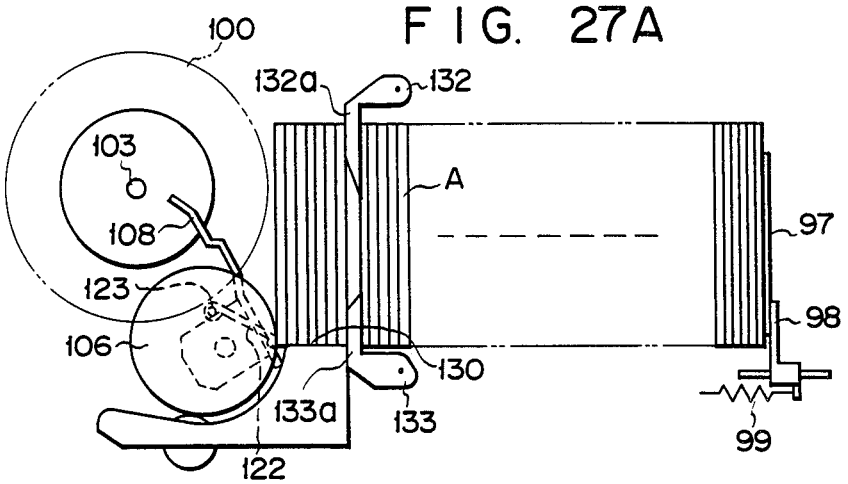
FIGS. 27A to 27E are side views showing operating states of the bill stacking/dispensing unit in the deposit return mode.
Figure 27B:
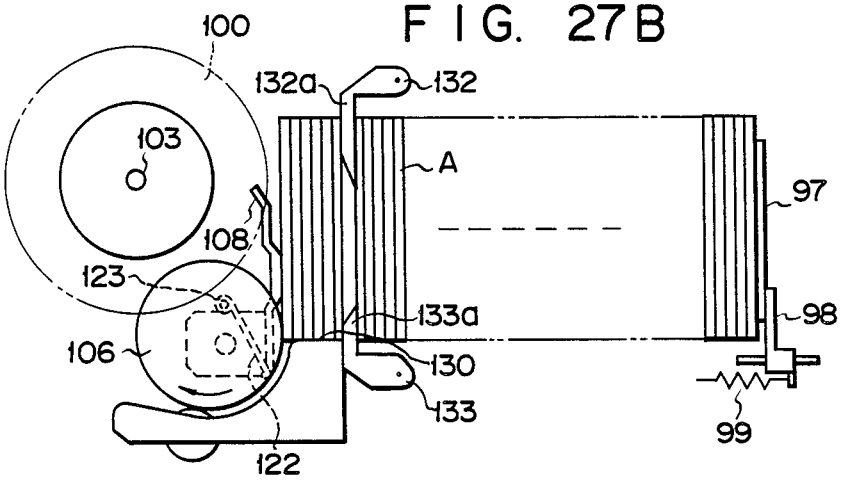

When the customer depresses the cancel button, or the transaction is "not permitted" as a result of communication between the automatic bank note transaction apparatus and the host computer, the main control section 150 sets the apparatus in the deposit return mode and generates a return instruction to the receiving/dispensing mechanism 12. In response to the return instruction, the bills A stacked in the temporary storage sections 34, 33, and 32 are received in an order of the third, second, and first denominations. All bills are collectively stacked in the temporary stacking section 38. In particular, each VR type pulse motor 136 for horizontally driving the respective separator mechanisms 28, 29, and 30 is deenergized. The locking of the upper and lower flappers 132 and 133 by means of the motor 136 is released, so that the upper and lower flappers 132 and 133 together with the bills A are urged by the spring 99 through the press plate 97. In this manner, the bills A in the temporary storage sections 32, 33, and 34 are urged toward the impellers 100, as shown in FIG. 27A. When the movable member 108 is pivoted clockwise, as shown in FIG. 27B, the bills A in the temporary storage sections 32, 33, and 34 are inserted between the pawls 132*a* to 132*d* of the flapper 132 and the pawls 133*a* to 133*d* of the flapper 133.

Figure 27C:
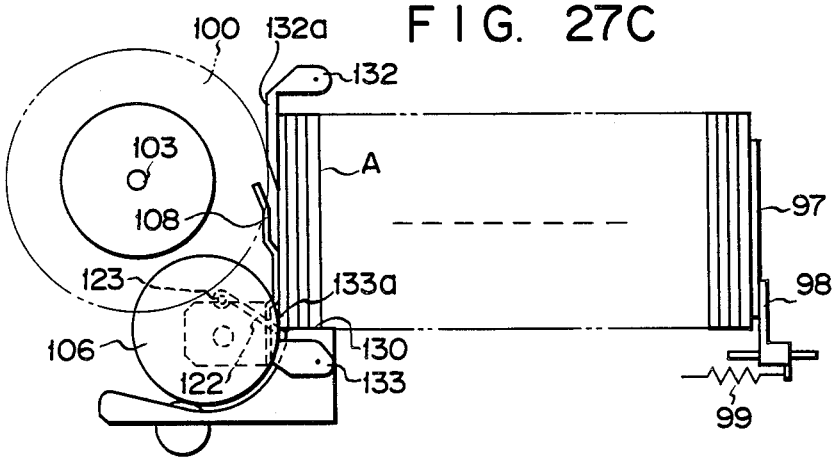
Figure 27D:
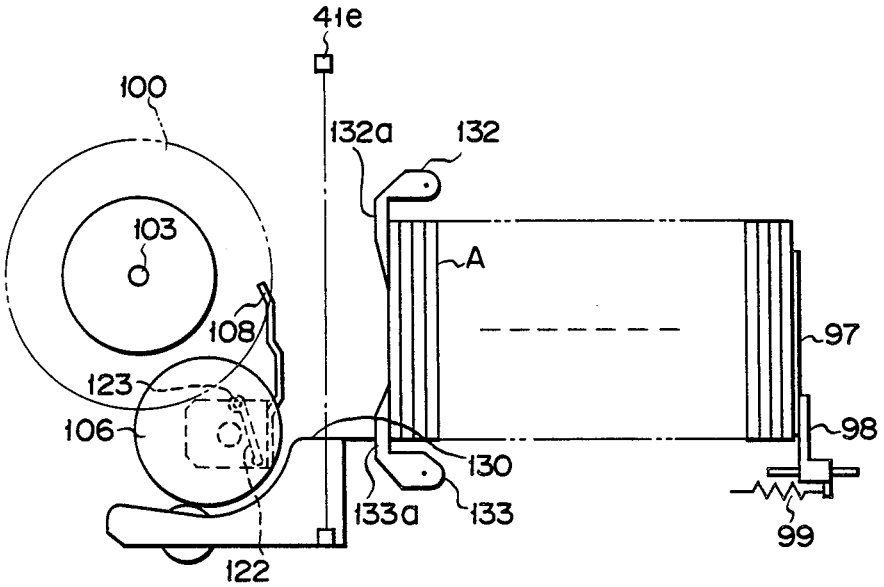
Figure 27E:
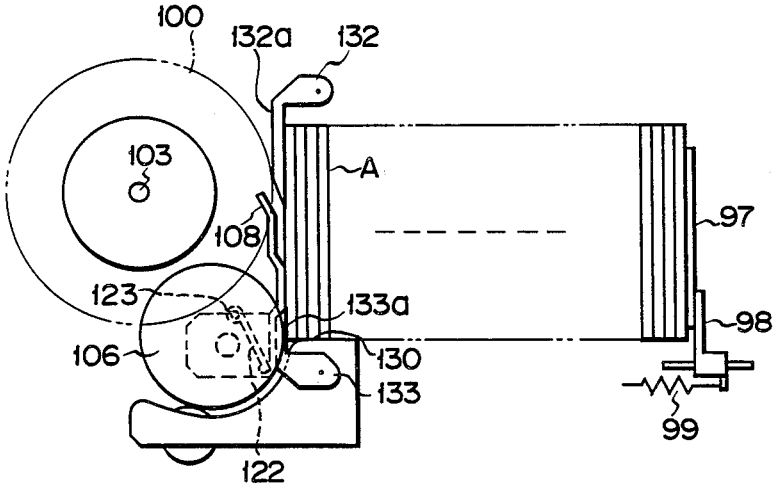

The pivotal movement of the rotating members 106*a*, 106*b* and 106*c* is started, so that the bills in the temporary storage sections 32, 33, and 34 are stacked in the temporary stacking section 38 (ST21). The end of the bill reception in the cassettes 16, 17, and 18 is detected when the last bill A is removed from the lever 94 and the sensor 96 is turned off, as shown in FIG. 27C (ST22) (see FIG. 15). Subsequently, the separator mechanisms 28, 29, and 30 are moved to the right (ST23), as shown in FIG. 27D (by a distance of 25 mm in this case). Thereafter, the sensors 41*e*, 41*f*, and 41*g* check whether or not any bill is left (ST24). If NO in ST24, the separator mechanisms 28, 29, and 30 are moved to the standby position (ST25), as shown in FIG. 27E, thereby terminating the deposit return operation. If YES in ST24, the return process is repeated (ST26).

Figure 28:
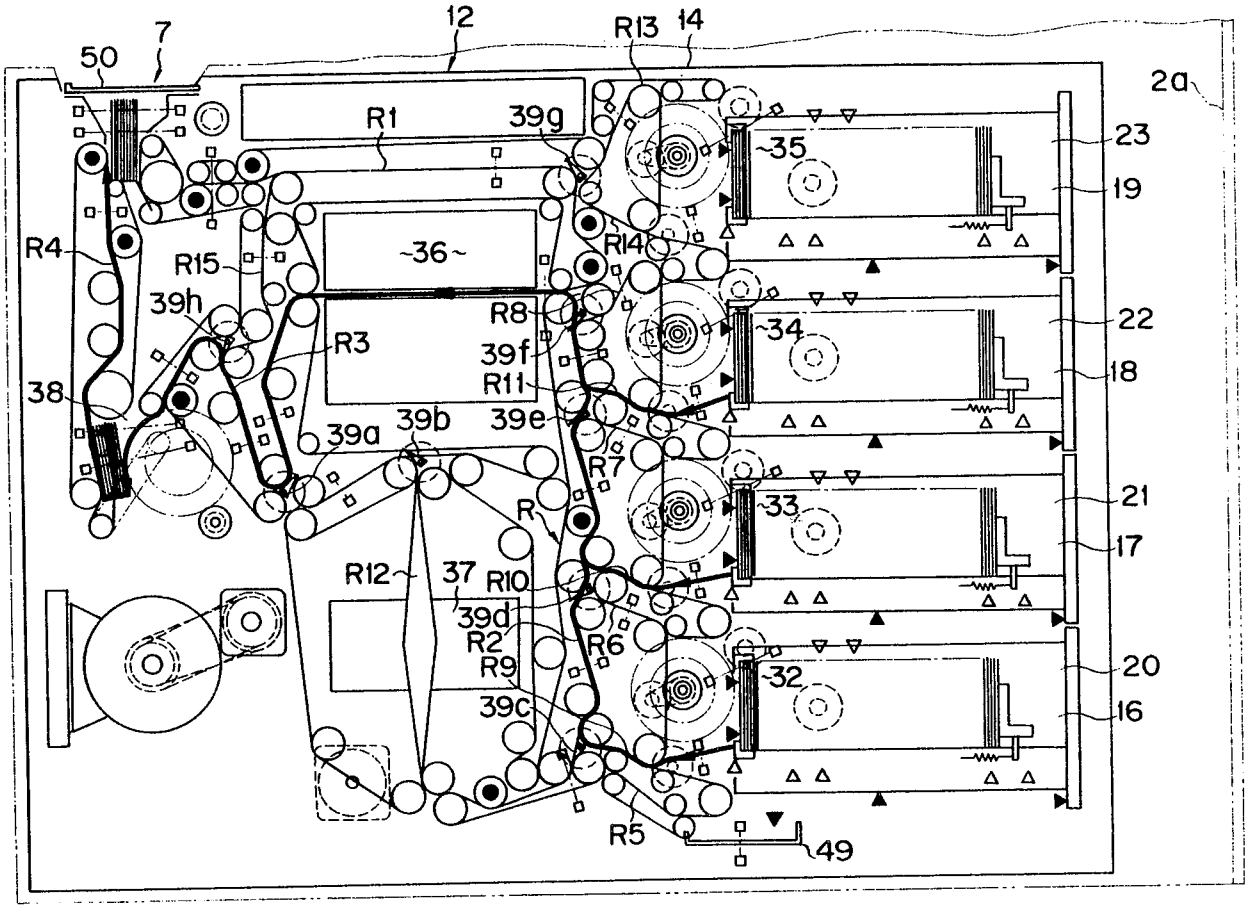

The received bills (deposit) taken out from the temporary storage sections 32, 33 and 34 are conveyed, one by one, along the rear half portion of the second convey path R2, the rear half portion of the first convey path R1 and the third convey path R3 and are stored in the temporary stacking section 38. After all the received bills are stacked in the temporary stacking section 38, the bills A are simultaneously conveyed in the bill storage chamber 51, as shown in FIG. 17. Thereafter, the bills A are popped up by a bill dispensing mechanism (pop-up mechanism) from the bill storage chamber 51 to the receiving/dispensing port 7 to permit the customer to remove the bills. In this case, the main control section 150 causes the CRT display unit 10 to display a message "Deposit is returned". The flow of the return operation is given by the solid line in FIG. 28.

All the received bills (deposit) are temporarily stacked in the temporary stacking section 38 in the automatic return mode regardless of the operating conditions, and the bills are collectively conveyed into the bill storage chamber 51. The bills are returned by the bill dispensing mechanism (pop-up mechanism) shown in FIG. 6 to the corresponding customer. The bills to be returned to the customer are not discriminated by the discrimination section 36. Although the discrimination section 36 can perform the operation for the bills to be returned in the same manner as in the case of received bills (deposit), the discrimination section 36 is not used because a recovery means becomes complicated when the number of received bills does not coincide with the number of bills to be returned. In addition, when overlying bills are detected at the time of reception, the number of received bills cannot be identified with the number of bills to be returned.

The bill receiving/dispensing mechanism 12 is arranged to be adapted to provide a retry recovery means.

Figure 29A:
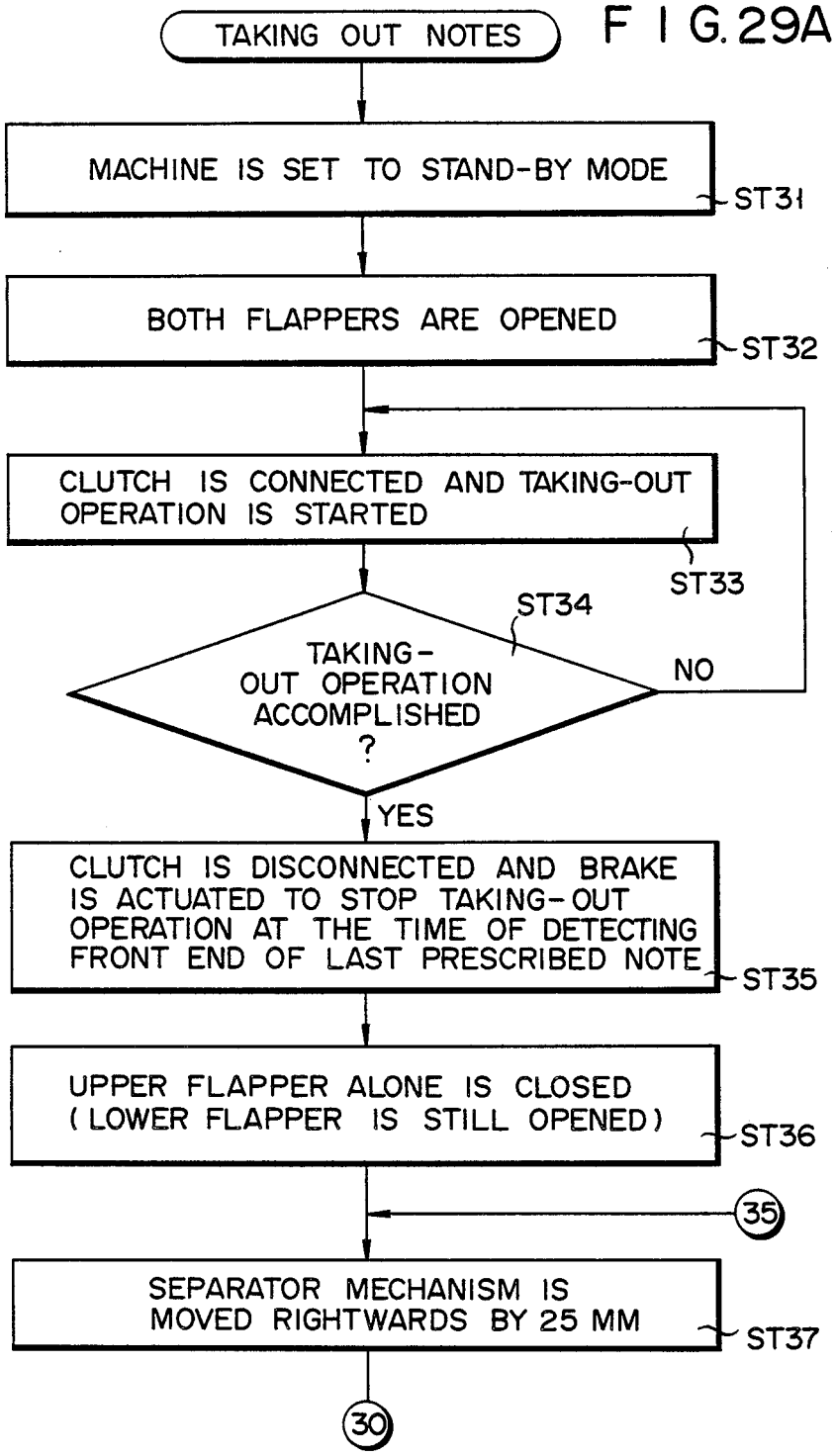
FIGS. 29A to 29C are flow charts for explaining the operation of the main parts in a withdrawal transaction mode.
Figure 29B:
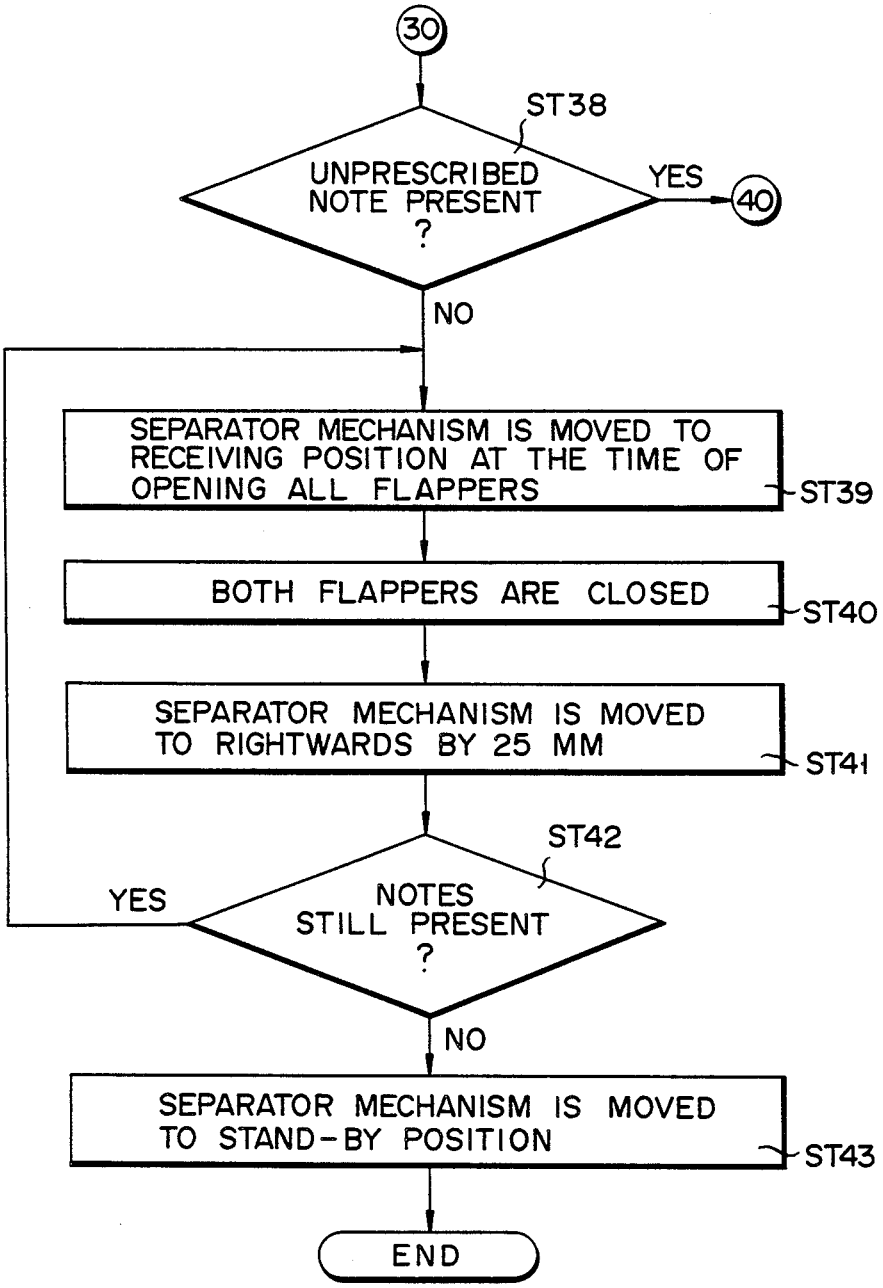
Figure 29C:
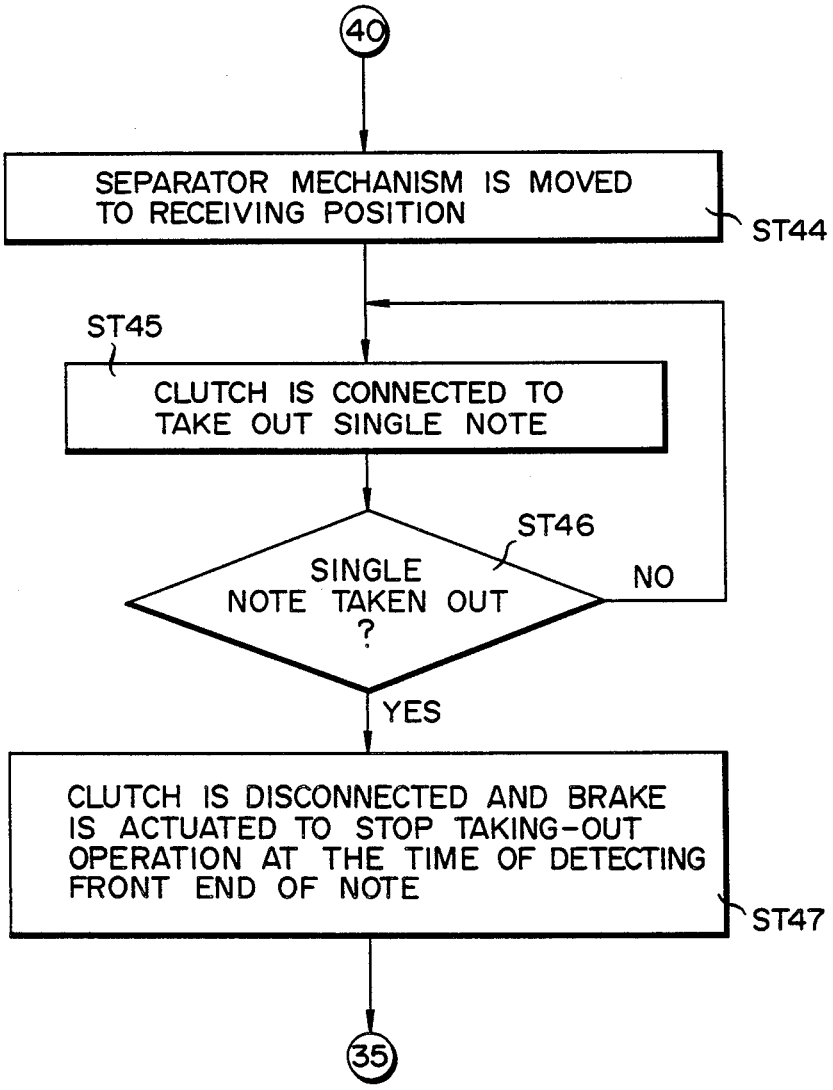

Dispensing operation will now be described with reference to the flow charts shown in FIGS. 29A and 29B.

When the customer depresses a "withdrawal" button of the operation buttons 8 at the time of transaction item selection, the main control section 150 causes the CRT display unit 10 to display a message "Enter withdrawal amount and press end button". The customer enters a withdrawal amount with the operation buttons 8. The main control section 150 causes the CRT display unit 10 to display a message "Press confirmation button or exchange button if the displayed amount is correct, or press cancel button if the amount is incorrect". Upon depression of one of confirmation and exchange buttons, the main control section 150 causes the CRT display unit 10 to display a message "Busy. Please wait". Meanwhile, the main control section 150 communicates with the host computer on an on-line basis and generates a withdrawal command to the bill receiving/dispensing mechanism 12. In response to this command, the bill receiving/dispensing mechanism 12 causes the storage sections 21 and 22 to dispense bills of predetermined denominations so as to correspond to the required withdrawal amount. The dispensed bills are stacked in the temporary stacking section 38.

Figure 30A:
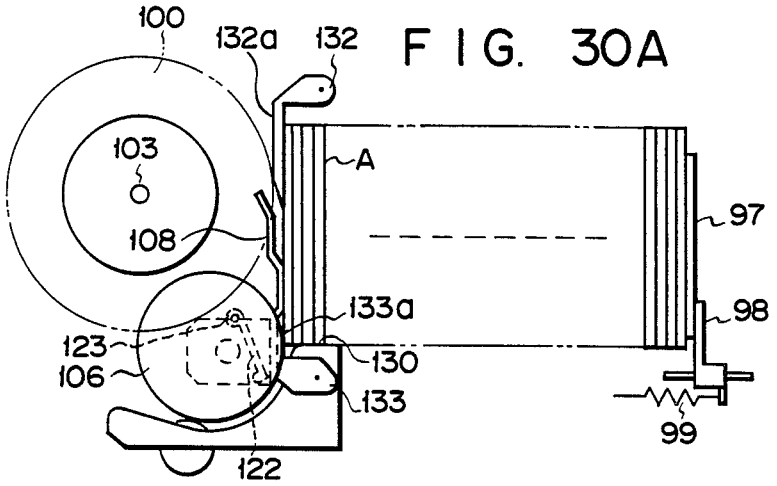
FIGS. 30A to 30K are side views showing the operating states of the bill stacking/dispensing unit in the withdrawal transaction mode.
Figure 30B:
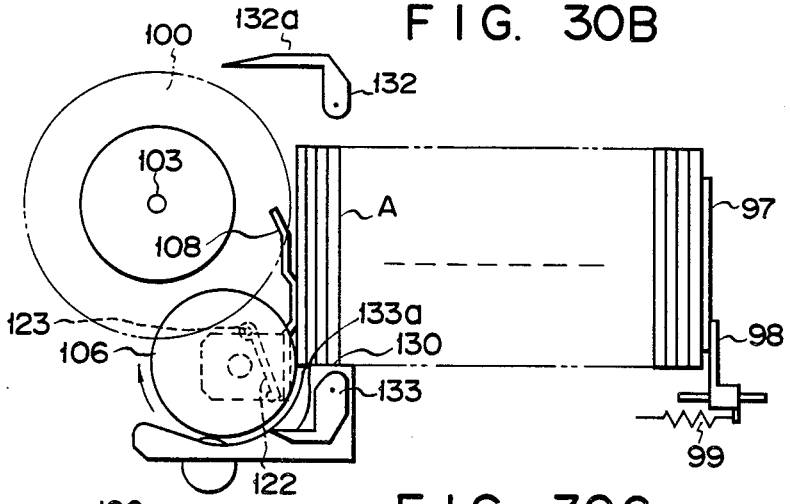

The flappers 132 and 133 of each of the separator mechanisms 30 and 29 of the third and second storage sections 22 and 21 are opened by the pulse motor 136 from the standby position shown in FIG. 30A (ST31) to the position shown in FIG. 30B (ST31).

The rotating members 106 are rotated to dispense the bill A from the third storage section 22 by connecting a clutch (not shown) (ST33). In this manner, the bill is dispensed.

The bill is sequentially gated through the selector gates 39*f*, 39*g* and 39*h* and is conveyed through the rear half portion of the second convey path R2, the rear half portion of the first convey path R1 and the third convey path R3, as indicated by the thick solid line in FIG. 21. The thus conveyed bill is stacked in the temporary stacking section 38. In this case, the bill of the third denomination which is dispensed from the third storage section 22 is detected by the bill flow sensor 40*r*. The main control section 150 counts the number of bills dispensed from the third storage section 22 in accordance with the detection signal from the sensor 40*r*. The bill dispensed from the second storage section 21 is detected by the bill flow sensor 40*q*, and the main control section 150 counts the number of bills dispensed from the section 21 in accordance with the detection signal from the sensor 40*q*.

When the counts of the bill flow sensors 40*r* and 40*q* coincide with the preset numbers, respectively, the main control section 150 causes the bill receiving/dispensing unit 15 to stop dispensing bills from the storage sections 22 and 21 (ST34).

When the sensors 40*r* and 40*q* detect the leading end of the final bill, a clutch (not shown) is deenergized and a brake is actuated, so that the rotating members 106*a* to 106*c* stop (ST35). In this case, the foremost bill of the bills A located in the first bill storage section 20 is partially dispensed while it is inserted between the rotating members 106*a* to 106*c* and the roller 113. In other words, an unprescribed note or bill which may undesirably follow the last prescribed note and part of which comes into the outlet port, is present. In order to perform the following operation, the unprescribed note must be lifted on the supports 130. Therefore, the unprescribed note must be restored.

Figure 30C:
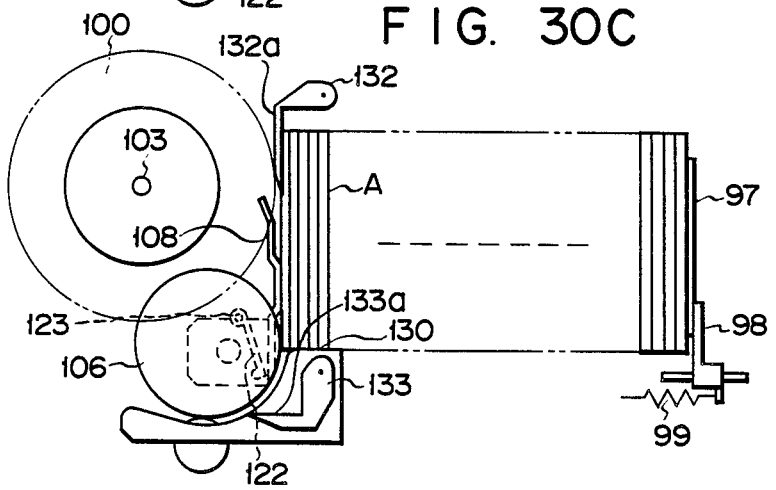
Figure 30D:
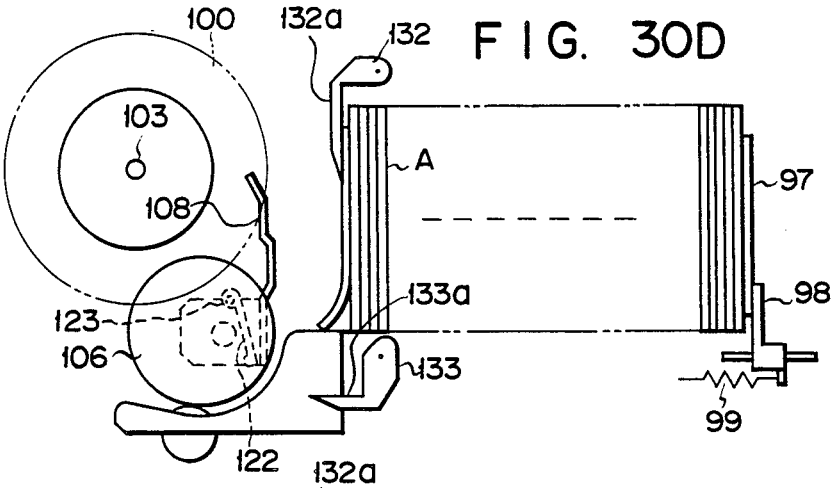

As shown in FIG. 30C, the upper flapper 132 is kept closed, and the lower flapper 133 is kept open (ST36). The separator mechanisms 28 and 29 are moved by 25 mm to the right (i.e., in the direction opposite to the stacking direction with respect to the rotating members 106*a* to 106*c*) (ST37). In this case, the lever 94 checks whether or not any unprescribed note is still left (ST38). If YES in ST38, the lever 94 is urged by the bills A (see FIG. 15), so that the sensor 96 for detecting the lever 94 continuously generates the "bright" signal.

Figure 30E:
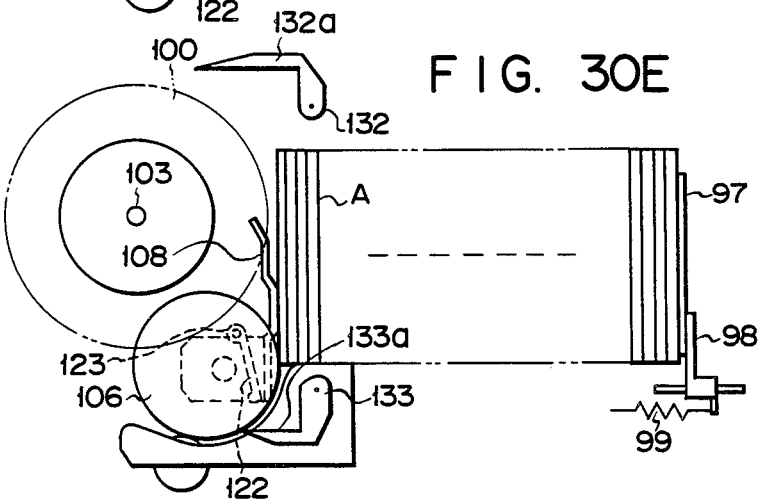
Figure 30F:
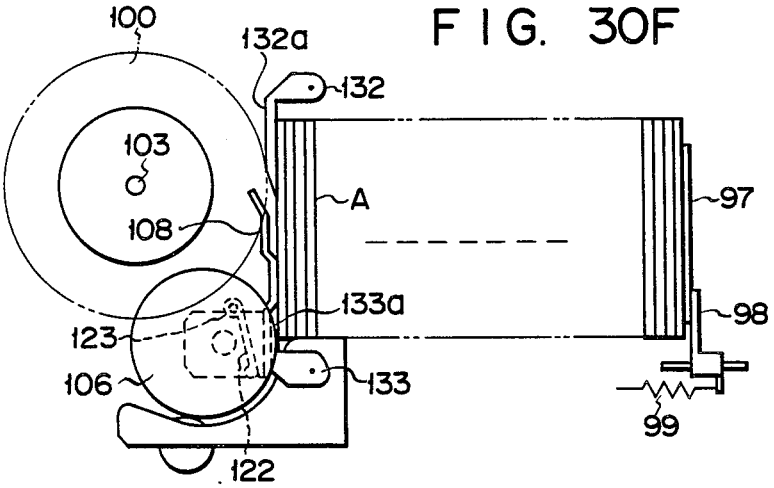
Figure 30G:
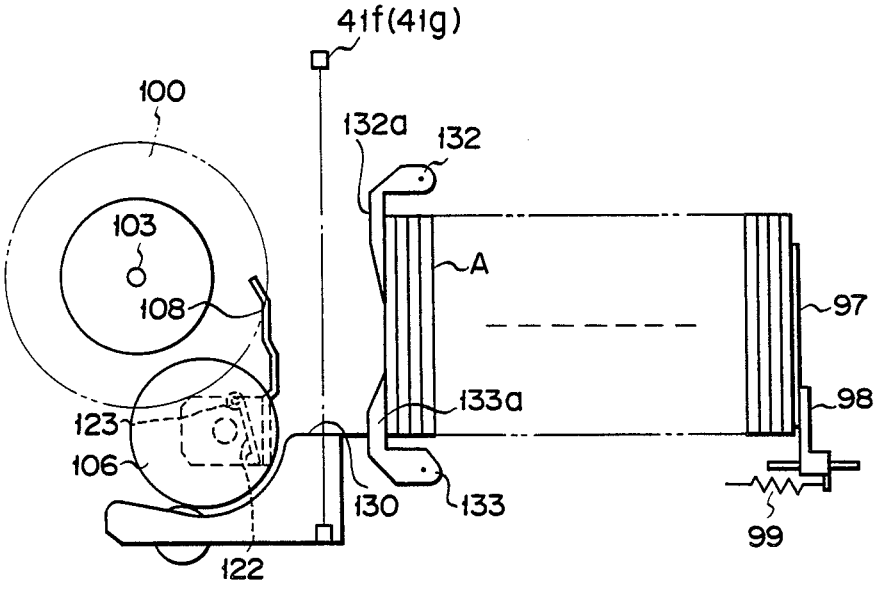
Figure 30H:
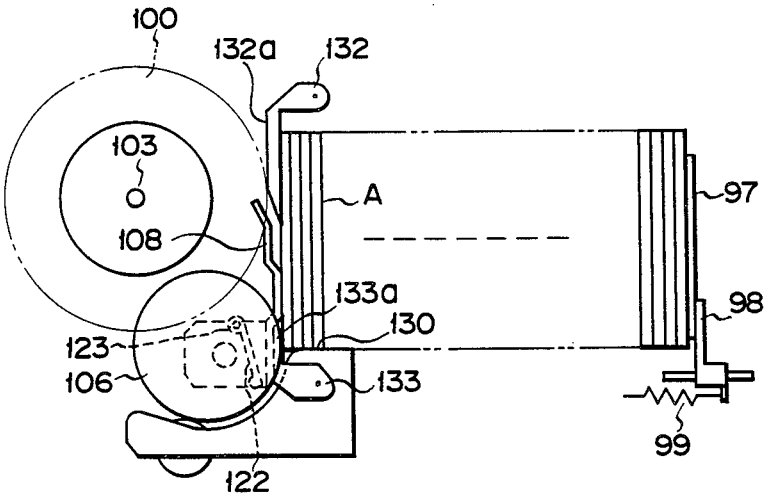

However, if NO in ST38, the upper and lower flappers 132 and 133 are fully opened, as shown in FIG. 30E. At the same time, the separator mechanism 28 or 29 is moved to the storage position (ST39). Subsequently, as shown in FIG. 30F, the flappers 132 and 133 are fully closed (ST40), and then the separator mechanisms 28 and 29 are moved by 25 mm to the right, as shown in FIG. 30G (ST41). The sensors 41*f* and 41*g* check whether or not any note or bill is left (ST42). If no note is left, the separator mechanisms 28 and 29 are moved to the standby position, as shown in FIG. 30H, thereby completing dispensing (ST43).

However, if any note is still left, the flappers 132 and 133 are fully opened, and the separators 28 and 29 are moved to the storage position (ST39). Thereafter, the flappers 132 and 133 are fully closed (ST40), and the separator mechanisms 28 and 29 are moved to the right (ST41). The sensors 41*f* and 41*g* then check whether or not any note is left (ST42). If NO in ST42, the separator mechanisms 28 and 29 are moved to the standby position, thereby ending dispensing (ST43).

Figure 30I:
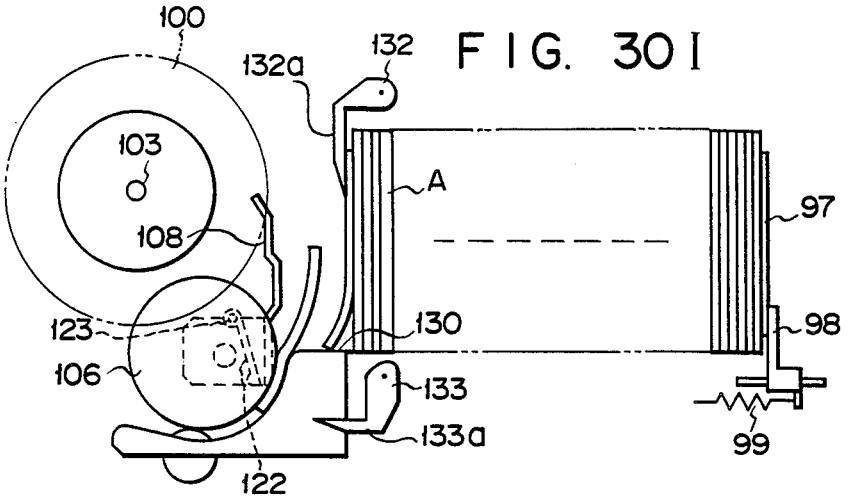
Figure 30J:
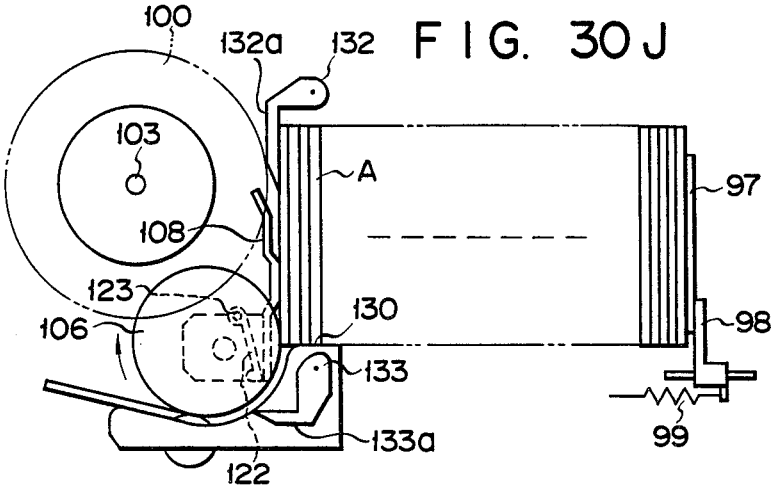

As shown in FIG. 30I, when an unprescribed note is left, the pulse motor 138 is deenergized while only the upper flapper 132 is kept closed so as to clamp the upper portion of the unprescribed note with the subsequent notes A located behind the lower flapper 133 and the upper flapper 132. Thereafter, the clutch is turned on to rotate the rotating members 106*a* to 106*c* so as to remove the note or bill A, as shown in FIG. 30J (ST44 and ST45). When the leading end of the bill or note A is detected by the sensors 40*q* and 40*r*, the clutch is turned off, and the brake is turned on, thereby removing only one note (ST46 and ST47). The removed note is sorted by the separator gates 39*d*, 39*e*, 39*f*, 30*a*, 39*b*, and 39*c* and is conveyed into a rejected bill stacking section 49 through the convey paths R6 and R4.

Figure 30K:
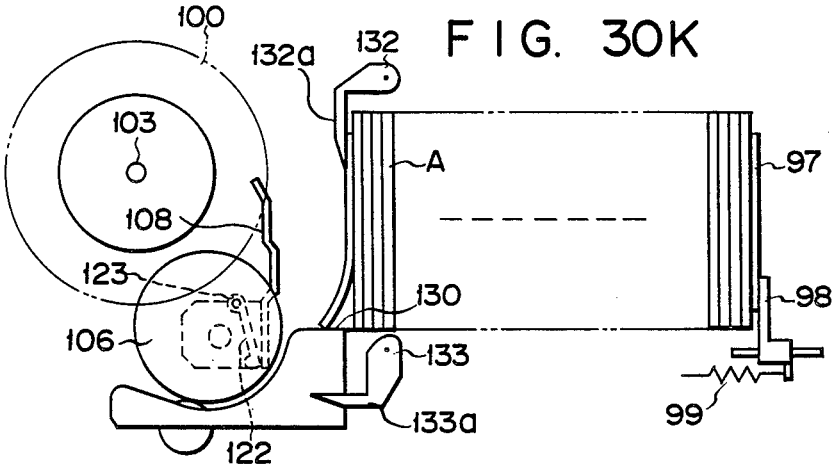

Thereafter, the separator mechanisms 28 and 29 are moved to the right (ST37) while only the upper flapper 132 is kept closed, as shown in FIG. 30K. As shown in FIG. 30L, it is checked whether or not any unprescribed note is left (ST38). If NO in ST38, the flappers 132 and 133 are fully opened, and the separator mechanisms 28 and 29 are moved to the storage position (ST39). Subsequently, the flappers 132 and 133 are fully closed (ST40), and the separator mechanisms 28 and 29 are moved by 25 mm to the right (ST41). It is then checked whether or not any note is left (ST42). If NO in ST42, the separator mechanisms 28 and 29 are moved to the standby position (ST43).

When the bill passes through the discrimination section 36, it is subjected to "denomination discrimination" and the like. The discrimination results are supplied to the main control section 150. The main control section 150 causes a counter (not shown) to count the number of the bills passing through the discrimination section 36 by the discrimination results. The bills stacked in the temporary stacking section 38 are subjected to stacking detection by the bill flow sensor 40*f*. In response to this detection signal from the bill flow sensor 40*f*, the main control section 150 counts the number of bills stacked in the temporary stacking section 38.

The main control section 150 performs an identification operation as to whether or not a total number of bills of the second and third denominations in accordance with the discrimination result coincides with the count of the bill flow sensor 40*f*.

As described above, the bill A is subjected to "denomination discrimination" in the discrimination section 36, so that the bill is rechecked as a bill dispensed from the corresponding one of the storage sections 22 and 21. Although this denomination discrimination need not be performed, the possibility exists that bank personnel may erroneously replenish the bills. For this reason, this denomination rediscrimination is preferred.

The "fit/unfit discrimination" is performed in the service mode at the time of cash deposit such that selection of bills in accordance with fit/unfit bills is required. Especially, in the cash deposit operation, any damaged bill which is contaminated, partially worn or applied with adhesive tape is preferably accepted if it can be discriminated to be "authentic". In this case, the service mode is set such that damaged bills are stored in either the third and second storage sections 22 and 21 so as to use them as bills to be dispensed, or in the first storage section 20 as rejected bills. In the former case, the bills must be rechecked for fit/unfit bills. In the latter case, the "fit/unfit discrimination" need not be performed.

In either case, unfit bills must not be dispensed to the customer.

When "fit/unfit discrimination" is performed, the unfit bill is regarded as a bill which cannot be recycled and is rejected as a rejected bill into the first storage section 20. In practice, when a bill to be rejected is detected, the selector gate 39*a* is pivoted to the left to close the third convey path R3, and the selector gate 39*b* is provited to the left to close the twelfth convey path R12. The rejected bill is then stored in the first storage section 20 through the second and sixth convey paths R2 and R6 without passing through the reverse-presented bill inverting section 37, as indicated by the thick alternate long and short dashed line. It should be noted that the rejected bill can be stored in the rejected bill stacking section 49 through the second and fifth convey paths R2 and R5, as shown by the thick dotted line FIG. 21.

Figure 31:
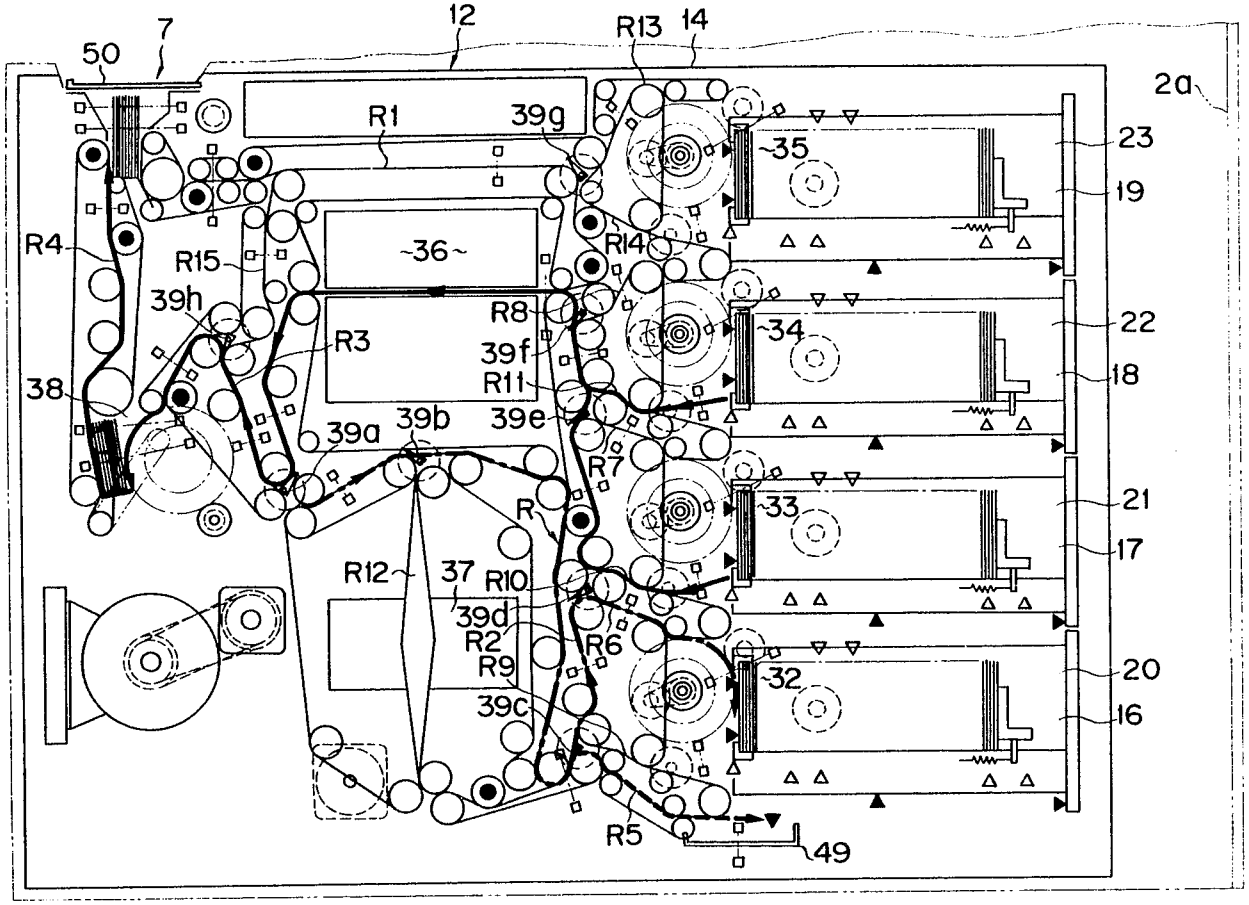

The flow of bills in the withdrawal operation is shown in FIG. 31.

When detected bills are rejected, the bills of the predetermined denominations which correspond to the number of rejected bills must be replenished. Therefore, bills are dispensed from the second and third storage sections.

Figure 7:
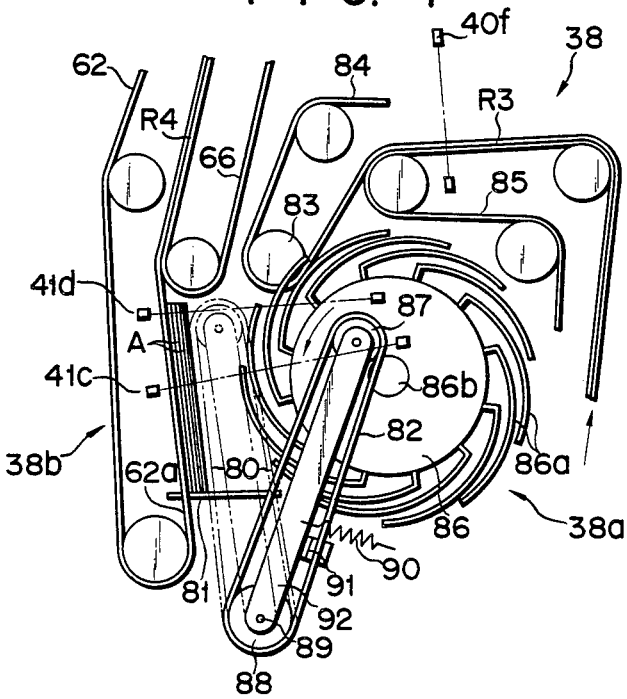

Thereafter, the bills stacked in the temporary stacking section 38 are collectively fed by the mechanism shown in FIG. 7 and are stored in the bill storage chamber 51. As a result that the main control section 150 communicates with the host computer on an on-line basis, when the withdrawal operation is permitted, the bills A are clamped by the bill dispensing mechanism (FIG. 6) and are lifted by the arm 71. The bills A partially extend through the bill receiving/dispension port 7, so that the customer can remove the bills.

On the other hand, when the withdrawal operation is not permitted as a result of the communication between the main control section 150 and the host computer, the bills stacked in the temporary storage chamber 51 are discriminated in the discrimination section 36, one by one, and are stored in the storage sections 22 and 21 in accordance with the predetermined denominations.

While the communication between the main control section 150 and the host computer is started (i.e., before permission/nonpermission for the withdrawal transaction is determined), the bills are conveyed for withdrawal, so that the time for one transaction can be greatly shortened, thereby improving the utilization efficiency of the machine. Furthermore, even if the transaction is not permitted, the bills can be stored in the corresponding storage sections. As a result, no problem is presented.

Figure 32:
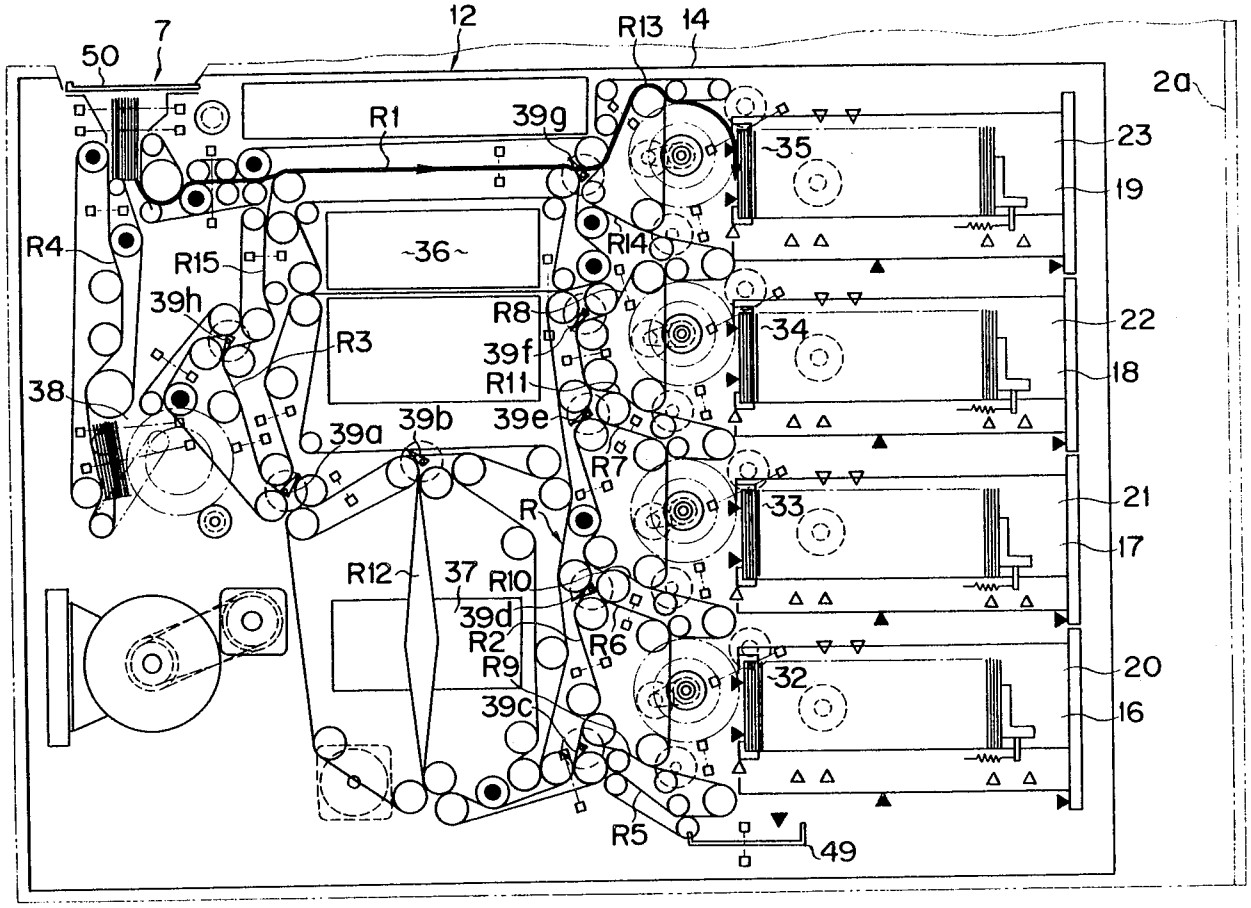
Figure 33A:
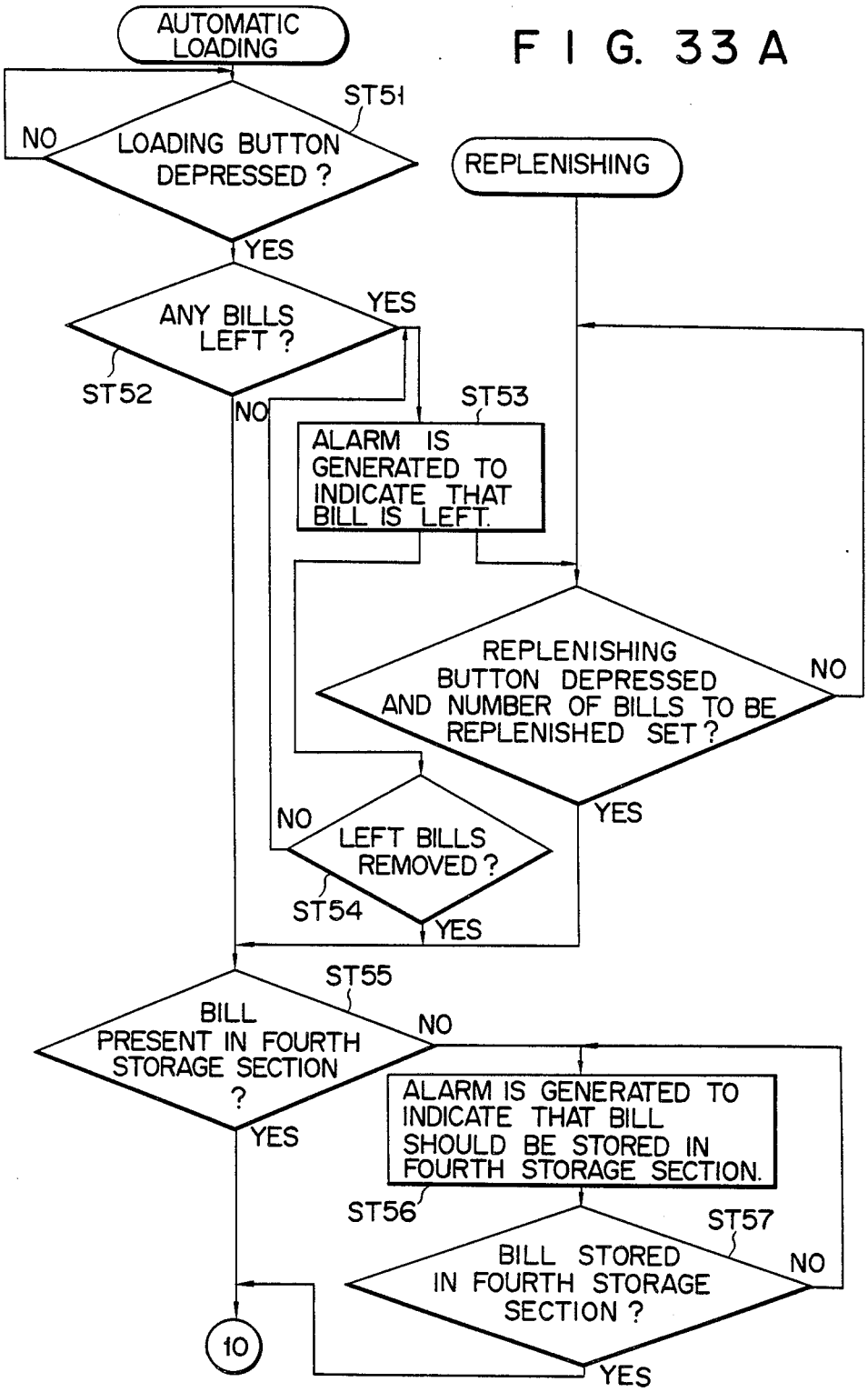
FIGS. 33A to 33C are flow charts for explaining a loading mode.
Figure 33B:
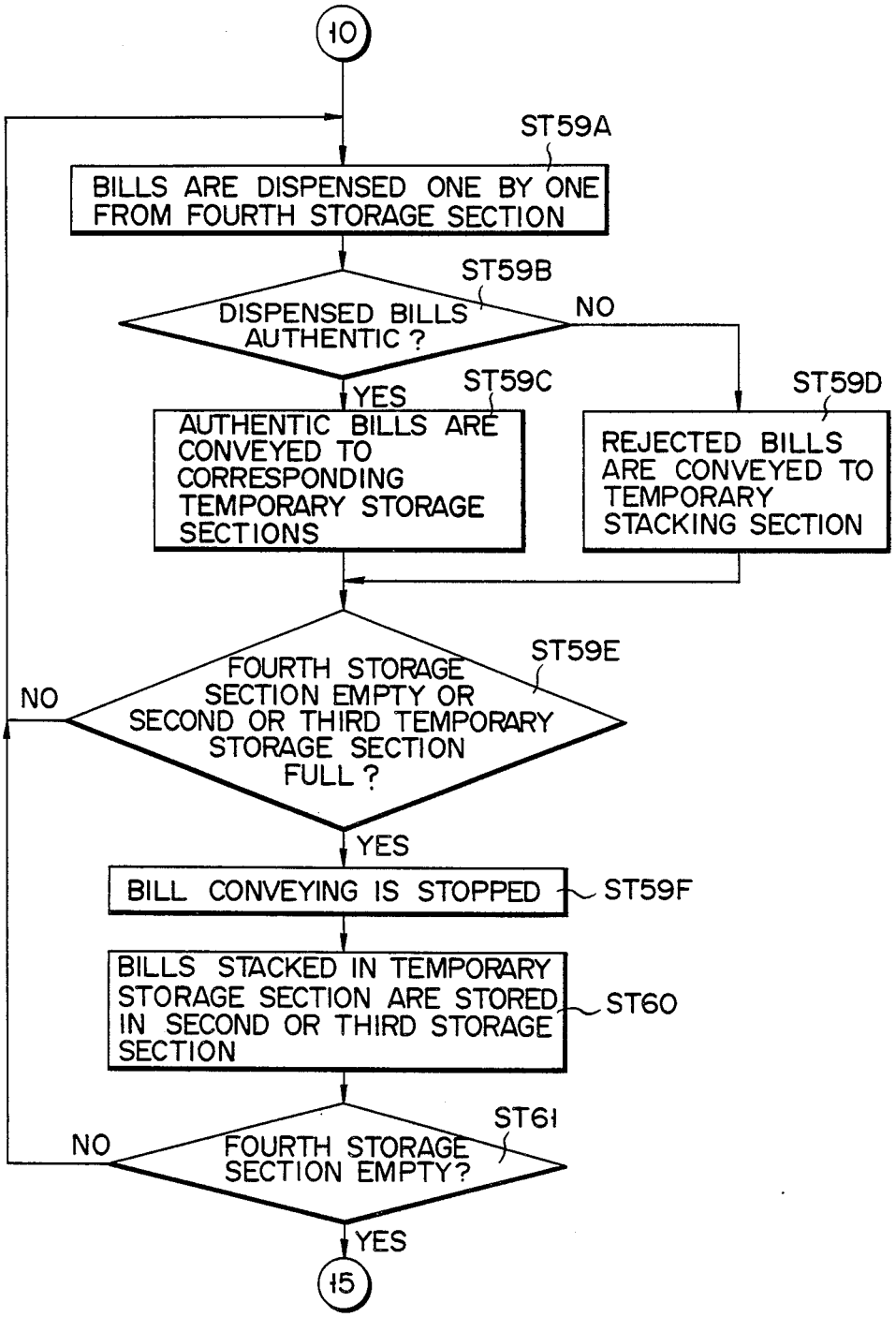
Figure 33C:
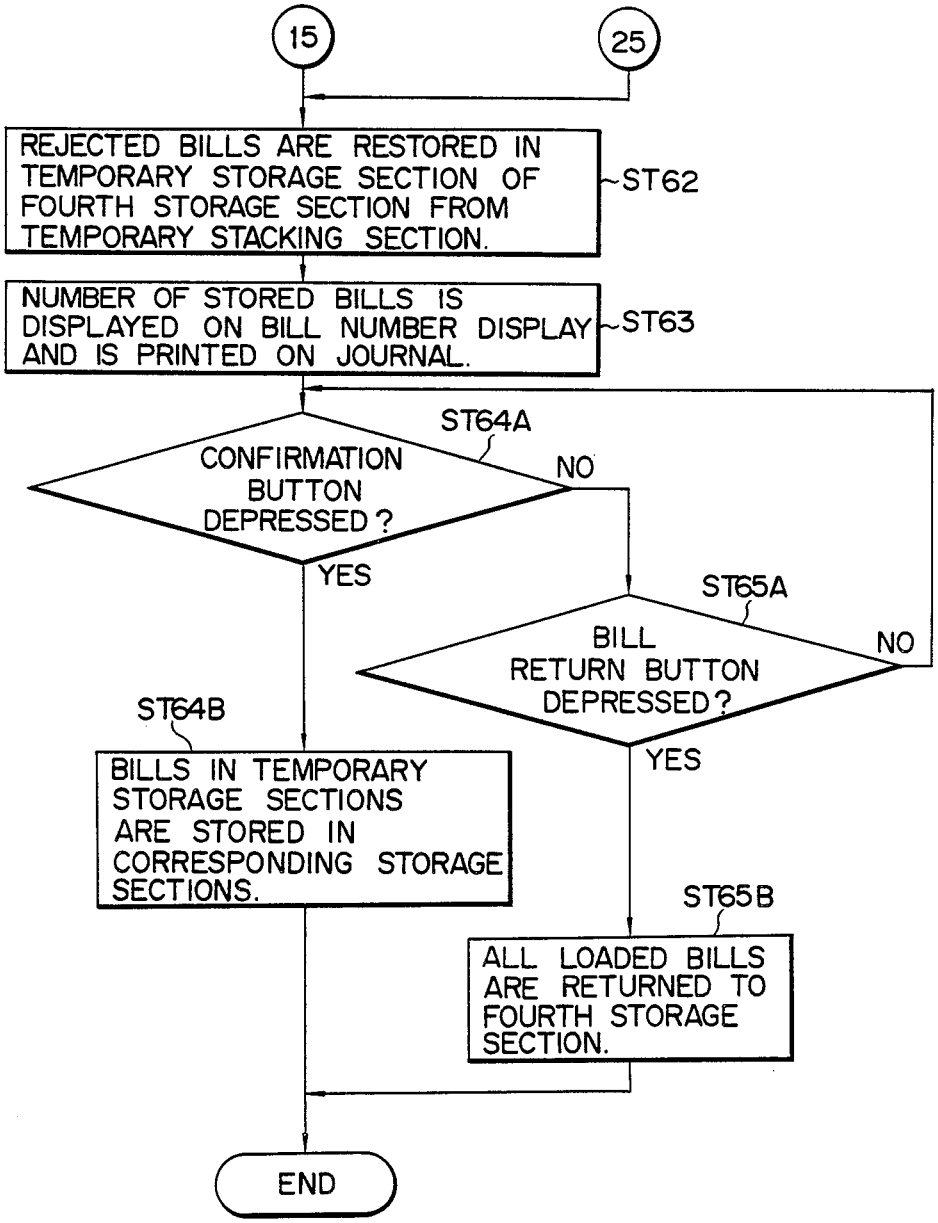

The bill recovery operation is described with reference to the bill flow given by the thick solid line in FIG. 32 when the bills (withdrawal) to be removed by the customer are dispensed by the dispensing mechanism shown in FIG. 6, the bills (deposit) are automatically returned to the customer, and the bills (deposit) are rejected bills and are dispensed.

When the customer forgets to remove the dispensed bills after a predetermined period of time has elapsed, recovery operation is performed. In the dispensing mechanism shown in FIG. 6, the bills A clamped between the first and second conveyor belts 53 and 54 and extended through the receiving/dispensing port 7 are conveyed by a drive source (not shown) in the direction opposite to the dispensing direction indicated by the arrow, and are returned to the bill sorage chamber 51. When the sensor 41*b* generates a "bright" signal and the sensor 41*a* generates a "dark" signal, the bills are completely stored in the bill storage chamber 51. At this time, the solenoid 73 is deenergized, and the arm 71 mounted on the pulley 64 around which the second conveyor belt 54 is looped returns to the initial position. Meanwhile, the door 50 is automatically closed to close the bill receiving/dispensing port 7. Thereafter, as shown in the normal deposit transaction operation shown in FIG. 4, the bills A are conveyed one by one along the first convey path R1. At this time, the selector gate 39*g* is pivoted to the left to close the first convey path R1 at the seventh branch and open the thirteenth convey path R13. In this manner, the bills conveyed, one by one, are stacked in the temporary storage section 35 of the fourth storage section 23 through the front half portion of the first convey path R1 and the thirteenth convey path R13, as indicated by the thick solid line in FIG. 32. When all the bills are recovered, they are stored from the temporary storage section 35 to the fourth storage section 23.

In the service mode wherein recovery operations continue until the fourth storage section 23 is filled with recovered bills, there are a first mode wherein the recovered bills are not corresponded to the transaction, and a second mode wherein the recovered bills are corresponded to the transaction. In the second mode, the recovered bills of the first transaction are stored in the fourth storage section 23, the recovered bills of the second transaction are stored in the temporary storage section 35 partitioned in the fourth storage section 23 by the separator mechanism 31, and the recovered bills of the third transaction are held in the bill storage chamber 51. In this manner, the apparatus need not be interrupted to perform up to two recovery procedures.

In the above embodiment, the recovered bills are directly conveyed to the fourth storage section 23 without being passed through the discrimination section 36. However, an alternate arrangement may be provided such that the selector gate 39*g* is pivoted to the right to discriminate the recovered bills by the discrimination section 36 through the first convey path R1, that the recovered bills are collectively stacked in the temporary stacking section 38 and then in the bill storage chamber 51, and that the selector gate 39*g* is pivoted to the left to store the recovered bills in the fourth storage section 23.

In addition, the recovered bills can be subjected to discrimination and counting in the same manner as deposited bills, and can be stored in the storage sections 20, 21 and 22 in accordance with the predetermined denominations.

The bill loading operation will be described with reference to the flow charts of FIGS. 33A to 33D and the bill flow shown in FIG. 34.

Every morning bank personnel load a mixture of bills of the second and third denominations that they consider will be required that day in the fourth storage section 23 of the fourth bill cassette 19. The fourth storage section 23 is set in the bill receiving/dispensing mechanism 12. The personnel depress the loading button 160 of the internal monitor unit 13 (ST51). Upon depression of the loading button 160, the main control section 150 checks whether or not any bills are left in the temporary storage sections 32, 33 and 34, the temporary stacking section 38, the bill storage chamber 51 and the convey paths R1 to R15 in response to detection signals from the sensors 41*e*, 41*f*, 41*g*, 41*c* and 41*b* and the sensors 40*a* to 40*u* (ST52). If any bill is left in any part of the above components, the main control section 150 causes the CRT display unit 10 to display an alarm (ST53). Upon generation of the alarm, the bank personnel remove bills from the above components (ST54). In this case, when the replenishing button 163 is depressed, the replenishing operation to be described later is performed. At this time, the main control section 150 causes the CRT display section 10 to display a message "Loading. Please wait".

The main control section 150 then checks in response to the detection signal from the sensor 41*h* whether or not a bill is present in the fourth storage section 23 (ST55). If it is determined that no bill is present, the main control section 150 causes the operating state code display 161 of the internal monitor unit 13 to display an error code representing the absence of any bill and to generate an alarm (ST56). Upon display of this indication and generation of the alarm, the personnel enter a mixture of bills of the second and third denominations in the fourth storage section 23 of the fourth bill cassette 19 (ST57). In this case, since the loading button 160 has already been depressed, it is detected to be NO (ST58) when it is checked whether or not the bills are replenished during servicing of the machine, and the routine advances to the next step (ST59A).

When the bills are sufficiently present and no residual bill is present in the machine, the main control section 150 causes the bill receiving/dispensing mechanism 12 to dispense bills, one by one, from the storage section 23 in the same manner as the deposit transaction operation (ST59A). The bill is then conveyed along the fourteenth convey path R14 and the rear half portion of the first convey path R1 and passes through the discrimination section 36. The discrimination section 36 discriminates the bill (ST59B) and the discrimination result is supplied to the main control section 150. The main control section 150 causes the counter to count the number of bills of the second and third denominations by the discrimination results and checks whether the bills are "authentic". Therefore, the authentic bills passed through the discrimination section 36 are stacked in the corresponding temporary storage sections 34 and 33 (ST59C). In practice, the selector gate 39*a* is pivoted to the left, and the authentic bills passed through the discrimination section 36 are conveyed toward the corresponding storage sections 21 and 22 through the second convey path R2, as indicated by the thick solid line in FIG. 34. On the other hand, the rejected bills passed through the discrimination section 36 are conveyed in the temporary stacking section 38 through the third convey path R3 since the selector gate 39*a* is pivoted to the right (ST59D).

When the third temporary storage section 34 or the second temporary storage section 33 is filled with 100 bills, or when the fourth storage section 23 becomes empty (ST59E), the fourth storage section 23 temporarily stops dispensing the bills (ST59F), and the bills stacked in the temporary storage section 33 or 34 are stored in the second or third storage section 21 or 22 (ST60). When this storage operation is completed and the bills are still left in the fourth storage section 23, the bills are dispensed from the fourth storage section 23. When the temporary storage sections 33 or 34 is filled again with 100 bills, the dispensing operation is temporarily stopped, so that the bills in the temporary storage section 33 or 34 are stored in the corresponding storage section. This operation continues until the fourth storage section 23 becomes empty. The empty-state sensor 42 thus detects the absence of bills in the fourth storage section 23, and at the same time the sensor 41*h* generates the "bright" signal (ST61). When the last bill is conveyed and all bills are stacked in the temporary storage section 33 or 34, the main control section 150 detects that no residual bill is present along the convey paths R1 to R15 in response to the detection signals from the sensors 40*a* to 40*u*. As a result, the respective convey members are stopped.

Figure 34:
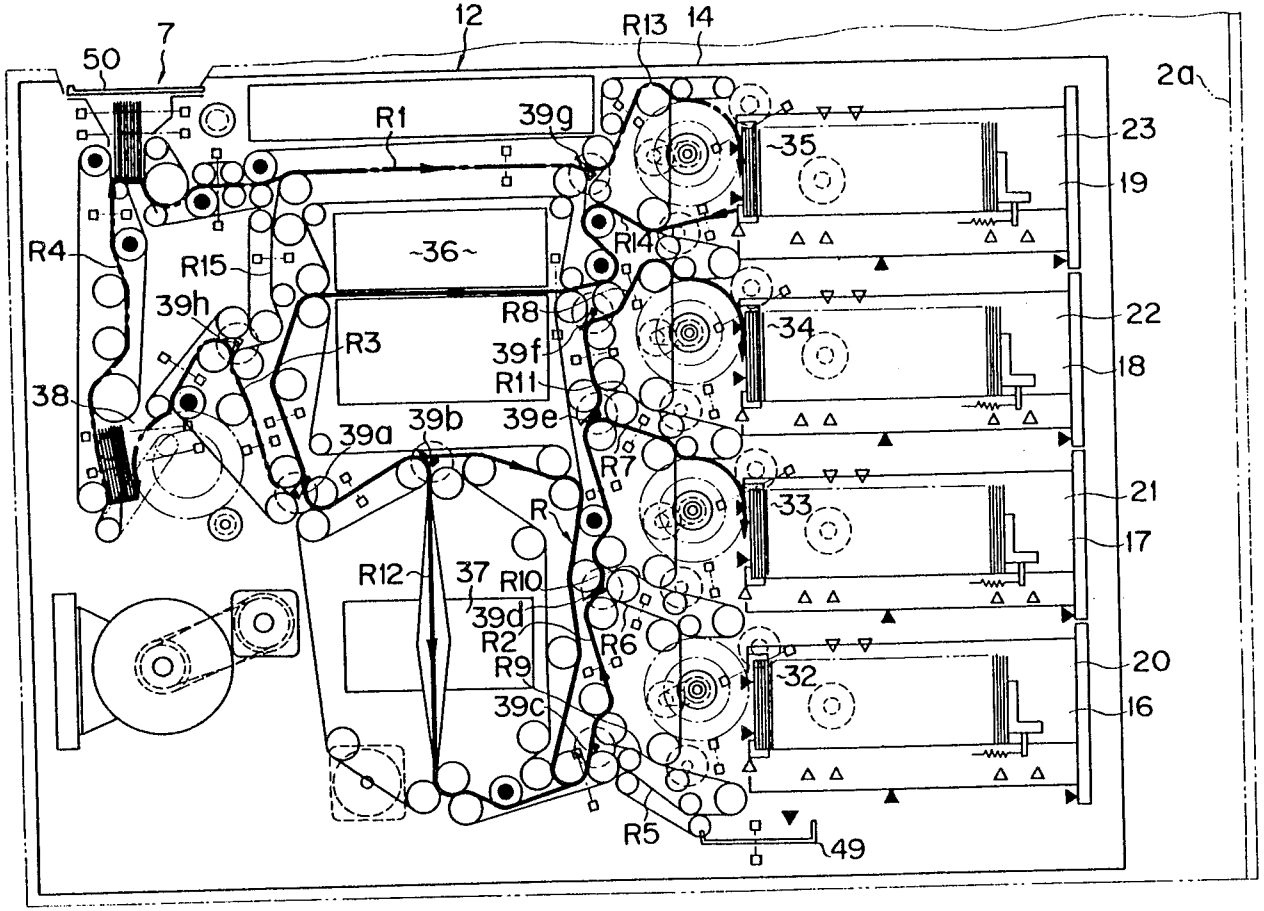
Figure 35:
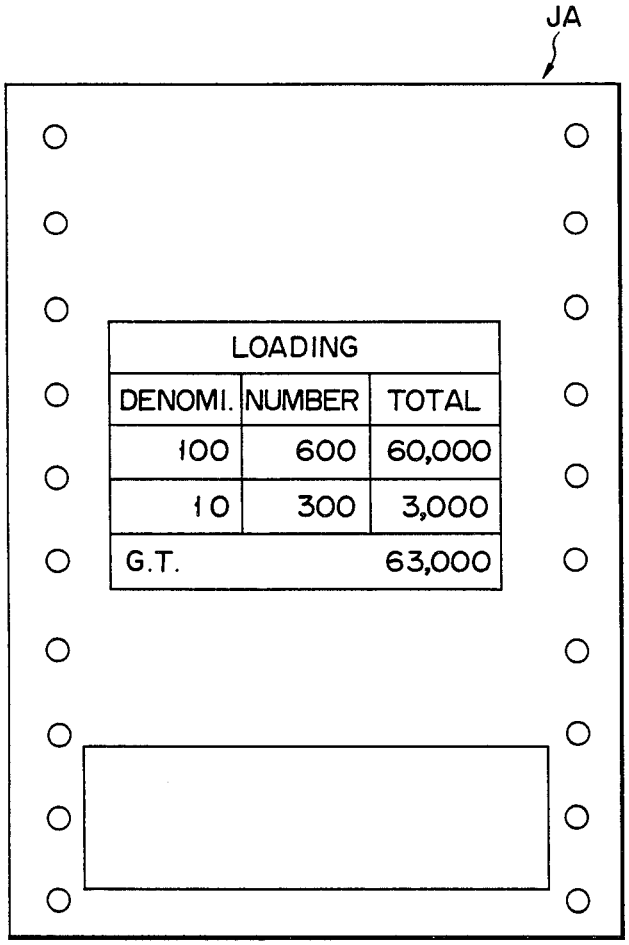

Thereafter, the main control section 150 is operated to collectively convey the bills stacked in the temporary stacking section 38 to the bill storage chamber 51, as indicated by the thick alternate long and short dashed line in FIG. 34 (also see FIG. 7). The bills in the bill storage chamber 51 are conveyed, one by one, in the same manner as in the recovery operation and are stacked in the temporary storage section 35 of the fourth storage section 23. Upon detecting that no residual bill is present, the bills are stored in the fourth storage section 23 (ST62).

Figure 25C:
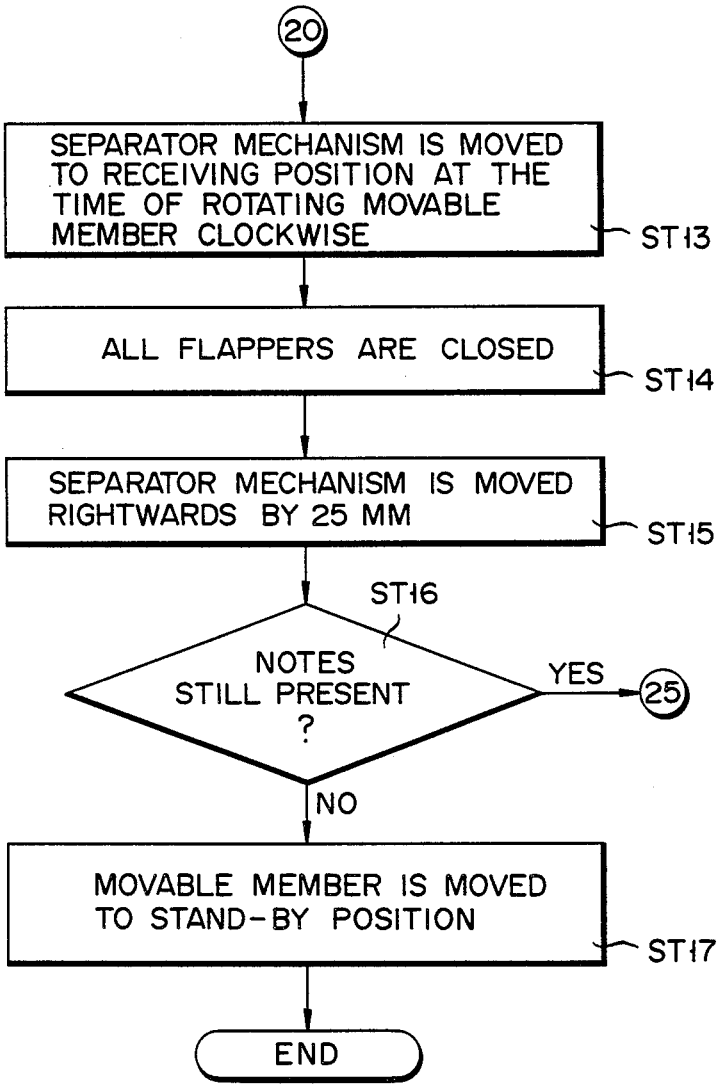

When a series of loading procedures are performed as described above, the main control section 150 causes the printer (not shown) in the card/receipt processing unit 11 to print the loading content (i.e., the number of bills of the second and third denominations, and their total amount) on a journal JA and to issue the printed journal, as shown in FIG. 25. At the same time, the main control section 150 causes the bill number display 164 of the internal monitor unit 13 to display the number of bills of each of the second and third denominations (ST63). When a rejected bill is returned to the fourth storage section 23, the main control section 150 causes a recovery/loading indicator 174 to signal to the bank personnel.

Upon signaling of the recovery/loading indicator 174, the bank personnel remove the bills returned to the fourth storage section 23 by removing the fourth bill cassette 19 from the apparatus 1 and count the number of returned bills. The bank personnel identify the initially preset number of bills of each of the denominations, and their amounts in accordance with the count of bills, the printed content of the journal JA and the display content of the internal monitor unit 13. When confirmation is completed, the bank personnel depress the confirmation button 166 of the internal monitor unit 13 (ST64A). In this manner, the bills stacked in the temporary storage sections 33 and 34 are stored in the corresponding storage sections 21 and 22 (ST63B), thus completing the loading operation.

When the personnel over/underload the bills during loading or when an identification cannot be performed due to personnel's miscalculation, the personnel depress the bill return button 167 of the internal monitor unit 13 (ST65A). In this case, all the bills loaded in the second and third storage sections 22 and 23 and the temporary storage sections 34 and 33 are dispensed one by one in the same manner as in the withdrawal transaction operation and are conveyed in the discrimination section 36 through the tenth convey path R10 or the eleventh convey path R11, the rear half portion of the second convey path R2, and the rear half portion of the first convey path R1 as indicated by the thick solid line in FIG. 36. The selector gates 39*a*, 39*h* and 39*g* are pivoted to the right, left and right, respectively. Therefore, the bills passing through the discrimination section 36 are conveyed in the third convey path R3 in accordance with the right position of the selector gate 39*a* and are conveyed in the fifteenth convey path R15 in accordance with the left position of the selector gate 39*h*.

Figure 36:
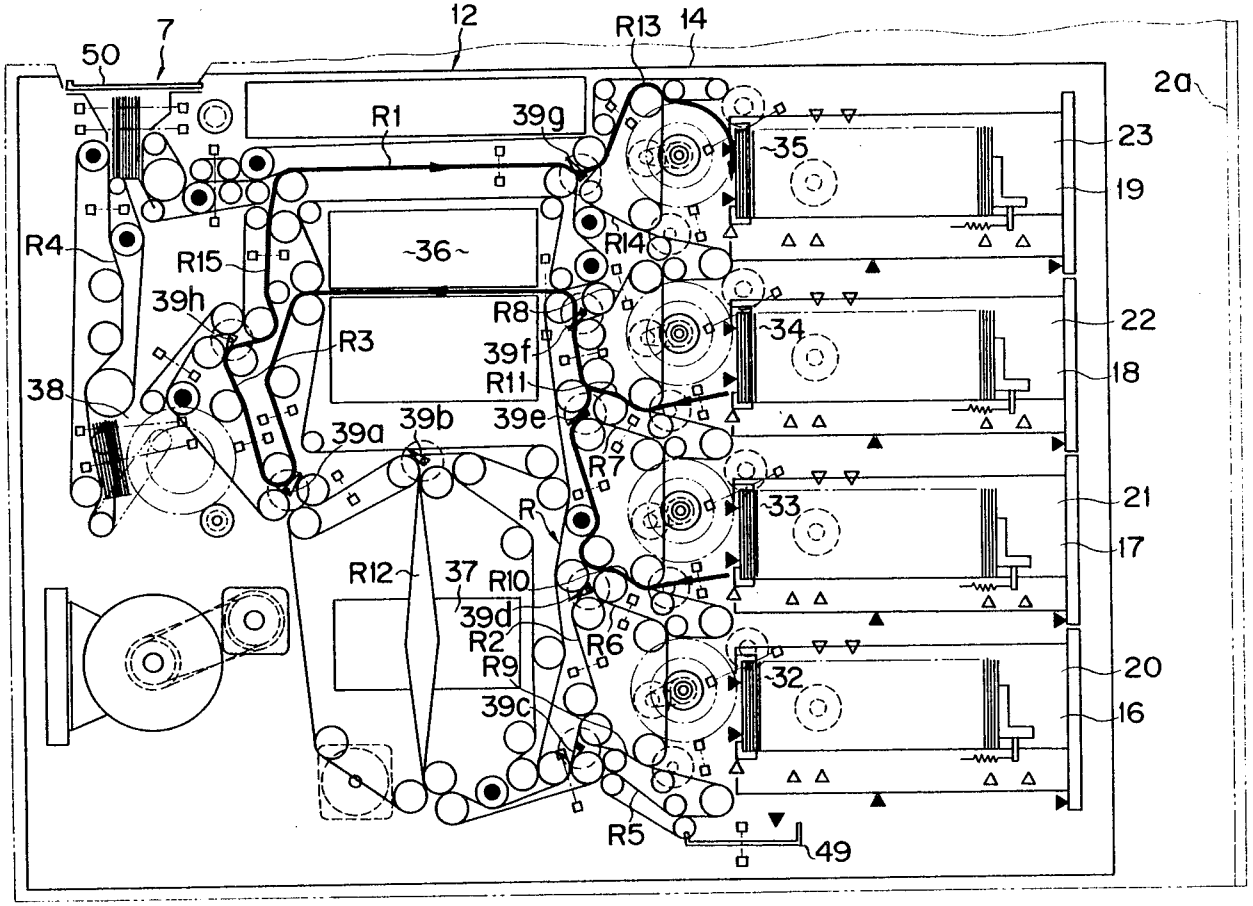

Thereafter, the bills are conveyed from the fifteenth convey path R15 to the first convey path R1 and are conveyed in the thirteenth convey path R13 in accordance with the left position of the selector gate 39*g*. The returned bills are then stored in the temporary storage section 35 of the fourth storage section 23 and then in the fourth storage section 23. This operation is repeated in the same manner as in loading every time 100 bills are stacked, so that the third and second storage sections 22 and 21 and the corresponding temporary storage sections 34 and 33 become empty. The above operation is repeated until no more bills are conveyed along the convey path (ST65B), thus completing return operation at the time of loading. The flow of bills in the return operation at the time of loading is illustrated in FIG. 36.

As described above, the loading operation is repeated by stacking/storing in denominated units of 100 notes or bills. Therefore, even if notes or bills become jammed in the dispensing section, the convey section and the stacking section, the bills received immediately before jamming occurs can be properly collected. In this manner, the bills stored in the third and second storage sections 22 and 21 need not be removed. In addition, only the bills which are stored in the temporary storage sections 34 and 33 and which are being dispensed can be removed. Thereafter, the apparatus is reset, and can be subjected to subsequent loading when the loading button 160 is depressed. In this manner, the recovery operation can be easily performed when trouble occurs.

When initial loading of the bills is performed, the "fit" bills which are obversely presented must be set in conventional daily loading. However, according to the apparatus of the present invention, the "denomination discrimination", the "obverse/reverse discrimination", the "fit/unfit discriminaiton", and "authentic/false discrimination" are performed even if the obverse- and reverse-presented fit and unfit bills are mixed in the same manner as in the deposit transaction. Initial loading is performed every morning, wherein a great number of bills must be loaded. Therefore, it takes a long period of time to complete initial loading. During initial loading, the automatic bank note transaction apparatus is preferably not used so as to provide a better service to the customers.

According to the present invention as described in detail, the apparatus can be easily set in the standby mode even if abnormal paper sheet dispensing occurs.

What is claimed is:

1. A paper sheet dispensing apparatus comprising:

storage means for stacking paper sheets along a predetermined stacking direction, said storage means having an outlet port on one edge of one end thereof;

rotating means, rotatably disposed at said outlet port, for engaging one of the paper sheets stacked in said one end of said storage means;

biasing means for biasing the paper sheets toward said rotating means so as to cause said rotating means to be engaged with said one of the paper sheets;

first driving means for rotating said rotating means to convey said one of said paper sheets which is engaged with said rotating means through said outlet port in response to rotation of said rotating means;

first engaging means, movable in the predetermined stacking direction, for freely engaging with a paper sheet whose end is located in a position opposite to said one edge of said storage means;

second driving means for moving said first engaging means apart from said rotating means in the predetermined stacking direction while said first engaging means continues to be engaged with said one end of the paper sheets; and third driving means for moving said first engaging means thereby disengaging said first engaging means from said one end of the paper sheet after said first engaging means is moved apart from said rotating means by said second driving means, wherein the paper sheets disengaged from said first engaging means by said third driving means are engaged with said rotating means due to the biasing force of said biasing means.

2. The apparatus according to claim 1, further comprising:

second engaging means, movable in the predetermined stacking direction, for freely engaging with the other end of the paper sheet opposite to said one end of the paper sheet; and fourth driving means for moving said second engaging means such that said second engaging means disengages the other end of the paper sheet after a predetermined number of paper sheets have been taken out of said storage means by said rotating means, wherein said second driving means for moving said first and second engaging means apart from said rotating means in the predetermined stacking direction when said second engaging means is disengaged from the paper sheet by said fourth driving means.

3. The apparatus according to claim 2, further comprising first detecting means for detecting whether any paper sheet is left at said outlet port before said third driving means causes said first engaging means to disengage from the paper sheet after said second driving means moves said first and second engaging means.

4. The apparatus according to claim 3, wherein said first detecting means comprises: a lever movable between a first position where said lever engages with the paper sheet at said outlet port and a second position where said lever enters in said outlet port at which no paper sheet is present; and a sensor for generating a signal which represents the presence of paper sheets at said outlet port when said lever is located at the first position and for generating a signal representing an absence of paper sheets at said outlet port when said lever is located at the second position.

5. The apparatus according to claim 4, wherein said first driving means drives said rotating means to remove any paper sheet left at said outlet port when said first detecting means detects that any paper sheet is left at said outlet port.

6. The apparatus according to claim 1, wherein the predetermined stacking direction is a horizontal direction.

7. The apparatus according to claim 6, wherein said outlet port is formed at a lower portion of said storage means.

8. The apparatus according to claim 7, wherein said first and second engaging means engage with upper and lower ends of the paper sheet, respectively.

9. The apparatus according to claim 8, wherein said first and second engaging means comprise upper and lower flappers which can engage with the upper and lower ends of the paper sheet, respectively, each of said upper and lower flappers being pivoted between a first position where each of the lower and upper flappers is engaged with the corresponding end of the paper sheet and a second position where each of the lower and upper flappers is disengaged from the corresponding end of the paper sheet.

10. The apparatus according to claim 9, wherein each of said upper and lower flappers comprises a substantially L-shaped member one end of which has a pivot pin and the other end of which has an engaging portion for engaging with the paper sheet.

11. The apparatus according to claim 10, further comprising second detecting means for detecting whether or not any paper sheet is left at said outlet port before said second driving means moves said first engaging means.

12. The apparatus according to claim 11, wherein said engaging portion of said lower flapper has a through hole.

13. The apparatus according to claim 12, wherein said second detecting means comprises: a lever movable between a first position where said lever engages with the paper sheet at said outlet port and a second position where said lever enters in a through hole of said lower flapper; and a sensor for generating a signal which represents the presence of paper sheets at said outlet port when said lever is located at the first position and for generating a signal representing an absence of paper sheets when said lever is located, at the second position.

14. The apparatus according to claim 13, further comprising first detecting means for detecting whether or not any paper sheet is left at said outlet port after said third driving means moves said first and second engaging means and before said fourth driving means causes said second engaging means to disengage from the paper sheets.

15. The apparatus according to claim 14, wherein said first detecting means comprises: a lever movable between a first position where said lever engages with the paper sheet at said outlet port and a second position where said lever enters in said outlet port in which no paper sheet is present; and a sensor for generating a signal which represents the presence of paper sheets at said outlet port when said lever is located at the first position and for generating a signal representing an absence of paper sheets when said lever is located at the second position.

16. The apparatus according to claim 4, wherein said first driving means drives said rotating means to remove any paper sheet left at said outlet port when said first detecting means detects that any paper sheet is left at said outlet port.

17. The apparatus according to claim 16, wherein said first detecting means comprises a detector which is commonly used with said second detecting means.

18. A paper sheet dispensing apparatus comprising:

storage means for storing paper sheets stacked in one direction including an outlet port defined at one end of said storage means to permit said paper sheets to be sequentially removed from said storage means;

rotating means operatively disposed at said outlet port of said storage means for engaging a first one of said paper sheets in said stack and for conveying said first one through said outlet port in response to rotation of said rotating means to thereby sequentially remove said paper sheets from said storage means;

biasing means for biasing said stack of paper sheets in said one direction towards said rotating means;

an engaging member movable between an engaged position wherein said engaging member is engaged with said first one of said paper sheets and a disengaged position wherein said engaging member is disengaged from said first one of said paper sheets;

mounting means for mounting said engaging member for reciprocal rectilinear movements in said one direction between near and far positions relative to said rotating means; and drive means operatively connected to said engaging member for (a) moving said engaging member in said second direction, opposite to said one direction from said near position and into said far position while said engaging member is in said engaged position, and thereafter (b) moving said engaging member from said engaged position and into said disengaged position such that said first one of said paper sheets in said stack is caused to be biased in said one direction towards engagement with said rotating means to thereby be conveyed through said outlet port.

19. A paper sheet dispensing apparatus as in claim 18 further comprising:

detecting means associated with outlet port for detecting the presence of a paper sheet in said outlet port before said driving means moves said engaging member from said engaged position to said disengaged position and for generating a detection signal representative of the presence of a paper sheet in said outlet port; wherein said rotating means receives said detection signal and rotates in response thereto to remove said paper sheet from said outlet port.

* * * * *